US012472397B2

(12) United States Patent
Sherin

(10) Patent No.: US 12,472,397 B2
(45) Date of Patent: Nov. 18, 2025

(54) ADJUSTABLE-FORCE RESISTANCE CABLE RETRACTOR

(71) Applicant: Keph Sherin, Lake Oswego, OR (US)

(72) Inventor: Keph Sherin, Lake Oswego, OR (US)

( * ) Notice: Subject to any disclaimer, the term of this patent is extended or adjusted under 35 U.S.C. 154(b) by 151 days.

(21) Appl. No.: 18/460,402

(22) Filed: Sep. 1, 2023

(65) Prior Publication Data

US 2024/0082622 A1 Mar. 14, 2024

Related U.S. Application Data

(60) Provisional application No. 63/403,461, filed on Sep. 2, 2022.

(51) Int. Cl.

| | |
|---|---|
| ***A63B 21/00*** | (2006.01) |
| ***A63B 21/02*** | (2006.01) |
| ***A63B 21/04*** | (2006.01) |
| ***A63B 21/16*** | (2006.01) |

(52) U.S. Cl.

CPC ..... *A63B 21/153* (2013.01); *A63B 21/026* (2013.01); *A63B 21/0435* (2013.01); *A63B 21/16* (2013.01)

(58) Field of Classification Search

CPC . A63B 21/00065; A63B 21/02; A63B 21/023; A63B 21/025; A63B 21/026; A63B 21/04; A63B 21/0407; A63B 21/0414; A63B 21/0435; A63B 21/151; A63B 21/153; A63B 21/157; A63B 21/22; A63B 21/222

See application file for complete search history.

(56) References Cited

U.S. PATENT DOCUMENTS

| | | | | |
|---|---|---|---|---|
| 4,135,714 | A | 1/1979 | Hughes | |
| 4,328,965 | A | 5/1982 | Hatfield | |
| 4,456,247 | A | 6/1984 | Ehrenfried | |
| 4,685,670 | A | 8/1987 | Zinkin | |
| 4,779,866 | A | 10/1988 | Marshall et al. | |
| 4,815,731 | A * | 3/1989 | Suarez | A63B 21/055 482/126 |
| 4,944,511 | A | 7/1990 | Francis | |
| 4,961,573 | A | 10/1990 | Wehrell | |
| 4,979,733 | A | 12/1990 | Prud'Hon | |
| 5,090,694 | A | 2/1992 | Pauls et al. | |
| 5,147,265 | A | 9/1992 | Pauls et al. | |
| 5,226,867 | A | 7/1993 | Beal | |
| 5,382,212 | A | 1/1995 | Davenport et al. | |
| 5,486,149 | A | 1/1996 | Smith et al. | |

(Continued)

OTHER PUBLICATIONS

International Search Report and Written Opinion received for International Application No. PCT/US2017/048703, mailed Nov. 6, 2017, 8 pages.

(Continued)

*Primary Examiner* — Zachary T Moore

(74) *Attorney, Agent, or Firm* — Morrison & Foerster LLP

(57) ABSTRACT

Apparatuses and methods for providing adjustable levels of resistances are disclosed. In some embodiments, the apparatus comprises a resistance module configured to provide a resistance. In some embodiments, the resistance module is configured to provide a constant-force resistance. In some embodiments, the apparatus comprises a continuously-variable gear for providing a continuously-variable resistance.

18 Claims, 70 Drawing Sheets

(56) References Cited

U.S. PATENT DOCUMENTS

| | | | | |
|---|---|---|---|---|
| 5,505,681 | A | 4/1996 | Bruggemann | |
| 5,586,962 | A | 12/1996 | Hallmark | |
| 5,618,249 | A | 4/1997 | Marshall | |
| 5,733,231 | A * | 3/1998 | Corn | A63B 21/153 482/127 |
| 6,120,423 | A | 9/2000 | Mackey et al. | |
| 6,436,006 | B1 | 8/2002 | Zemlyakov et al. | |
| 6,440,044 | B1 | 8/2002 | Francis et al. | |
| 6,685,602 | B2 * | 2/2004 | Colosky, Jr. | A63B 23/00 482/904 |
| 6,733,428 | B2 | 5/2004 | List | |
| 6,790,166 | B2 | 9/2004 | Broudy | |
| 6,837,838 | B2 | 1/2005 | List | |
| 6,929,589 | B1 * | 8/2005 | Bruggemann | A63B 21/025 482/904 |
| 7,137,936 | B1 | 11/2006 | Shaw et al. | |
| 7,229,391 | B2 | 6/2007 | Francis | |
| 7,462,141 | B1 | 12/2008 | Raboin et al. | |
| 7,468,019 | B2 | 12/2008 | Zylstra | |
| 7,871,359 | B2 | 1/2011 | Humble et al. | |
| 7,878,955 | B1 | 2/2011 | Ehrlich et al. | |
| 8,002,677 | B2 | 8/2011 | Dibble et al. | |
| 8,348,816 | B2 | 1/2013 | Gerschefske et al. | |
| 8,715,146 | B2 | 5/2014 | Bronston et al. | |
| 9,199,123 | B2 | 12/2015 | Solow et al. | |
| 9,320,936 | B1 | 4/2016 | Rea et al. | |
| 9,370,679 | B2 | 6/2016 | Lagree et al. | |
| 9,700,314 | B2 | 7/2017 | Marczyk | |
| 10,343,006 | B2 * | 7/2019 | Francis | A63B 21/045 |
| 10,556,143 | B2 * | 2/2020 | Sherin | A63B 21/00065 |
| 10,561,880 | B2 | 2/2020 | Pollock | |
| 10,780,307 | B2 | 9/2020 | Lagree et al. | |
| 11,179,590 | B1 | 11/2021 | Nicholas | |
| 11,786,775 | B2 | 10/2023 | Sherin | |
| 2002/0025891 | A1 | 2/2002 | Colosky, Jr. et al. | |
| 2004/0102294 | A1 | 5/2004 | Chen | |
| 2005/0101447 | A9 | 5/2005 | Pyles et al. | |
| 2005/0181915 | A1 | 8/2005 | Hoecht et al. | |
| 2006/0063650 | A1 | 3/2006 | Francis | |
| 2008/0085820 | A1 | 4/2008 | Majkrzak | |
| 2010/0016131 | A1 | 1/2010 | Hoffman | |
| 2010/0130338 | A1 | 5/2010 | Wehrell | |
| 2010/0204024 | A1 | 8/2010 | Mills et al. | |
| 2010/0267533 | A1 | 10/2010 | Susnjara | |
| 2015/0111705 | A1 | 4/2015 | Walker et al. | |
| 2018/0214731 | A1 * | 8/2018 | Sherin | A63B 21/025 |
| 2019/0126095 | A1 | 5/2019 | Zerbo et al. | |
| 2019/0160320 | A1 | 5/2019 | Lagree et al. | |
| 2022/0168606 | A1 * | 6/2022 | Herring | A63B 21/153 |

OTHER PUBLICATIONS

International Search Report and Written Opinion received for International Application No. PCT/US2018/015571, mailed Apr. 13, 2018, 9 pages.

* cited by examiner

ADJUSTABLE-FORCE RESISTANCE CABLE RETRACTOR

CROSS-REFERENCE TO RELATED APPLICATIONS

This application claims the priority benefit of U.S. Provisional Application Ser. No. 63/403,461, filed Sep. 2, 2022, which is incorporated herein by reference in its entirely.

FIELD OF THE INVENTION

The present disclosure relates generally to a cable retractor device that provides adjustable-force resistance, including a constant-force resistance at each resistance level of a plurality of adjustable resistance levels, or a continuously-variable resistance.

BACKGROUND OF THE INVENTION

A cable retractor device can apply a force on the cable to cause the retraction, and one may exert an equal or greater force in an opposite direction to keep the cable from retracting. A cable retractor device may be used in a variety of exercises. These exercises may be physical therapy exercises or physical fitness exercises. In particular, existing cable retracting devices facilitate exercises that are not possible or practical with either body weight or free weights. Specifically, some physical therapy or physical fitness exercises are accomplished while free standing and without any additional equipment, simply incorporating only the body weight of the user. However, body weight exercises are not always possible or practical, for body weight may not represent the appropriate amount of resistance, and the gravitational force may not be in the appropriate direction for the exercise. Some physical therapy or physical fitness exercises are accomplished with the use of free weights. Yet, while the amount of resistive force can be better controlled using free weights, the force is still restricted to a single direction because the exercise relies on the force of gravity.

As such, to address these types of problems, some existing cable retractor devices provide resistance through an elastic band or a traditional spring. Elastic bands and traditional springs provide variable resistance such that as the range of motion of the exercise increases, the resistance provided by the elastic band or spring increases. However, variable resistance can be problematic in exercise devices because muscle strength varies depending on how far the muscle is extended. For example, most muscles are at their weakest state when fully extended. As a result, exercise devices employing variable resistance are often at their maximum resistance level when the muscle of the user is at its weakest, which results in a less efficient exercise for the user.

Another difficulty in designing cable retractor devices that facilitate exercises is that users differ in size and strength, and thus require differing levels of resistance to train optimally. Moreover, the resistance level required for an individual user can vary over time as the user progresses or regresses based on his or her training habits, muscle development, injury, etc. Some cable retractor devices have a single non-adjustable resistance level; others allow the resistance level to be adjusted but only in a cumbersome manner.

Thus, there is a need for a cable retractor device that can be used, as both a standalone device or as a component of other exercise equipment, to provide a constant-force resistance at each available resistance level, where the resistance level can easily be adjusted to accommodate for the diverse physical characteristics of different users.

BRIEF SUMMARY OF THE INVENTION

Apparatuses and methods for providing adjustable levels of resistances are disclosed. In some embodiments, the apparatus comprises a resistance module configured to provide a resistance. In some embodiments, the resistance module is configured to provide a constant-force resistance. In some embodiments, the apparatus comprises a continuously-variable gear for providing a continuously-variable resistance.

The present disclosure solves the aforementioned problems of previous devices by providing a cable retractor device and corresponding methods for providing adjustable-force resistance, including a constant-force resistance at each resistance level amongst a plurality of adjustable resistance levels provided by the device or a continuously-variable force resistance. In particular, the resistance level can be easily adjusted by the user as needed.

Other objects and features of the present disclosure will become apparent by a review of the specification, claims, and appended figures.

BRIEF DESCRIPTION OF THE DRAWINGS

For a better understanding of the various described embodiments, reference should be made to the Detailed Description of the Invention below, in conjunction with the following drawings in which like reference numerals refer to corresponding parts throughout the figures.

DETAILED DESCRIPTION OF THE INVENTION

Figure 1:
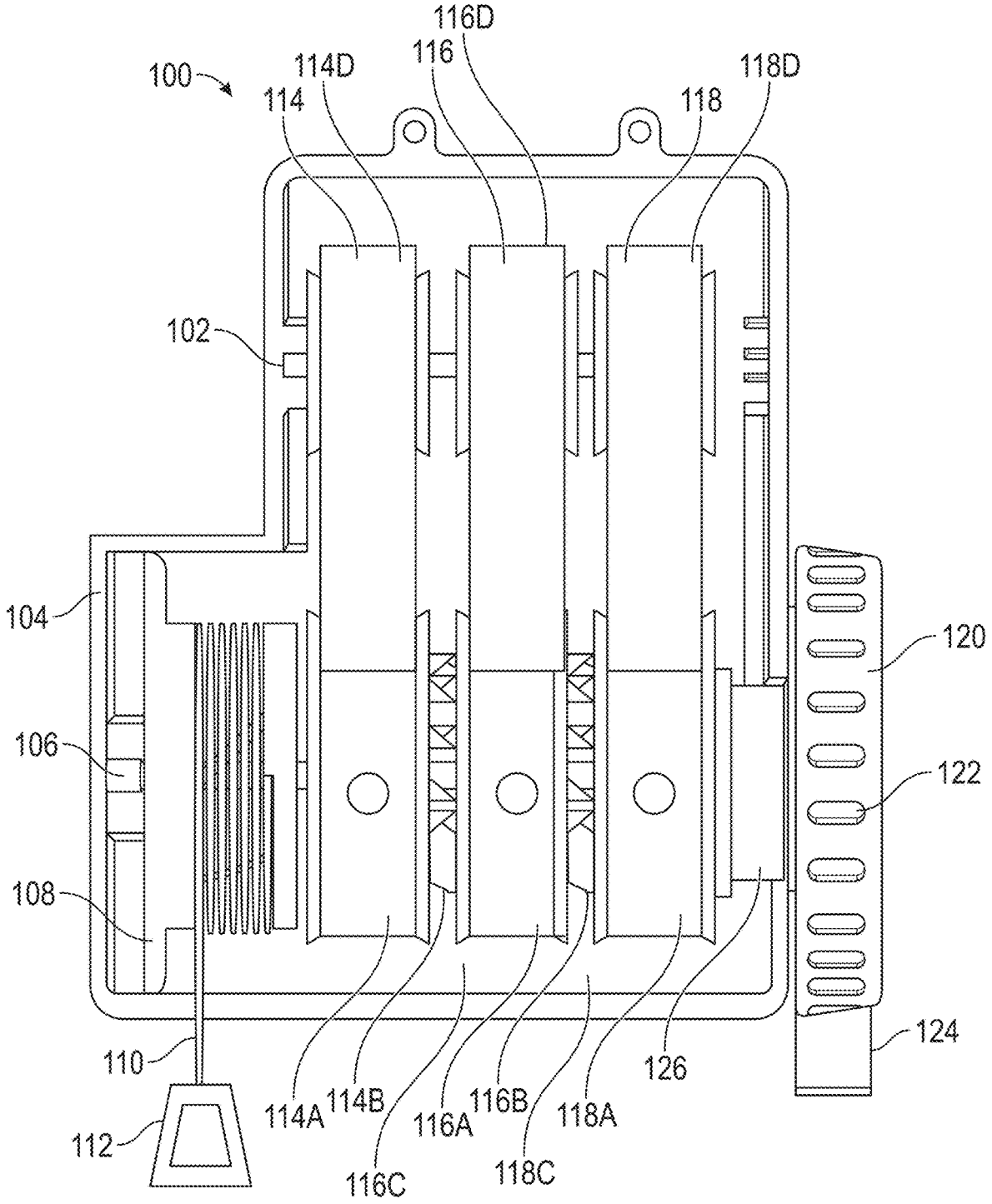
FIG. 1 illustrates a perspective view of an example cable retractor device where the resistance level can be adjusted through a resistance selector, according to some embodiments.

The following description sets forth example methods, parameters, and the like. It should be recognized, however, that such description is not intended as a limitation on the scope of the present disclosure, but is instead provided as a description of example embodiments.

The present disclosure is directed to a cable retractor device and methods of using the device. Importantly, the described cable retractor device can be used either as a standalone exercise device or as a component of other exercise equipment (e.g., as a part of a fitness system, as a part of a physical therapy system). For example, the cable retractor device may be used as a standalone device when attached, e.g., to a wall or any form of sliding system, rotating cam, or any other possible mounting system. The cable retractor can then be used for any number of exercises. Further, the cable retractor device may be used along with one or more additional cable retractor devices. Although examples of the device are described as a component of an exercising equipment, it should be appreciated that the device may be a component of a system providing incremental and/or variable forces for non-exercise uses.

The device includes a housing that encloses a set of resistance modules and a cord wrapped around a cord spool. The cord can pass through the housing when it is pulled off of the cord spool. Each resistance module contains a constant-force spring that is configured to resist the cord being pulled off of the cord spool during an exercise. The constant-force spring of the resistance module can be selected to provide the desired level of resistance (e.g., 1, 2, 3, 4 lbs.) provided by each resistance module. The constant-force springs can all be rated for the same load or can be rated for different loads. Furthermore, the device can be made to have any number of resistance modules. Additionally, each resistance module has engagement patterns that allow an adjacent resistance module to be coupled together to adjust the overall level of resistance. The overall resistance level of the device increases as an increasing number of resistance modules are coupled together because the constant-force spring in each of the coupled resistance modules resists the rotation of the cord spool as the cord is pulled off of the cord spool. Although examples of the device are described as comprising a spring for providing the constant-force resistance, it should be appreciated that the constant-force resistance may be provided via a different mechanism (e.g., an electric motor, magnetic force).

In one example embodiment, the device includes a resistance selector configured to adjust the coupling between adjacent resistance modules, thereby adjusting the resistance level of the device. In another example embodiment, each resistance module includes a switch configured to adjust the coupling of resistance modules. In another example embodiment, each resistance module is configured to be removable from the device.

FIG. 1 is a perspective view of one embodiment of a device 100. The device 100 includes a housing 104. The housing 104 encloses a cord spool 108, cord 110, axles 102 and 106, and resistance modules 114, 116, and 118. In some embodiments, the housing 104 has a cross-section that is rectangular. In other embodiments, the housing 104 may be any other shape including free form. The housing 104 may be any size sufficient to enclose the necessary components and to provide the necessary structural strength for the device 100.

The cord 110 wraps around the cord spool 108. In some embodiments, the cord 110 is made out of rope. In other embodiments, the cord 110 is made out of any number of materials including plastic, rubber, or any combination of those or other materials. In some embodiments, the cord spool 108 is outside of the housing that encloses the resistance modules (e.g., the cord spool 108 is in separate housing that is attached to the housing 104 enclosing the resistance modules 114, 116, 118).

Due to its length, the cord 110 may wrap around the cord spool 108 more than once and may wrap onto itself, adding to the total diameter (in addition to diameter of the cylindrical portion of the cord spool). This total diameter may dictate a force for pulling the cord spool 108. Because the cord may wrap around itself differently at different times, the force for pulling the cord spool 108 varies based on the varying total diameter. In some embodiments, the cord 110 comprises a strap having a width same as height of the cylindrical portion of the cord spool 108. The strap having this width may cause the variation in force to be advantageously more predictable because the strap would wrap around itself in a similar manner each time. In some embodiments, the strap wraps around the cylindrical portion once and does not cause a variation in force for rotating the cord spool. In some embodiments, an interface between the cord spool 108 and the cord 110 is shaped such that the total diameter variance caused by the cord 110 is offset by the shape. For example, the interface comprises wedges that provides this offset.

In some embodiments, the device 100 includes a handle 112 that connects to the cord 110. The cord 110 passes through an opening in the housing 104 when the cord is retracted onto or pulled off of the cord spool 108 using the handle 112. The handle 112 allows the user to pull the cord 110 off of the cord spool 108 when force is applied by pulling the handle 112. When force is removed from the handle 112, the cord 110 is retracted back onto the cord spool 108. The handle 112 can be made out of any number of materials or finishes, including wood, plastic, metal, rubber, or any combination of these or other materials. In some embodiments, other accessories can be attached to the cord 110.

Figure 2:
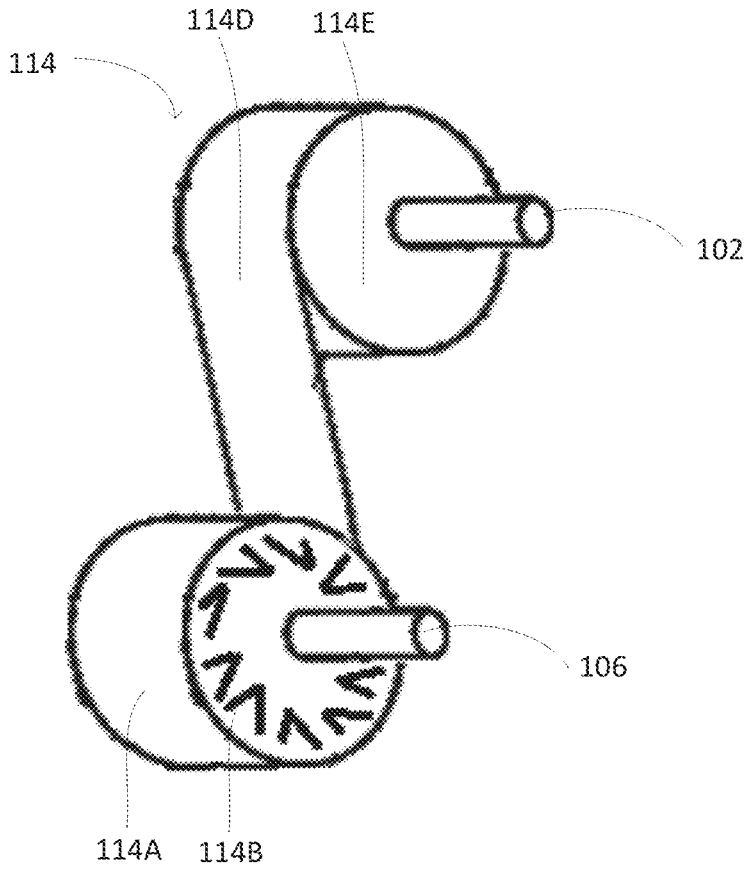
FIG. 2 illustrates a perspective view of an example resistance module, according to some embodiments.

The device may comprise one or more resistance modules, which may be used to adjust the resistance levels. FIG. 2 is a perspective view of an example resistance module 114. The housing 104 contains two or more resistance modules (e.g., resistance modules 114, 116, or 118). In an example embodiment, the first resistance module 114 includes a constant-force spring 114D, a first storage drum 114E, and a second storage drum 114A. The constant-force spring 114D is affixed to the first storage drum 114E and second storage drum 114A via a screw, adhesive, or any combination of those or other materials. In another example embodiment, the constant-force spring 114D is configured to wrap around the first storage drum 114E and the second storage drum 114A without being affixed to the first storage drum 114E or the second storage drum 114A.

Constant-force springs are a commercially available type of spring that provide nearly a constant load throughout the spring's range of motion. For example, for one commercially available spring, the load provided by the spring ramps up from no load to its rated load over the initial (e.g., 2-3) turns of the spring around the drum that stores the spring. After those initial turns, the constant-force spring provides roughly a constant load as the spring is moved throughout the spring's range of motion. The spring can provide a load that is within a certain percentage (e.g., 10%) of the rated load of the constant-force spring after the initial turns of the spring. Constant-force springs can provide a nearly identical load regardless of the orientation of the constant-force spring. For example, a constant-force spring provides a load when pulled parallel to the ground that is nearly identical as when pulled perpendicular to the ground.

In some embodiments, the constant-force spring 114D is configured to be in an S-shape arrangement. In the S-shape arrangement, the constant-force spring wraps around the first storage drum 114E in one direction (e.g., a clock-wise direction) and wraps around the second storage drum 114A in the opposite direction (e.g., a counter clock-wise direction). The axle 102 is configured to pass through the first storage drum 114E, and the axle 106 passes through the second storage drum 114A.

Figure 3:
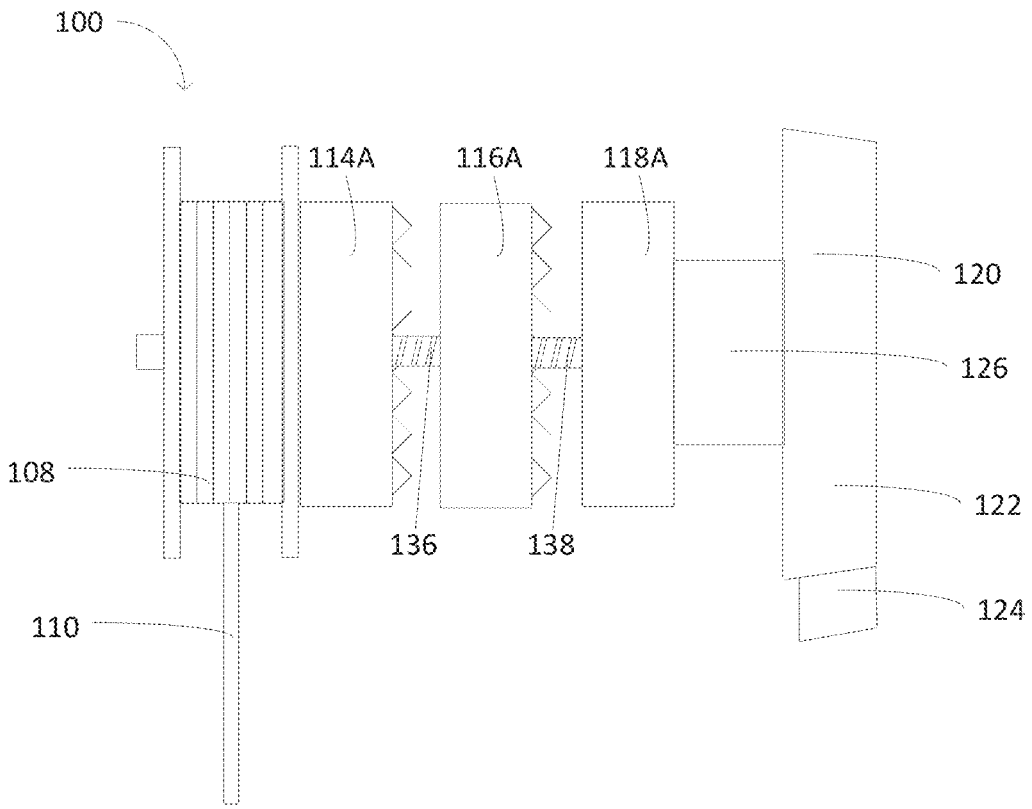
FIG. 3 illustrates compression springs separating the drums of example resistance modules, according to some embodiments.

In some embodiments, compression springs may be located between storage drums of adjacent resistance modules. As illustrated in FIG. 3, the device 100 includes a first compression spring 136 located between the second storage drum 114A of the first resistance module 114 and the second storage drum 116A of the second resistance module 116. In some embodiments, the device 100 includes a second compression spring 138 located between the second storage drum 116A of the second resistance module 116 and the second storage drum 118A of the third resistance module 118. In some embodiments, the first and second compression springs 136 and 138, respectively, are configured to have different load resistances, thus allowing the resistance modules to be selectively coupled in order to adjust the resistance level, as described in greater detail below. In some embodiments, the load resistance of the second compression spring 138 is greater than the load resistance of the first compression spring 136. In some embodiments, a compression spring separates the cable spool 108 from the second storage drum 114A.

Figure 4:
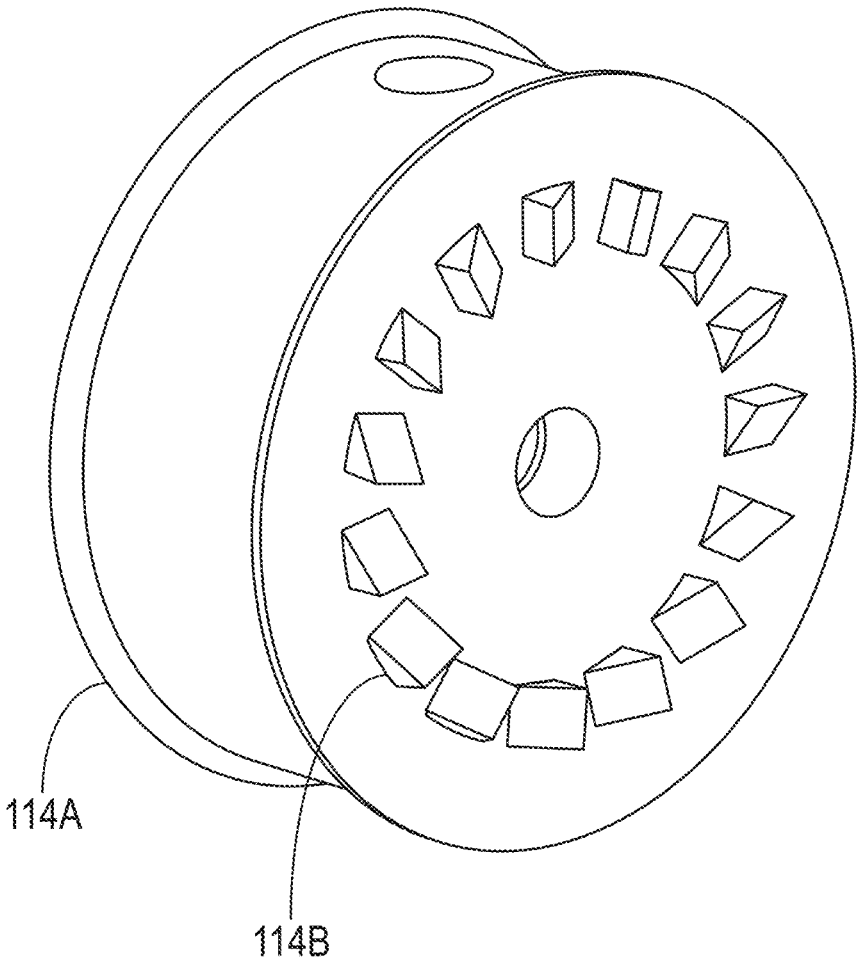
FIG. 4 illustrates a drum of an example resistance module having a teeth coupling component, according to some embodiments.
Figure 5:
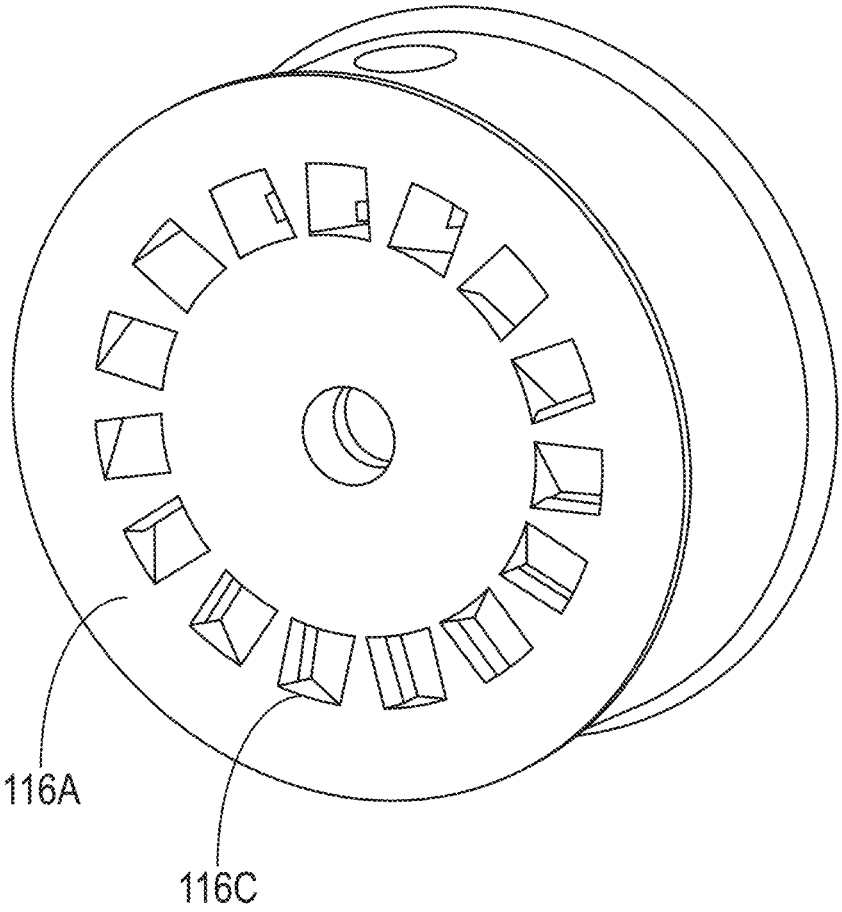
FIG. 5 illustrates a drum of an example resistance module having a teeth coupling component and corresponding receptive holes, according to some embodiments.

In some embodiments, the second storage drums may include engagement patterns to help with adjusting the resistance levels. For example, the second storage drum 114A includes an engagement pattern. In some embodiments, the engagement pattern is a set of teeth 114B. As shown in FIGS. 1, 4, and 5, the engagement pattern of one resistance module (e.g., teeth 114B of the second resistance module 114) are configured to match the engagement pattern of another resistance module (e.g., holes 116C of the adjacent second storage drum 116A of the third resistance module 116). The engagement patterns are configured to couple two adjacent drums together.

In other embodiments, the second storage drum 114A of the first resistance module 114 does not include holes and is instead affixed to the cord spool 108 such that the second storage drum 114A is rotated by the cord spool 108 when the cord spool 108 rotates. Thus, the constant-force spring 114D of the first resistance module resists the movement of the cord 110 off of the cord spool 108, and, as such, the device 100 provides resistance.

In some embodiments, the second storage drum 116A includes an engagement pattern on both sides of the drum. As an example, for the second resistance module 116, the engagement pattern on one side of the drum may be a set of teeth 116B, and the engagement pattern on the other side of the drum may be holes 116C. As shown in FIGS. 1, 4, and 5, the teeth 116B of the second resistance module 116 are configured to match the holes 118C on the adjacent second storage drum 118A of the third resistance module 118. Thus, the engagement patterns are configured to couple adjacent drums together.

In some embodiments, the second storage drum 118A has an engagement pattern on one side. As described above, the engagement pattern may be a set of holes 118C. In some embodiments, the second storage drum 118A is affixed to the pusher 126 such that second storage drum 118A is configured to move along the shaft 106 in the same direction as the pusher 126. As a result, the pusher 126 causes the coupling of one or more resistance modules (e.g., resistance modules 114, 116, and 118) together.

The device may include one or more shafts that pass through the resistance modules. For example, the shaft 106 is configured to pass through the cord spool 108, the second storage drums 114A, 116A, and 118A (of the first, second, and third resistance modules 114, 116, and 118, respectively), and the pusher 126. A shaft 102 is configured to pass through the first storage drums of the resistance modules 114, 116, and 118. The constant-force springs 114D, 116D, and 118D are configured to resist the rotation of second storage drums 114A, 116A, and 118A. Constant-force springs provide a constant level of resistance across the entire range that the second storage drums 114A, 116A, and 118A are rotated. Thus, the constant-force springs provide the device 100 with the ability to provide a constant resistance level as the handle 112 pulls the cord 110 off of the cord spool 108.

In some embodiments, the constant-force springs 114D, 116D, and 118D only resist movement of the cord 110 off of the cord spool 108 when the associated second storage drums 114A, 116A, and 118A are attached to the cord spool 108 or coupled with another second storage drum (e.g., when the second storage drum 114A is attached to the cord spool 108). As a result, the constant-force spring 114D resists the movement of the cord 110 off of the cord spool 108. In some embodiments, the constant-force spring 116D only resists the movement of the cord 110 off of the cord spool 108 when the second storage drum 116A of the second resistance module 116 is coupled to second storage drum 114A of the first resistance module 114. Similarly, the constant-force spring 118D resists the movement of the cord 110 off of the cord spool 108 only when the second storage drum 118A of the third resistance module 118 is coupled to the second storage drum 116D of the second resistance module 116. Thus, by selectively coupling the second storage drums 116A and 118A of the second and third resistance modules 116 and 118, respectively, to other second storage drums, the overall resistance level of the device 100 can be adjusted.

In some embodiments, the device 100 is configured to provide constant-force resistances in 0.5 to 100 pound increments. In some embodiments, the device 100 is configured to provide constant-force resistances in 0.5 to 50 pound increments. Accordingly, in some embodiments, a resistance module is configured to provide a constant-force resistance of 0.5 to 50 pounds. For example, the device 100 comprises resistance modules configured to provide incremental constant-force resistances of 1, 2, 2.5, 3, 5, 10, 15, 20, 25, 30, 40, 50, 75, or 100 pounds. The spring force of the spring in the resistance module may generate this constant-force resistance. In some embodiments, the force provided by the constant-force springs 114D, 116D, and 118B is selected based on the constant-force resistance provided by a corresponding resistance module (e.g., an incremental force value provided by the device 100). The spring force of a spring may be the constant-force resistance provided by a corresponding resistance module or less. For example, if the resistance module is configured to provide a constant-force resistance of 10 pounds (e.g., the device 100 is configured to provide forces in 10-pound increments), then a spring for providing the force is 10 pound or less (e.g., 5 pounds). As discussed in more detail below, in some embodiments, a gear ratio between a driving gear and driven gear for actuating the spring may be tuned based on a ratio between a desired constant-force resistance (e.g., the incremental force provided by the device 100) and a constant-force resistance provided by the spring.

Figure 6:
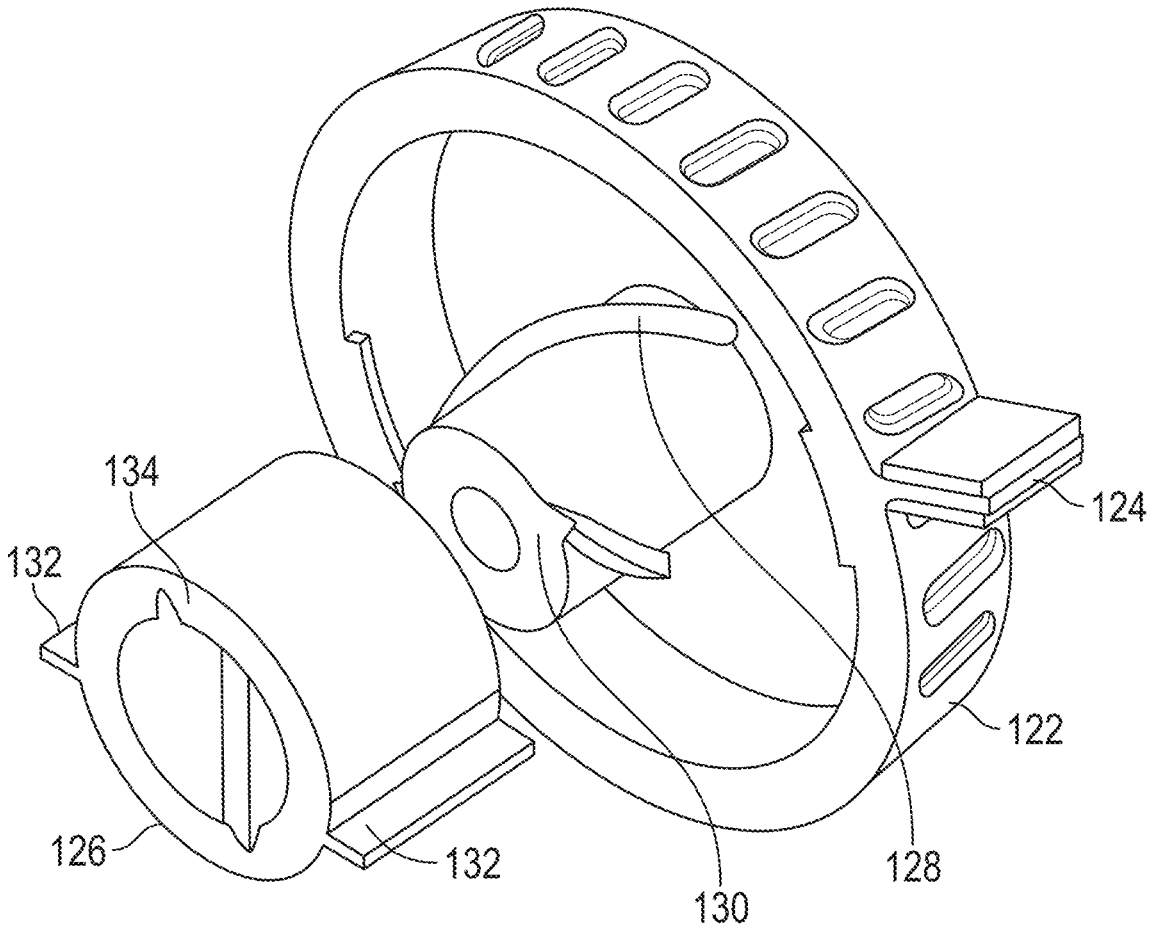
FIG. 6 illustrates an example resistance selector, according to some embodiments.
Figure 7:
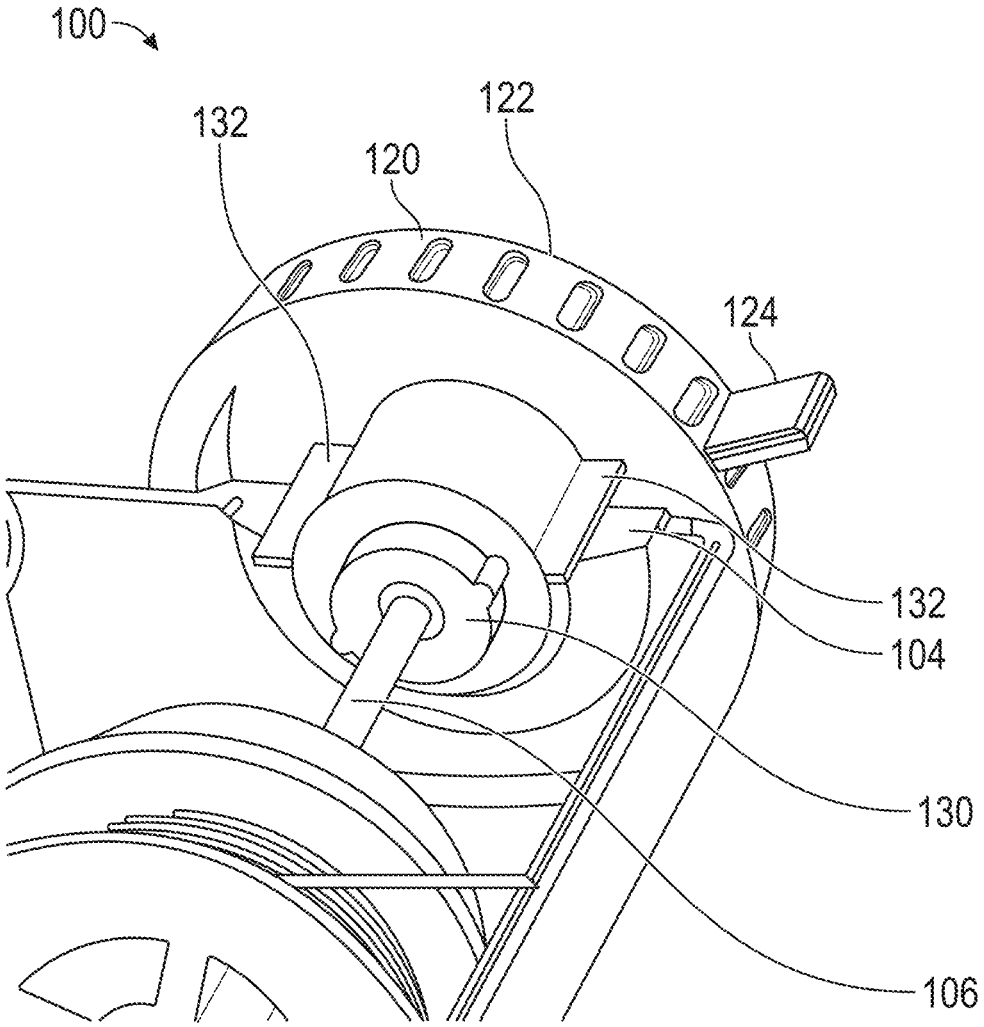
FIG. 7 illustrates an example resistance selector, according to some embodiments.

In some embodiments, the device 100 includes a resistance selector 120 that is configured to adjust the resistance level of the device 100. In one embodiment, the resistance selector 120 is comprised of an adjustment knob 122 and a pusher 126. In one embodiment, as illustrated in FIG. 6, the adjustment knob 122 includes a threaded shaft 130 and a thread 128 that wraps around the threaded shaft 130. The threaded shaft 130 passes inside the pusher 126. Further, the thread 128 is positioned inside a thread notch 134 of the pusher 126. As shown in the figure, the pusher 126 includes flaps 132 on two sides, which are configured to contact the housing 104. The flaps 132 are configured to prevent rotation of the pusher 126 around the shaft 106 when the resistance selector 120 is rotated. The flaps 132 are configured to force the pusher 126 to move along the shaft 106 in a direction determined by the direction that the resistance selector 120 is rotated. FIG. 7 illustrates the adjustment knob 122 and the shaft 106.

In some embodiments, when the resistance level is adjusted, the device 100 indicates to the user that a new resistance level has been set. For example, the adjustment knob 122 includes a resistance indicator 124 that displays a visual indication of the current overall resistance level. The indication of the overall resistance level can be tactile, audible, and/or visual.

The following describes the device 100 providing constant-force resistance at each resistance level amongst a plurality of adjustable resistance levels.

A resistance selector 120 is moved to a first constant resistance level. Rotating the adjustment knob 122 causes the threaded shaft 130 to rotate. The threaded shaft 130 rotating causes the thread 128 to rotate. The thread 128 rotating causes force to be applied to the pusher 126 via the threaded notch 134. The flaps 132 prevent the pusher from rotating around the shaft 106; instead, the pusher 126 is forced to move along the shaft 106. The force applied to the pusher 126 causes the pusher 126 to move forward or backward along the shaft 106 in a direction that depends on the direction that the adjustment knob is rotated.

The device 100 can be configured for the lowest resistance level by coupling only one resistance module to the cord spool 108. In some embodiments, none of the second storage drums 114A, 116A, and 118A are coupled together. In this configuration, only the constant-force spring 114D resists the movement of cord 110 off of the cord spool 108 because only the second storage drum 114A of the first resistance module 114 is attached to the cord spool 108.

In some embodiments, the device 100 can be configured for a second lowest resistance level by, e.g., coupling two resistance modules to the cord spool 108. Rotating the adjustment knob 122 of the resistance selector 120 in the direction that increases the resistance level results in the pusher 126 moving on the shaft 106 towards the second storage drum 116A of the second resistance module 116. Since the pusher 126 is attached to the second storage drum 118A, the movement of the pusher 126 causes the second storage drum 118A to compress the compression spring 138. The compression spring 138 resists the movement of the second storage drum 118A along the shaft 106 and causes the second storage drum 116A of the second resistance module 116 to move toward the second storage drum 114A of the first resistance module 114. As described above, the load resistance of the compression spring 136 is less than the load resistance of the compression spring 138. Because of this, as the adjustment knob 122 is rotated, the second storage drums 114A and 116A of the first and second resistance modules 114 and 116, respectively, couple together before the second storage drums 116A and 118A of the second and third resistance modules, respectively. This engagement causes the teeth 114B of second storage drum 114A (of the first resistance module 114) to couple with the holes 116C of the second storage drum 116A (of the second resistance module 116). When the teeth 114B and holes 116C are coupled in this manner, both constant-force springs 114D and 116D resist the cord 110 from being pulled off the cord spool 108 resulting in increased resistance.

The user pulls the cord 110 off of the cord spool 108. In this configuration, both constant-force springs 114D and 116D resist the movement of the cord 110 off of cord spool 108. This is because the second storage drum 114A of the first resistance module 114 is directly attached to cord spool 108 and the second storage drum 116A of the second resistance module 116 is coupled with the second storage drum 114A. Constant-force springs 114D and 116D are configured to resist the movement of the cord 110 off of cord spool 108.

The user stops pulling the cord 110, which causes the cord 110 to retract onto the cord spool 108. The cord retracts due to the force produced by constant-force springs 114D and 116D on second storage drums 114A and 116A.

In some embodiments, the device 100 can be configured for the highest resistance level by, e.g., coupling three resistance modules to the cord spool 108. The user rotates the resistance selector 120 to a second constant resistance level. Rotating the adjustment knob 122 in a direction that increases the resistance level results in the pusher 126 again moving on the shaft 106 towards the second storage drum 116A of the second resistance module 116. The compression spring 138 again resists the movement of the second storage drum 118A. When the adjustment knob 122 is rotated far enough, the second storage drums 116A and 118A of the second and third resistance modules 116 and 118, respectively, couple together. This coupling is caused by the teeth 116B of second storage drum 116A (of the second resistance module 116) coupling with the holes 118C of second storage drum 118A (of the third resistance module 118). When the teeth 116B and holes 118C are coupled, the constant-force springs 114D, 116D, and 118D all resist the cord 110 being pulled off the cord spool 108. This configuration represents the highest resistance level of the device 100 since the constant-force springs in resistance modules 114, 116, and 118 resist the cord 110 being pulled off the cord spool 108.

The user pulls the cord 110 off of the cord spool 108. In this configuration, the constant-force springs 114D, 116D, and 118D resist the movement of the cord 110 off of cord spool 108. This is because second storage drum 114A of the first resistance module 114 is directly attached to cord spool 108 and second storage drums 116A and 118A of the second and third resistance modules 116 and 118, respectively, are coupled with the second storage drum 114A (of the first resistance module 114). Constant-force springs 114D, 116D, and 118D are configured to resist the movement of the cord 110 off of cord spool 108.

The user stops pulling the cord 110, which causes the cord 110 to retract onto the cord spool 108. The cord retracts due to the force produced by constant-force springs 114D, 116D, and 118D on second storage drums 114A, 116A, and 118A.

Rotating the adjustment knob 122 in the direction that decreases the resistance level results in the pusher 126 moving the shaft 106 away from the second storage drum 116A. Since the pusher 126 is attached to the second storage drum 118A, the movement of the pusher 126 causes the second storage drum 118A of the third resistance module 118 to apply less force to the compression spring 138 and the second storage drum 116A of the second resistance module 116. When the adjustment knob 122 is rotated far enough, the teeth 116B of second storage drum 116A of the second resistance module 116 decouple from the holes 118C of the second storage drum 118A of the third resistance module 118. When the teeth 116B and teeth holes 118C are decoupled, only the constant-force springs 114D and 116D of the first and second resistance modules 114 and 116, respectively, resist the cord 110 from being pulled off the cord spool 108. Continuing to adjust the adjustment knob 122 in the same direction further decreases the resistance level as the teeth 114B and holes 116C of second storage drums 114A and 116A of the first and second resistance modules 114 and 116, respectively, decouple.

Figure 8:
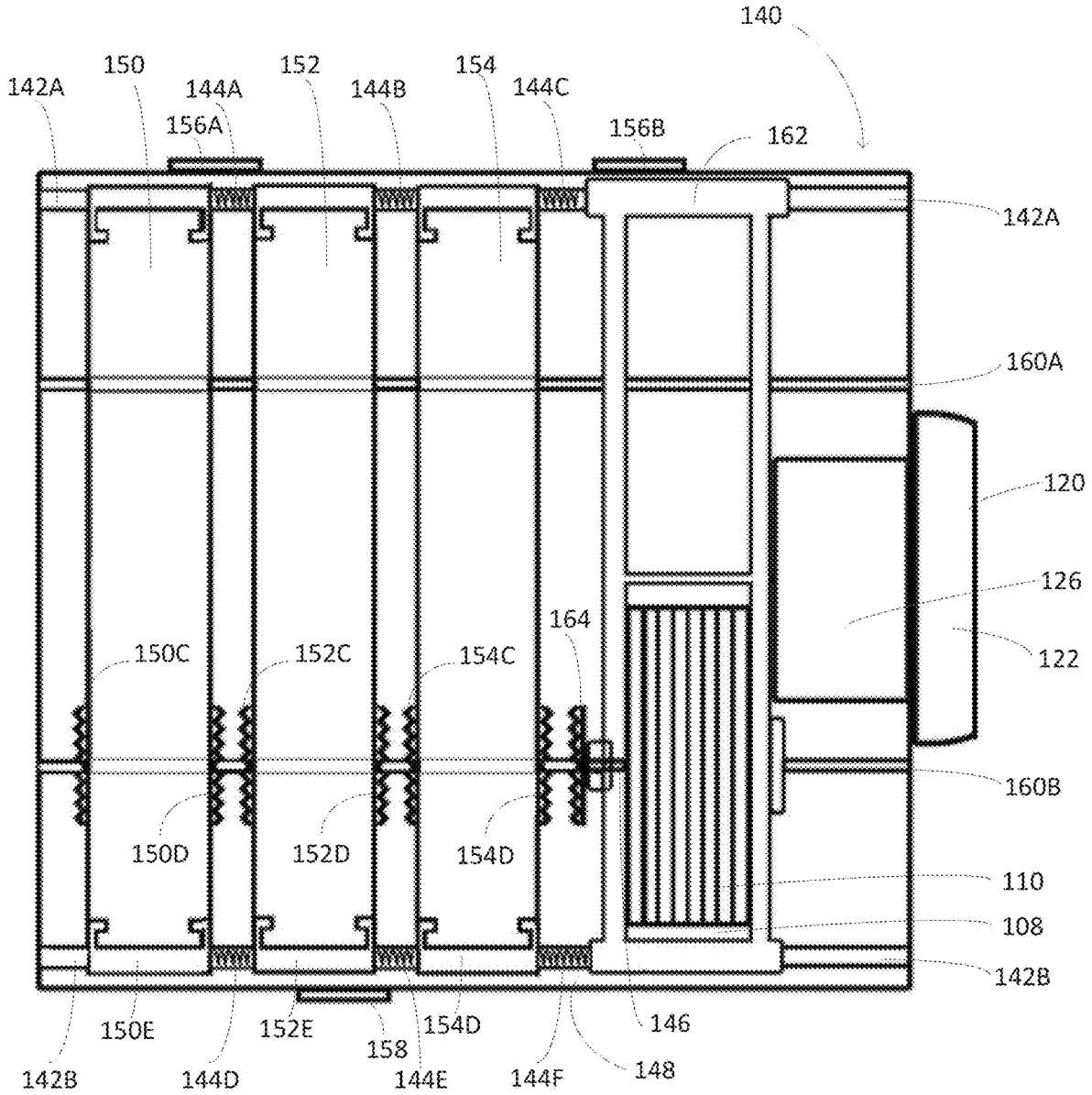
FIG. 8 illustrates another example cable retractor device that provides for removable resistance modules, according to some embodiments.

In some embodiments, the resistance modules may be removable. FIG. 8 is a perspective view of another example embodiment of the device. The device 140 includes a housing 148. The housing 148 encloses one or more removable resistance modules (e.g., resistance modules 150, 152, 154). As described below with reference to FIG. 9, a resistance module is configured to be easily removed from and inserted into the device 140. In some embodiments, the housing 148 also encloses a removable cord spool cartridge 162.

Figure 9:
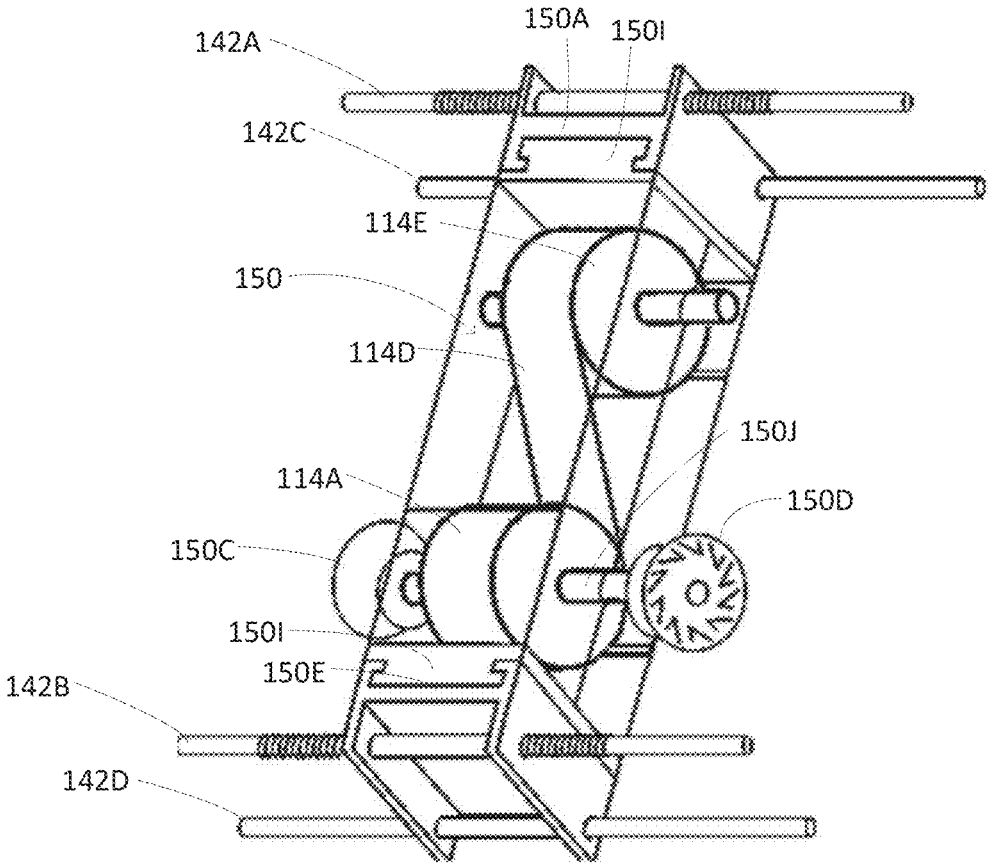
FIG. 9 illustrates an example removable resistance module, according to some embodiments.

FIG. 9 is a perspective view of an example removable resistance module 150. The removable resistance module 150 includes a module housing 1501. The module housing 1501 encloses a constant-force spring 114D, a first storage drum 114E, and a second storage drum 114A. A shaft 150J runs through the second storage drum 114A. The ends of the shaft 150J are configured with interlocking gears 150C and interlocking gears 150D. The gears are configured to form an engagement pattern such that the interlocking gears from one resistance module can couple with the interlocking gears of an adjacent resistance module. When the interlocking gears of adjacent resistance modules are coupled, the constant-force spring of all of the coupled resistance modules resist the movement of the cord 110 off of the cord spool 108.

In one embodiment, the rods 142A, 142B, 142C, and 142D pass through the module holders 150A and 150E and support the module holders 150A and 150E. The device 100 could also support the module holders 150A and 150E with a different number of rods. The resistance module housing 1501 is configured to fit into and be removable from the module holders 150A and 150E. The module holders 150A and 150E as well as the removable resistance module 150 are configured to move, in either direction, on the rods 142A, 142B, 142C, and 142D.

In some embodiments, the device may include rods (e.g., rods 142A and 142B of FIGS. 47A, 47C, and 47D) that pass through an internal gear housing (e.g., internal gear housing 4710) to provide greater rigidity and stability to the cable retractor device. In some embodiments, the gear housing 4710 is metal. In certain embodiments, the outer housing is metal. In some embodiments, the metal for gearing house 4710, outer housing, or both may be sheet metal such as steel or aluminum.

Figure 14:
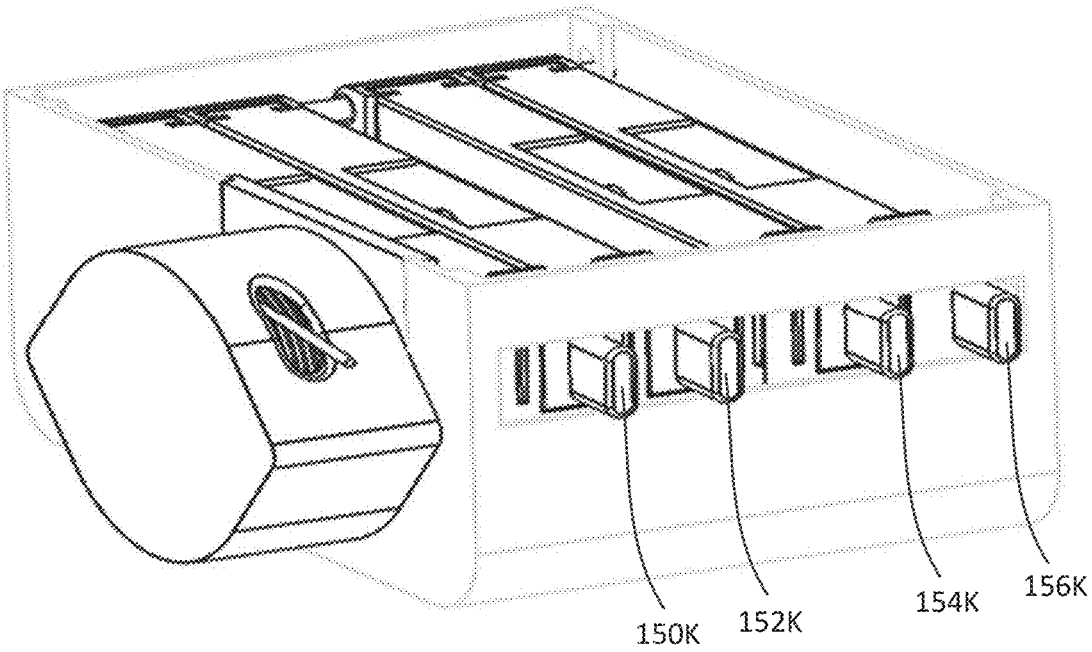
FIG. 14 illustrates another perspective view of an example cable retractor device that includes one or more clips for engaging resistance modules, according to some embodiments.

In some embodiments, a module tab is provided on the resistance module (e.g., 150, 152, and 154). The module tab can be shaped to be easily grasped by the hand of a user. The function of the module tab is to allow a user to easily remove a resistance module (e.g., 150, 152, 154) from module holder (e.g., 150E) when the resistance module needs to be replaced. In some embodiments, a module tab may be used for removing a resistance module from a module holder (e.g., module tab 1420 of FIG. 14 for removing resistance module 1450 from module holder 1450E).

Figure 10:
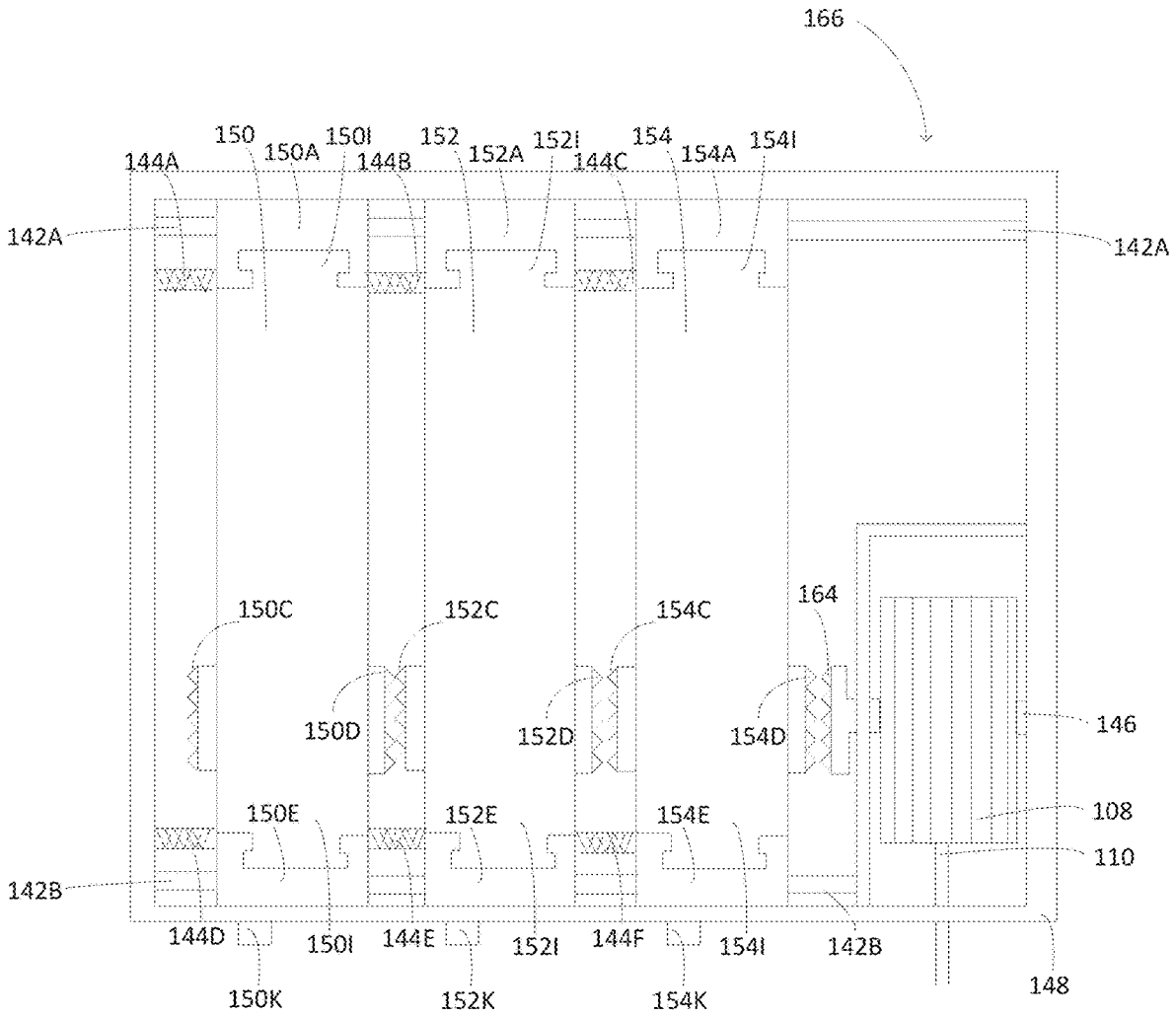
FIG. 10 illustrates another example cable retractor device where the resistance level can be adjusted through the use of switches, according to some embodiments.

With reference to FIG. 10, the housing 148 includes module holders 150A and 150E that are part of the housing 148, and are configured to stabilize the sliding of the removable resistance modules 150, 152, and 154 along the rods 142A, 142B, 142C, and 142D. In particular, indentations in the housing 148 are configured to align with corresponding protrusions on the module housing (e.g., 1501) such that the module housing can be inserted into the housing 148.

The cord spool cartridge 162 is configured to enclose the cord spool 108 and cord 110. When in action, the rods 142A, 142B, 142C, and 142D pass through the cord spool cartridge 162 and allow the cord spool cartridge 162 to move on the rods 142A, 142B, 142C, and 142D in either direction. The cord spool 108 is mounted on a shaft 146 that runs the width of the cord spool cartridge 162. In one embodiment, the shaft is mounted on bearings on one or both sides of the cord spool cartridge 162. There are interlocking gears 164 on one side of the cord spool cartridge 162 that rotate as the shaft 146 rotates. The shaft 146 rotates as the cord 110 retracts or is pulled off the cord spool 108. The interlocking gears 164 are configured to be coupled with interlocking gears of 154D to change the overall resistance level of the device 140.

In one embodiment, the housing 148 is configured with hinges 156A and 156B and a lid latch 158. Further, a lid may fit into the hinges 156A and 156B and latch to the housing 148 via the lid latch 158. In some embodiments, the lid consists of plastic material and is transparent. When a removable resistance module (e.g., 150, 152, and 154) breaks or malfunctions, a lid that is transparent allows a user to visually observe and identify which of the removable resistance modules (e.g., 150, 152, or 154) is broken or malfunctioned. As such, the user can easily replace the broken or malfunctioned removable resistance module by opening the lid, taking the identified removable resistance module (e.g., 150, 152, or 154) out of its module holder (e.g., 150A for removable resistance module 150), and replacing the identified removable resistance module with a new module.

The following describes how the device 140 provides for a constant-force exercise where the resistance level is adjustable.

In one embodiment, the user replaces a removable resistance module (e.g., 150, 152, or 154). The user opens the lid attached to the lid latch 158 and the lid hinges 156A and 156B and removes the removable resistance module (150, 152, or 154) by sliding the removable resistance module (150, 152, or 154) out of the module holder, e.g., 150A. The user replaces the removable resistance module (150, 152, or 154) with a new removable resistance module.

The device 140 may be configured at the lowest resistance level. The user moves the resistance selector 120 to a first constant resistance level. For the sake of discussion, it is assumed that none of the removable resistance modules 150, 152, and 154 are coupled together or with the interlocking gears 164 of the cord spool cartridge 162. In this configuration, none of the constant-force springs in the removable resistance modules (150, 152, and 154) are configured to resist the movement of cord 110 off of the cord spool 108.

Rotating the adjustment knob 122 in the direction that increases the resistance level results in in the pusher 126 applying force to the cord spool cartridge 162. The force causes the cord spool cartridge 162 to move along the rods 142A-142D. When the rotation selector 120 is rotated far enough, the interlocking gears 164 of the cord spool cartridge 162 engage with interlocking gears 154D of the first removable resistance module 154. When coupled together, the constant-force spring of the first removable resistance module 154 resists the movement of the cord 110 off of the cord spool 108.

Note that turning the resistance selector 120 to this resistance level does not couple the interlocking gears of the second and third removable resistance modules 150 and 152, respectively, because of the relative load resistance of the compression spring 144A-144C and 144D-144F, respectively, as described above. In one embodiment, the load resistance of third compression springs 144A and 144D (between second and third removable resistance modules 152 and 150, respectively) is greater than the load resistance of second compression springs 144B and 144E (between first and second removable resistance modules 154 and 152, respectively). Similarly, the load resistance of second compression springs 144B and 144E is greater than the load resistance of first compression springs 144C and 144F (between the cord spool cartridge 162 and the first removable resistance module 154). As a result, the first removable resistance module 154 couples before the second removable resistance module 152, which couples before the third removable resistance module 150.

The user then pulls the cord 110 off of the cord spool 108. In this configuration, the constant-force springs in removable resistance module 154 resists the movement of the cord 110 off of cord spool 108.

The user stops pulling the cord 110, which causes the cord 110 to retract onto the cord spool 108. The cord retracts due to the force produced by the constant-force spring in the removable resistance module 154.

The user rotates the resistance selector 120 to a second constant resistance level. Continuing to rotate the resistance selector 120 in the direction that causes the resistance level to increase causes the pusher to force the interlocking gears 152D on removable resistance module 152 to couple with the interlocking gears 154C on removable resistance module 154.

The user pulls the cord 110 off of the cord spool 108. When the interlocking gears 152D and 154C are coupled, the constant-force springs in removable resistance modules 152 and 154 both resist the cord 110 being pulled off the cord spool 108.

The user stops pulling the cord 110, which causes the cord 110 to retract onto the cord spool 108. The cord retracts due to the force produced by the constant-force springs in removable resistance modules 152 and 154.

Turning the resistance selector 120 in the reverse direction causes the pusher to exert less force on the interlocking gears of the resistance modules causing the interlocking gears of removable resistance modules to uncouple. This causes fewer removable resistance modules to resist the movement of the cord 110 off of the cord spool 108.

FIG. 10 is a perspective view of another example embodiment of the device. The device 166 includes a housing 148. In this example embodiment, the housing 148 is configured to enclose three resistance modules (e.g., 150, 152, and 154). The housing 148 is also configured to enclose the cord spool 108.

The shaft 146, which is affixed to the housing 148, supports the cord spool 108. The shaft 146 is configured with, at an end of the shaft 146, interlocking gears 164. In some embodiments, to provide optimal rotation of the shaft 146, the shaft 146 is configured with one or more bearings on an end. When in action, the cord 110 can pass through the housing 148 when it is pulled off the cord spool 108.

In some embodiments, the removable resistance modules (e.g., 150, 152, and 154) are configured with switches (e.g., 150K, 152K, and 154K) that allow a user to slide the removable resistance modules (e.g., 150,152, 154) along the rods 142A and 142B. Specifically, switches 150K, 152K, and 154K are part of the module holders 150E, 152E, and 154E, respectively. Each of the switches protrudes out of the housing 148. When configuring the resistance level of the device 166, the user can move (e.g., slide to the right) switch 154K to move removable resistance module 154 such that the interlocking gears 154D of module 154 couple with the interlocking gears 164 of the shaft 146. To further increase the resistance level, the user can move (e.g., slide to the right) switch 152K to move removable resistance module 152 such that interlocking gears 152D of module 152 couple with the interlocking gears 154C of the first removable resistance module 154. To increase the resistance level even further, the user can move switch 150K (e.g., slide to the right) to move removable resistance module 150 such that interlocking gears 150D of the third removable resistance module 150 couple with interlocking gears 152C of the second removable resistance module 152.

Figure 11:
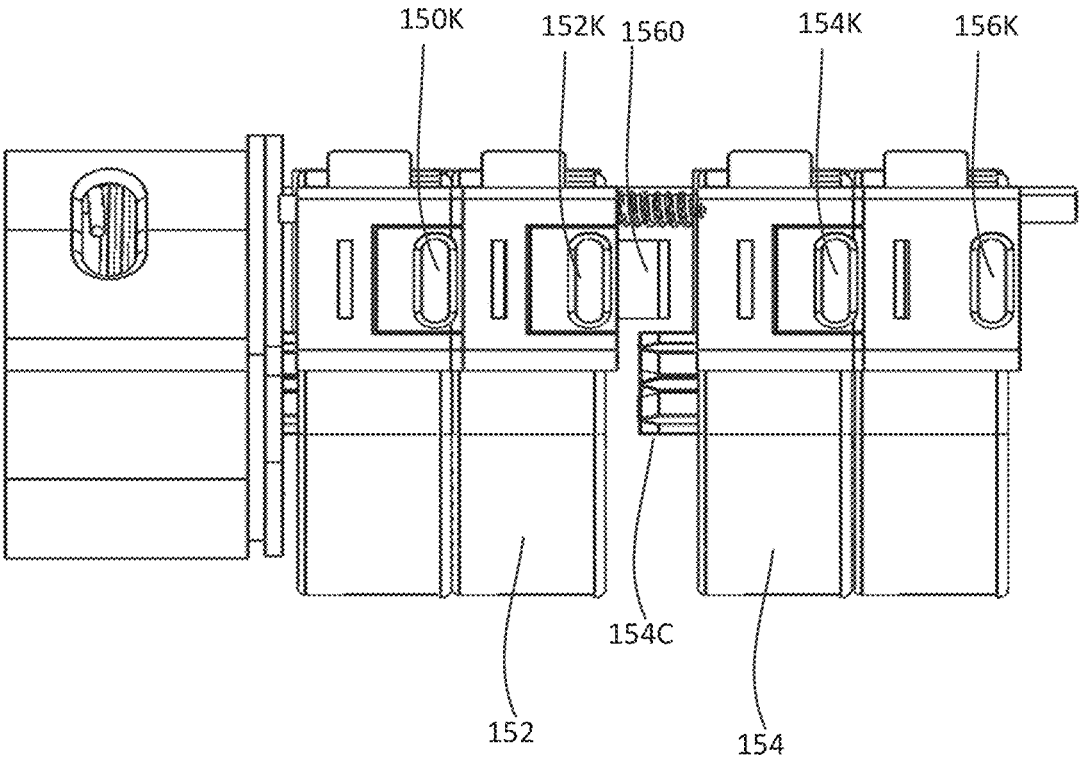
FIG. 11 illustrates a perspective view of another example cable retractor device that includes one or more clips for engaging resistance modules, according to some embodiments.
Figure 12:
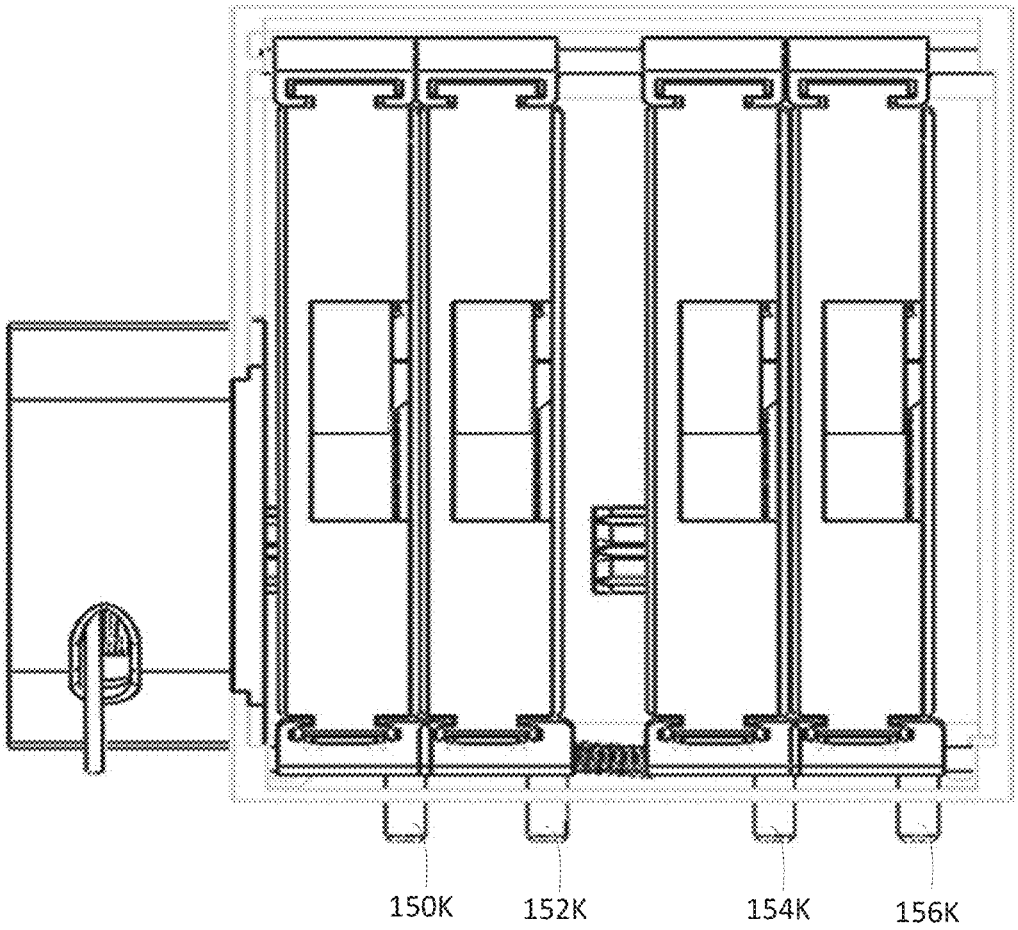
FIG. 12 illustrates another perspective view of an example cable retractor device that includes one or more clips for engaging resistance modules, according to some embodiments.

In some embodiments, the switches (e.g., 150K, 152K, and 154K) of the removable resistance modules (e.g., 150, 152, and 154) are configured with a clip that allows a switch to fit into a slot on an adjacent removable resistance module (e.g., 150, 152, and 154) or housing 148. In these embodiments, moving the clip of the switch (e.g., 150K, 152K, 154K) into the slot results in the removable resistance modules (e.g., 150, 152, 154) remaining engaged for the duration of an exercise. FIGS. 11-156 depict an example device having one or more such clips. As depicted in these figures, the device includes switches 150K, 152K, 154K, and 156K for moving four removable resistance modules to adjust the resistance level of the device.

Figure 13:
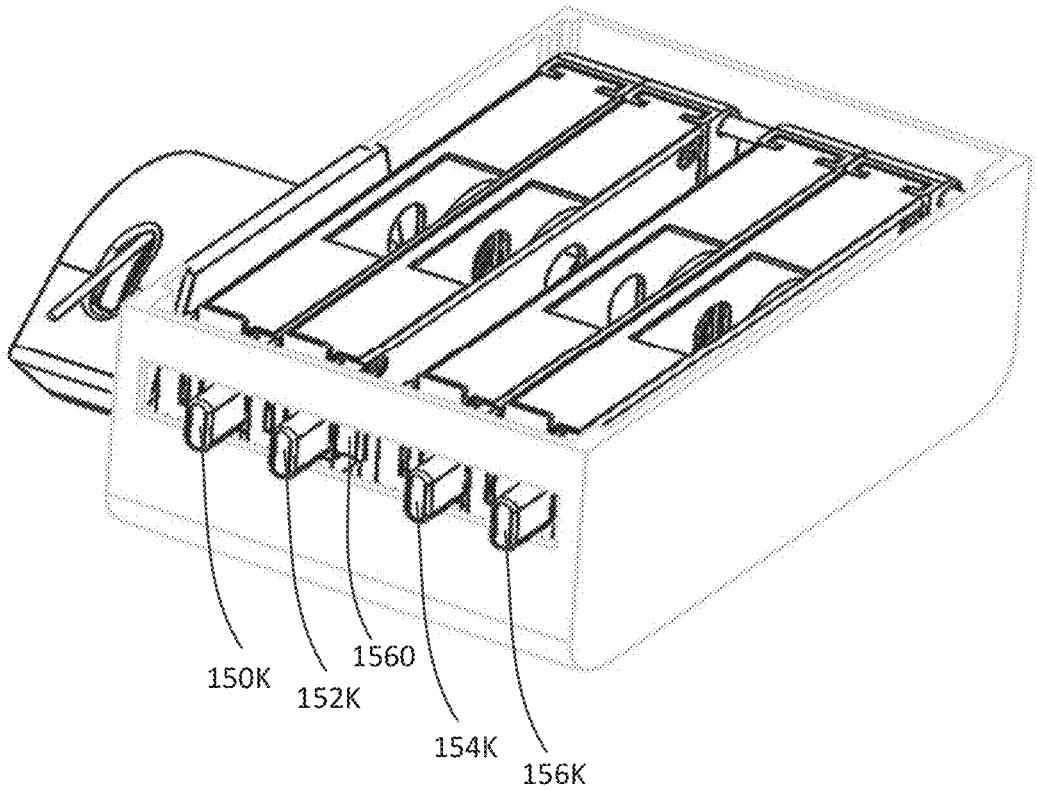
FIG. 13 illustrates another perspective view of an example cable retractor device that includes one or more clips for engaging resistance modules, according to some embodiments.
Figure 15:
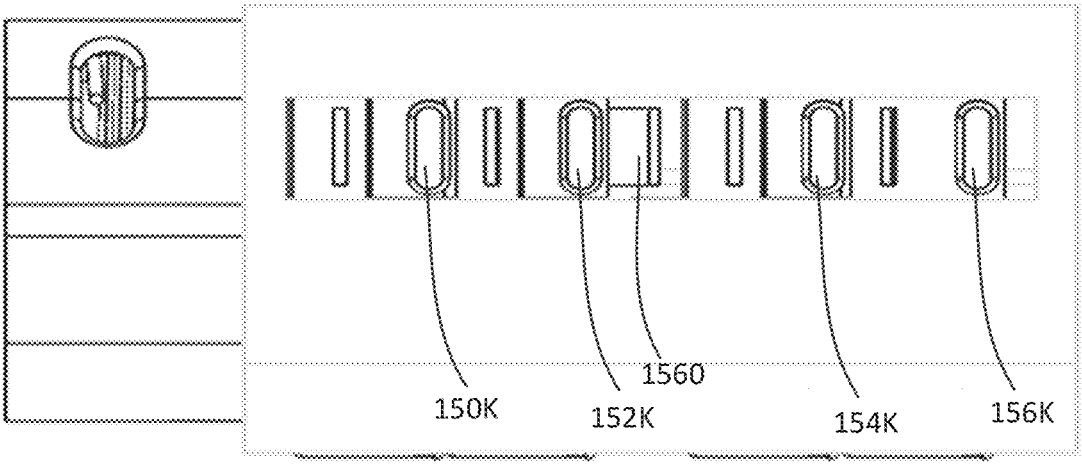
FIG. 15 illustrates another perspective view of an example cable retractor device that includes an example clip for engaging two resistance modules, according to some embodiments.

As depicted in FIGS. 11, 13, and 15, the resistance module 152 includes a clip 1560 protruding from the right side of the module. As the resistance module 152 and the resistance module 154 become engaged together via interlocking gears (e.g., interlocking gear 154C), the clip 1560 is moved into a slot in the resistance module 154 or the housing to secure the two resistance modules together. To separate two engaged resistance modules 152 and 154, the user may push the switch 154K inward to disengage the clip 1560 from the slot and slide the resistance module 154 away from the resistance module 152.

Figure 16:
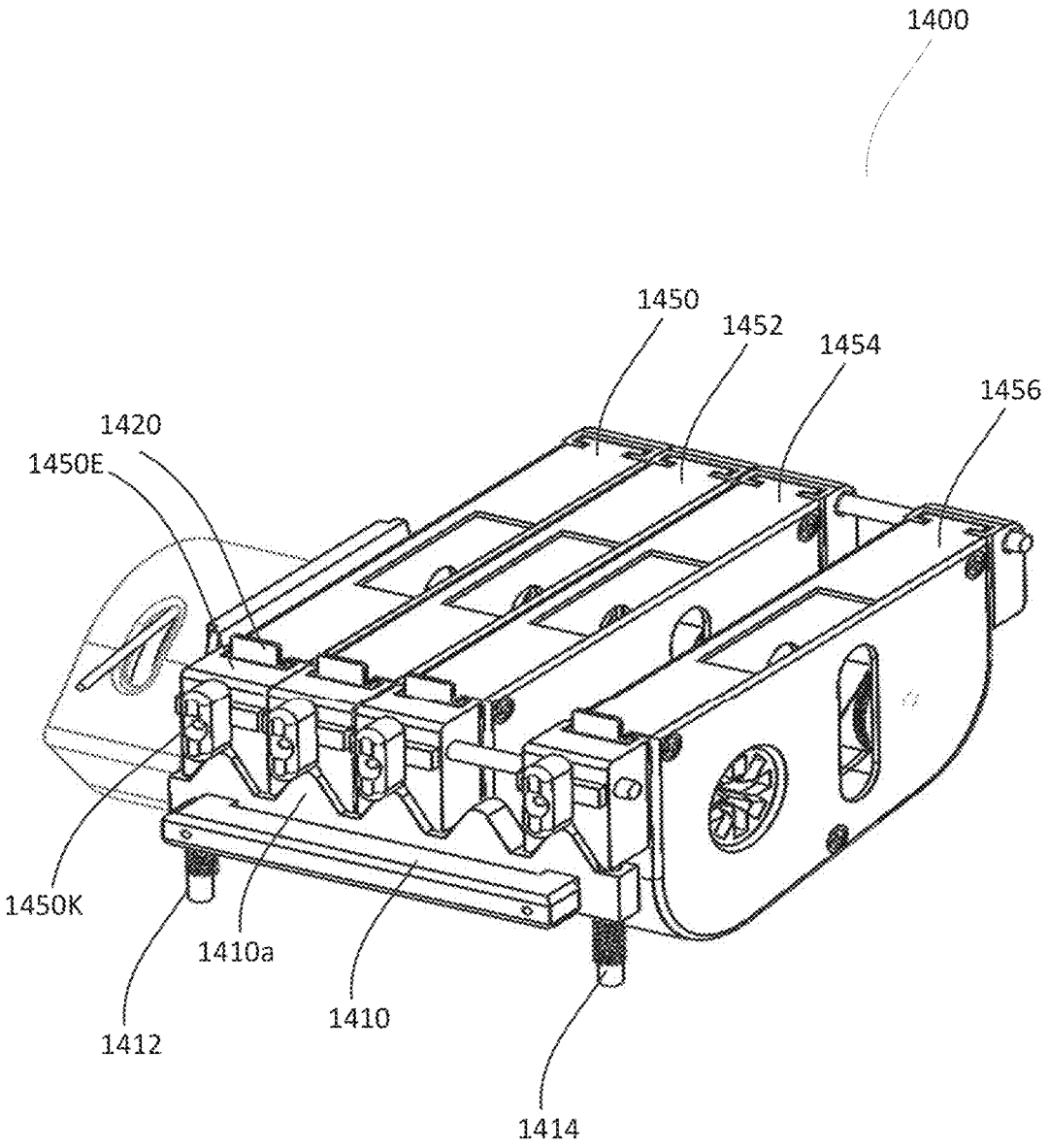
FIG. 16 illustrates another example embodiment of the cable retractor device that includes a bar with grooves for maintaining the switch settings of the device, according to some embodiments.

In some embodiments, as illustrated in FIG. 16, the device 1400 includes a bar 1410 having a plurality of grooves (e.g., 1410*a*) that serve to keep the resistance modules 1450, 1452, 1454, and 1456 and the corresponding module holders (e.g., 1450E) in place. In one embodiment, there are multiple sets of grooves (e.g., on both edges of the resistance module holders) such that the bar can move to further keep the resistance modules and module holders in place. The bar can be on the side, bottom, middle, or other locations on the device. In the depicted embodiment, two rods 1412 and 1414 pass through the bar 1410, thus allowing the bar 1410 with grooves (e.g., 1410*a*) to slide along the rods. As depicted, rods 1412 and 1414 each has a spring to keep the bar 1410 with grooves in position such that the switches (e.g., 1450K) cannot be switched between set and unset positions. When the user pushes downward on the bar 1410, the springs are compressed and the bar 1410 with grooves can be moved downward such that the switches can be switched from a set position (in which the switches cannot be moved by the user) to an unset position (in which the switches can be moved by the user). When the user releases the bar 1410 with grooves, the springs 1412 and 1414 force the bar with grooves back into a position where the switches (e.g., 1450K) of the resistance modules cannot be moved by the user.

One of ordinary skill in the art would understand that the bar 1410 may not operate as intended if the bar 1410 is not configured correctly. For example, the springs 1412 and 1414 may resist the user's push and, rather than causing the bar 1410 to slide downward to put the resistance modules into an unset position, cause the whole device to tilt. FIGS. 17-21 illustrate alternative mechanisms for switching the resistance modules between a set position (in which they cannot be moved by the user) and an unset position (in which they can be moved by the user).

Figure 17:
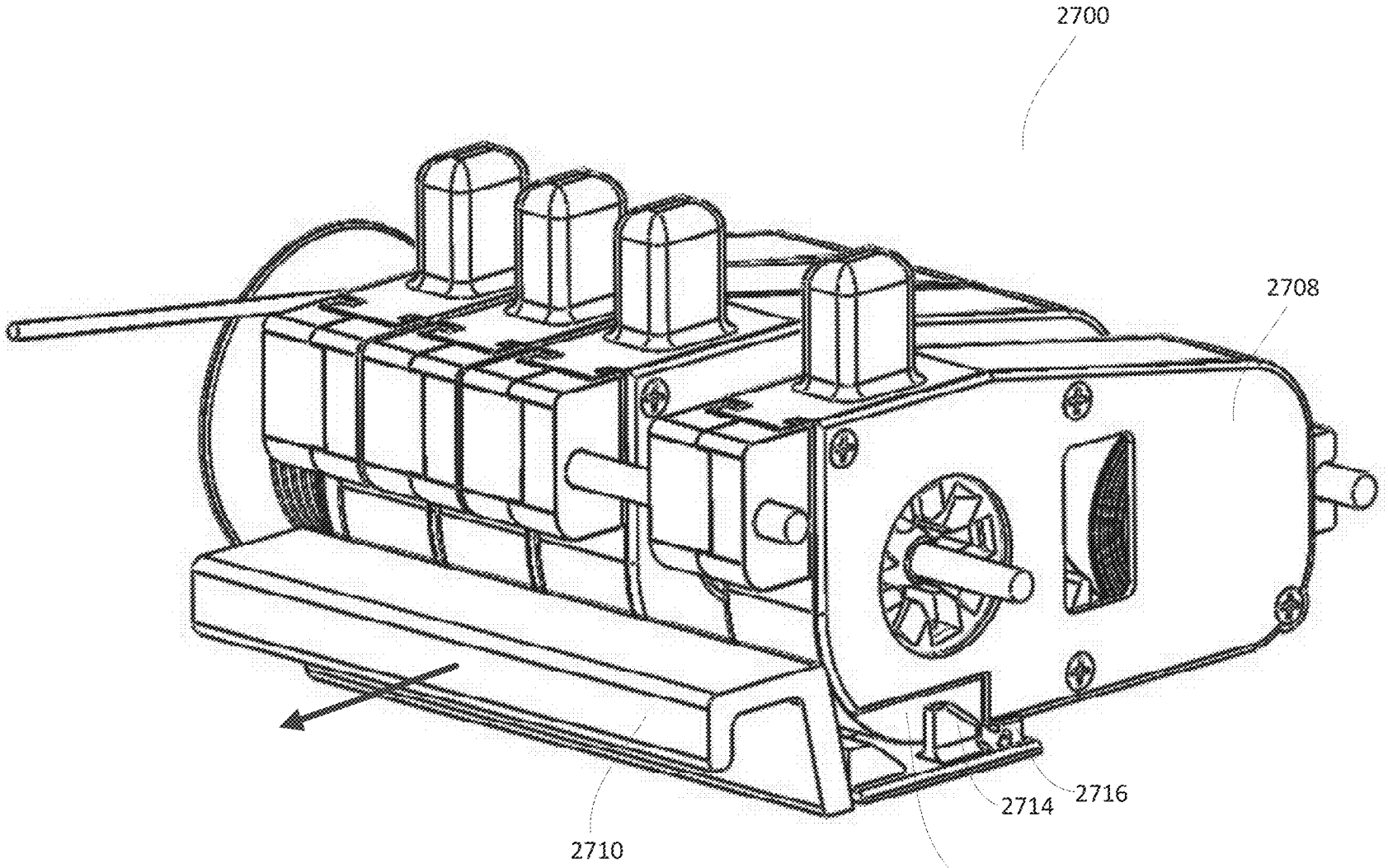
FIG. 17 illustrates a perspective view of another example cable retractor device that includes a bar for maintaining the switch settings of the device, according to some embodiments.

FIG. 17 illustrates an example cable retractor device 2700 that includes a bar 2710 for switching the resistance modules between a set position and an unset position. Unlike the bar 1410 of the device 1400, the bar 2710 is designed to be pulled out rather than being pulled down. The bar 2710 is attached to a flat bottom piece, on which a set of teeth such as tooth 2714 and tooth 2716 are disposed. As shown in the figure, when the bar is not pulled out, the teeth 2714 and 2716 engage with the resistance module 2708 via a cutout 2702 on the side surface of the resistance module. It should be appreciated that other teeth are disposed on the bottom piece to keep each of the resistance modules in place in a similar manner. As such, when the bar is not pulled out, the resistance modules are in a set position and cannot be moved relative to each other.

Figure 18:
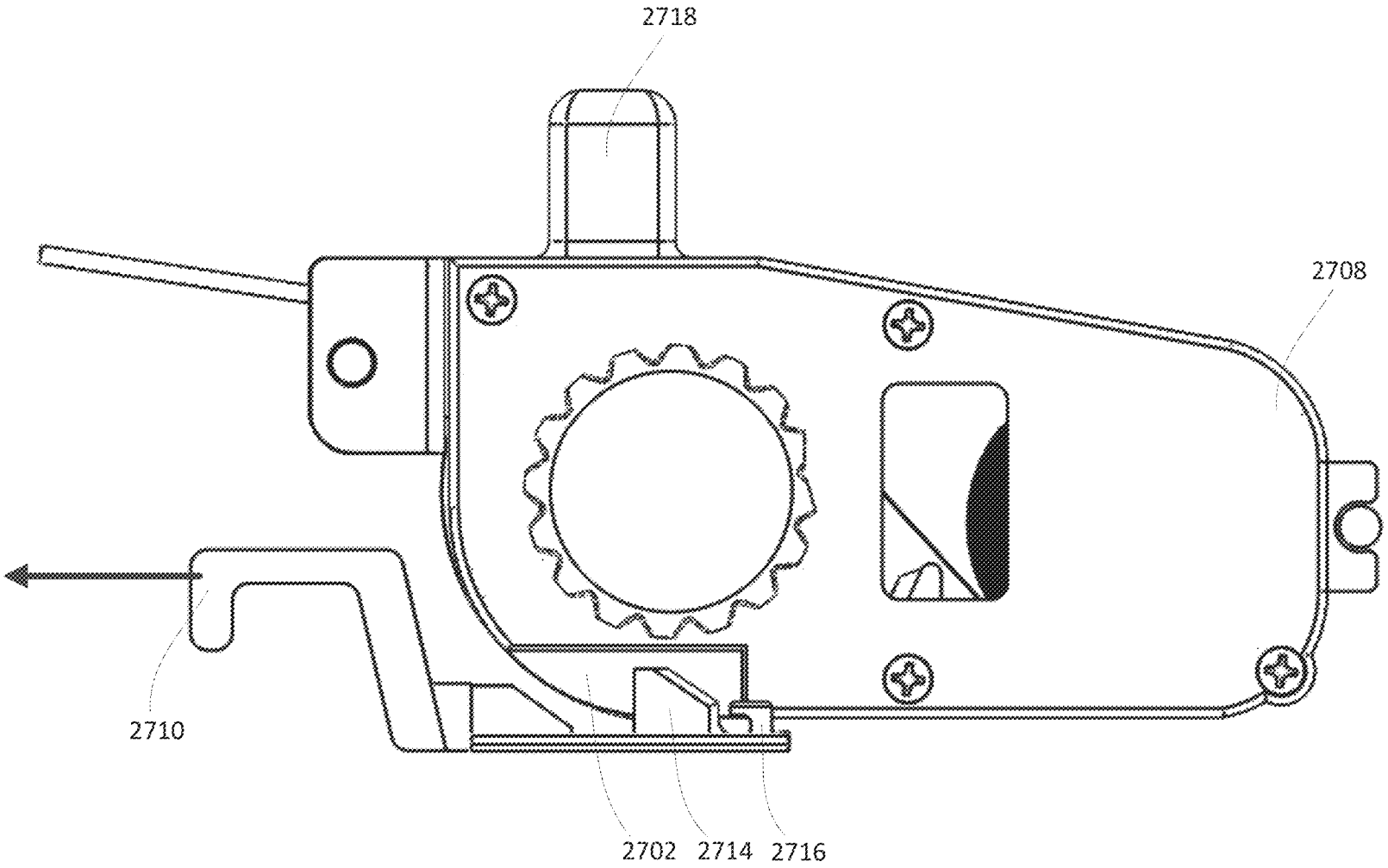
FIG. 18 illustrates a side view of an example cable retractor device that includes a bar for maintaining the switch settings of the device, according to some embodiments.

Turning to FIG. 18, when the user pulls out the bar 2710 as indicated by the arrow, the bottom piece, along with the teeth 2714 and 2716 disposed on the bottom piece, becomes disengaged from the resistance module 2708. As the bar 2710 is pulled out, the bottom piece moves downward relative to the cutout 2702 and the teeth 2714 and 2716 are no longer in contact with the cutout 2702, thus switching the resistance modules to an unset position. In the unset position, the user can grab switch 2718 located on the top of the resistance module 2708 and slide the resistance module to engage with or disengage from a neighboring resistance module.

Figure 19:
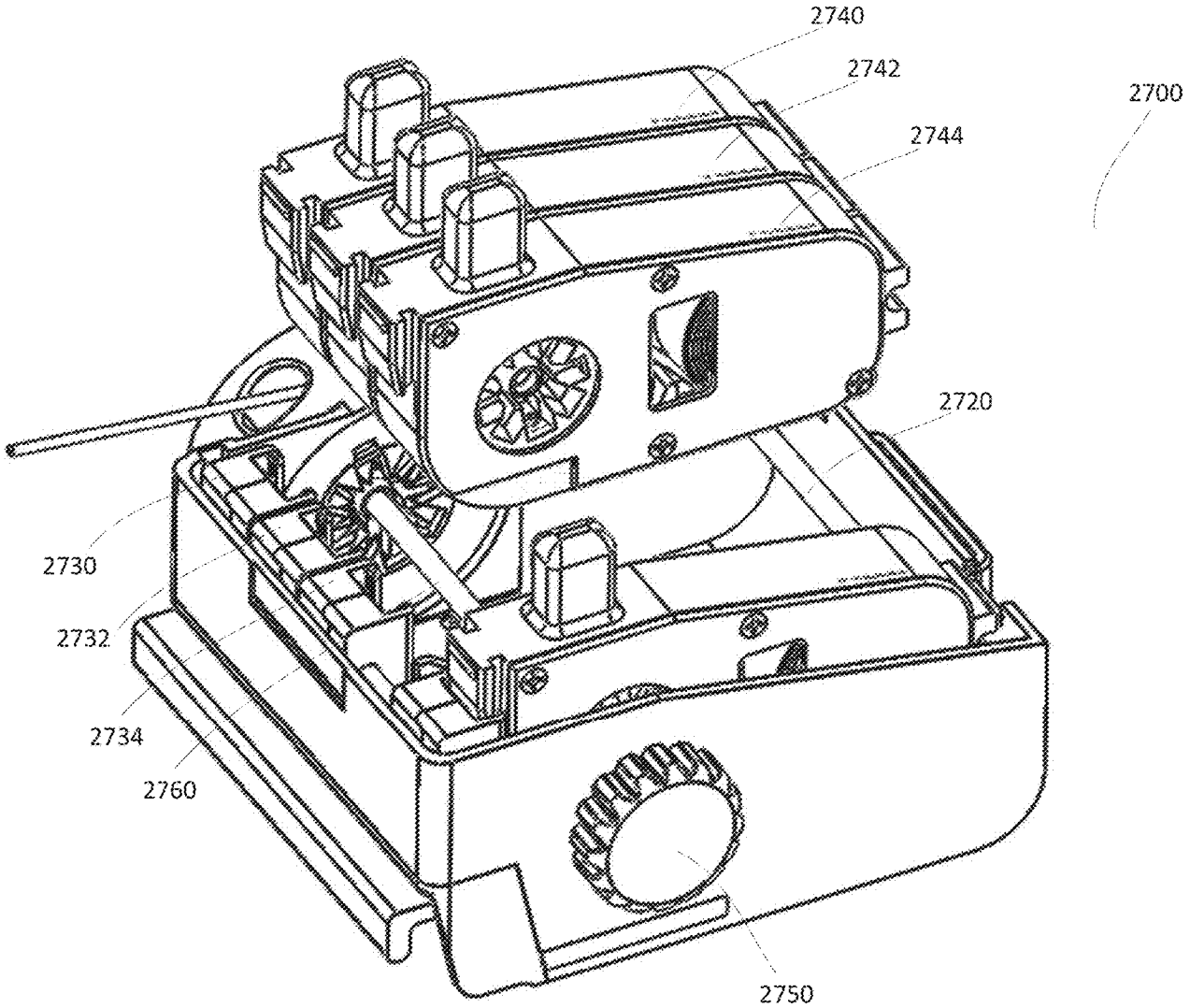
FIG. 19 illustrates another perspective view of an example cable retractor device that includes a bar for maintaining the switch settings of the device, according to some embodiments.

It should be appreciated that each of the resistance modules in the device 2700 may be removed and replaced with a different resistance module, for example, one providing a different resistance level. As depicted in FIG. 19, resistance modules 2740, 2742, and 2744 may be inserted into module holders 2730, 2732, and 2734, respectively. In some examples, before replacing any resistance modules, the shaft 2760 needs to be removed (e.g., pulled out via pusher 2750) so that the replacement resistance module(s) can be dropped in. As shown, after the resistance modules are dropped in, the resistance modules are held by a rail 2720 on the backside of the device.

Figure 20A:
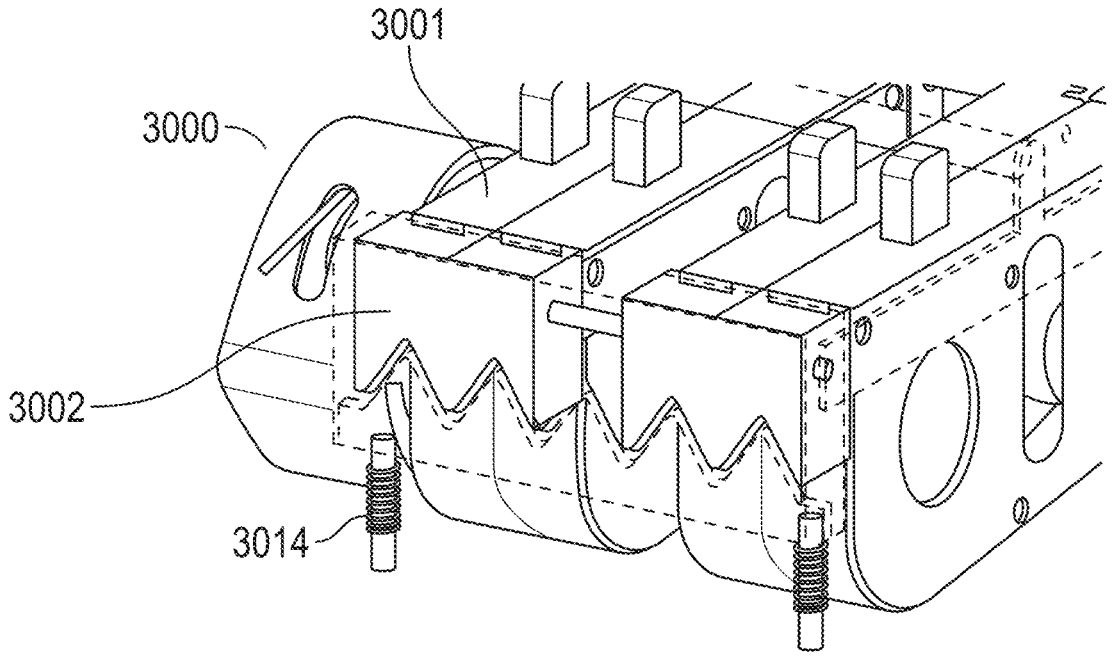
FIG. 20A illustrates a perspective view of another example cable retractor device that includes a bar structure for maintaining the switch settings of the device, according to some embodiments.

FIG. 20A illustrates another alternative mechanism for switching resistance modules between a set position (in which they cannot be moved by the user) and an unset position (in which they can be moved by the user). Device 3000 includes four resistance modules, each of which is held in a resistance module holder. For example, resistance module 3001 is held by resistance module holder 3002. The resistance module holder 3002 includes a wedge-shaped groove toward the bottom.

Figure 20B:
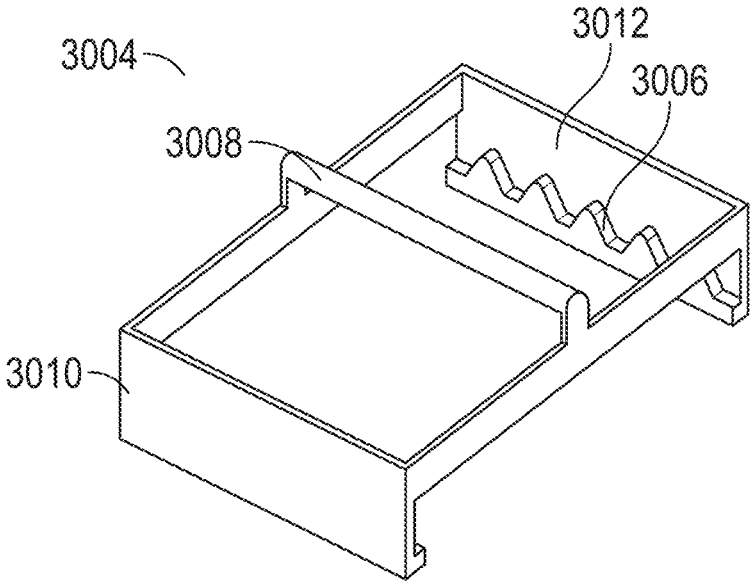
FIG. 20B illustrates a perspective view of a bar structure for maintaining the switch settings of a device, according to some embodiments.

The device 3000 also includes a bar structure 3004 as depicted in FIG. 20B. The bar structure includes two lateral surfaces 3010 and 3012, each of which includes a set of grooves (e.g., 3006). Turning back to FIG. 20A, the bar structure 3004 is placed over and around the four resistance modules. By way of the loaded springs (e.g., spring 3014), the grooves on the lateral surfaces of the bar structure 3004 (shown as transparent) press up against the grooves of the resistance module holders to keep the resistance module holders in a set position. Accordingly, the resistance modules are secured in place and cannot be moved relative to each other.

Figure 21:
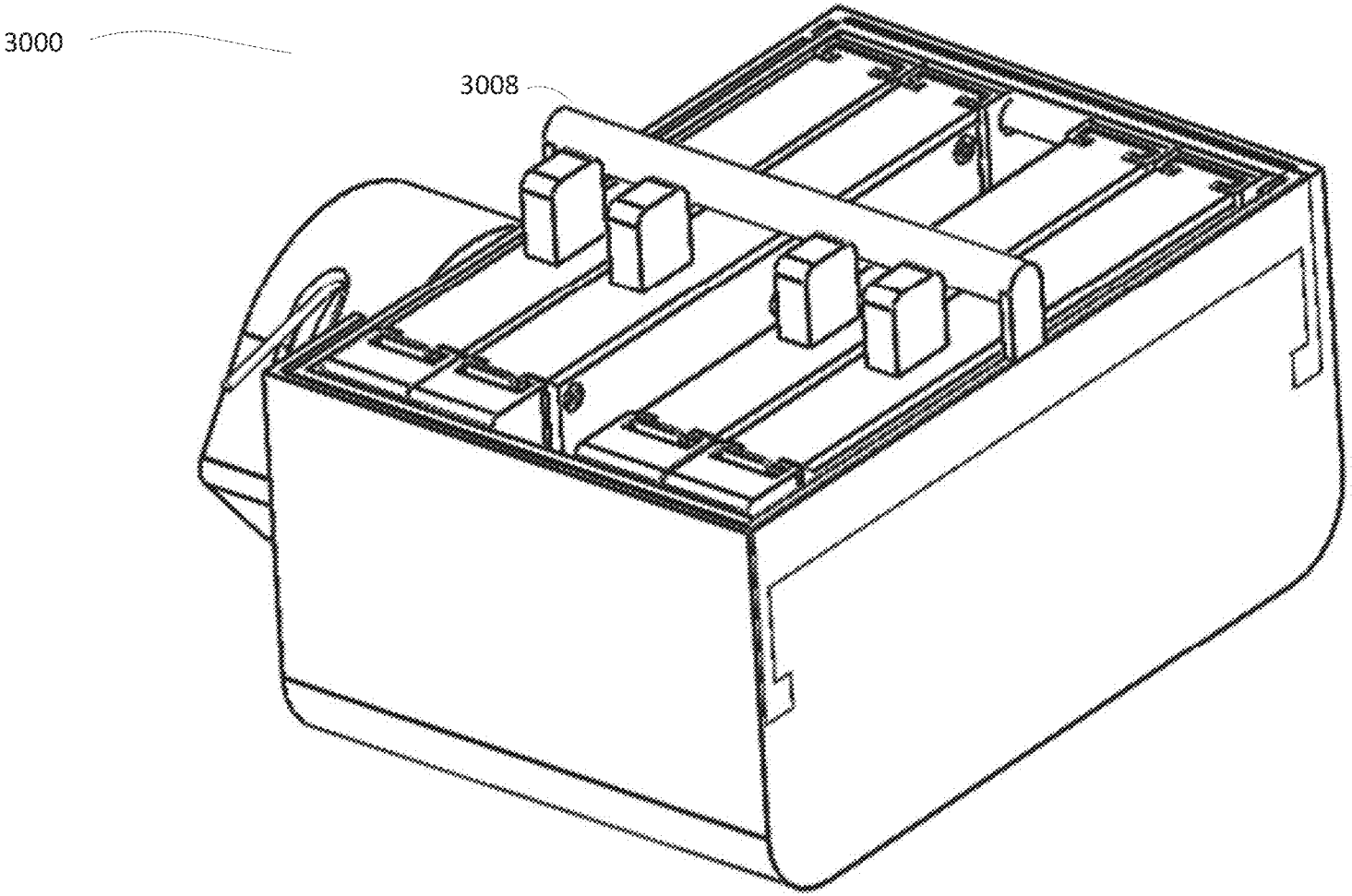
FIG. 21 illustrates another perspective view of an example cable retractor device that includes a bar structure for maintaining the switch settings of the device, according to some embodiments.

To switch the resistance modules into an unset position, the user can push the bar structure downward using the top handle 3008, as depicted in FIG. 21. After the bar structure is pushed down, the grooves of the bar structure are no longer pressed up against the resistance module holders, allowing the user to slide the resistance modules (e.g., via the switches on the top of the resistance modules) to adjust the resistance level of the device.

Figure 22A:
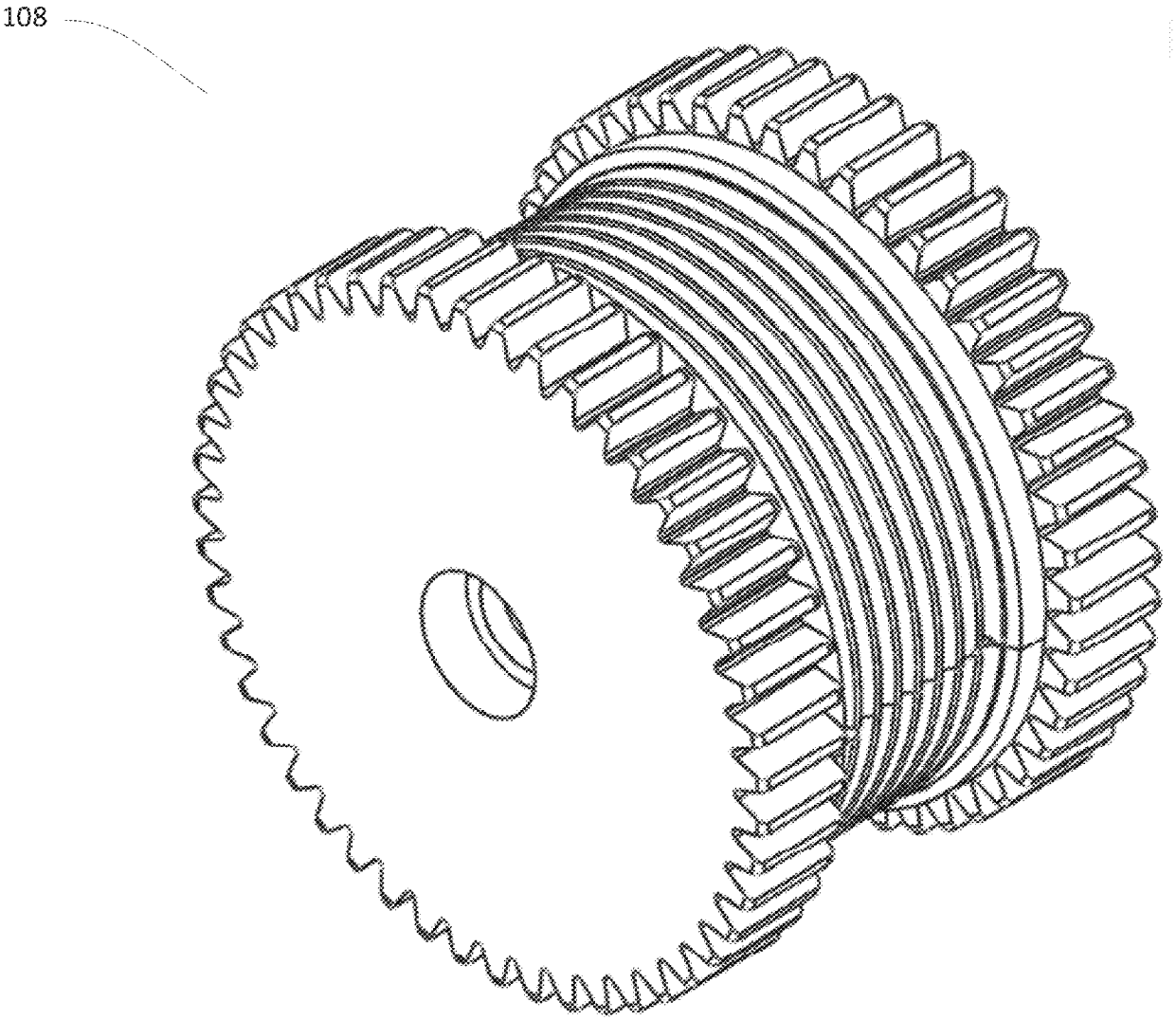
FIGS. 22A and 22B illustrate an example cord spool comprising removable spool portions, according to some embodiments.
Figure 22B:
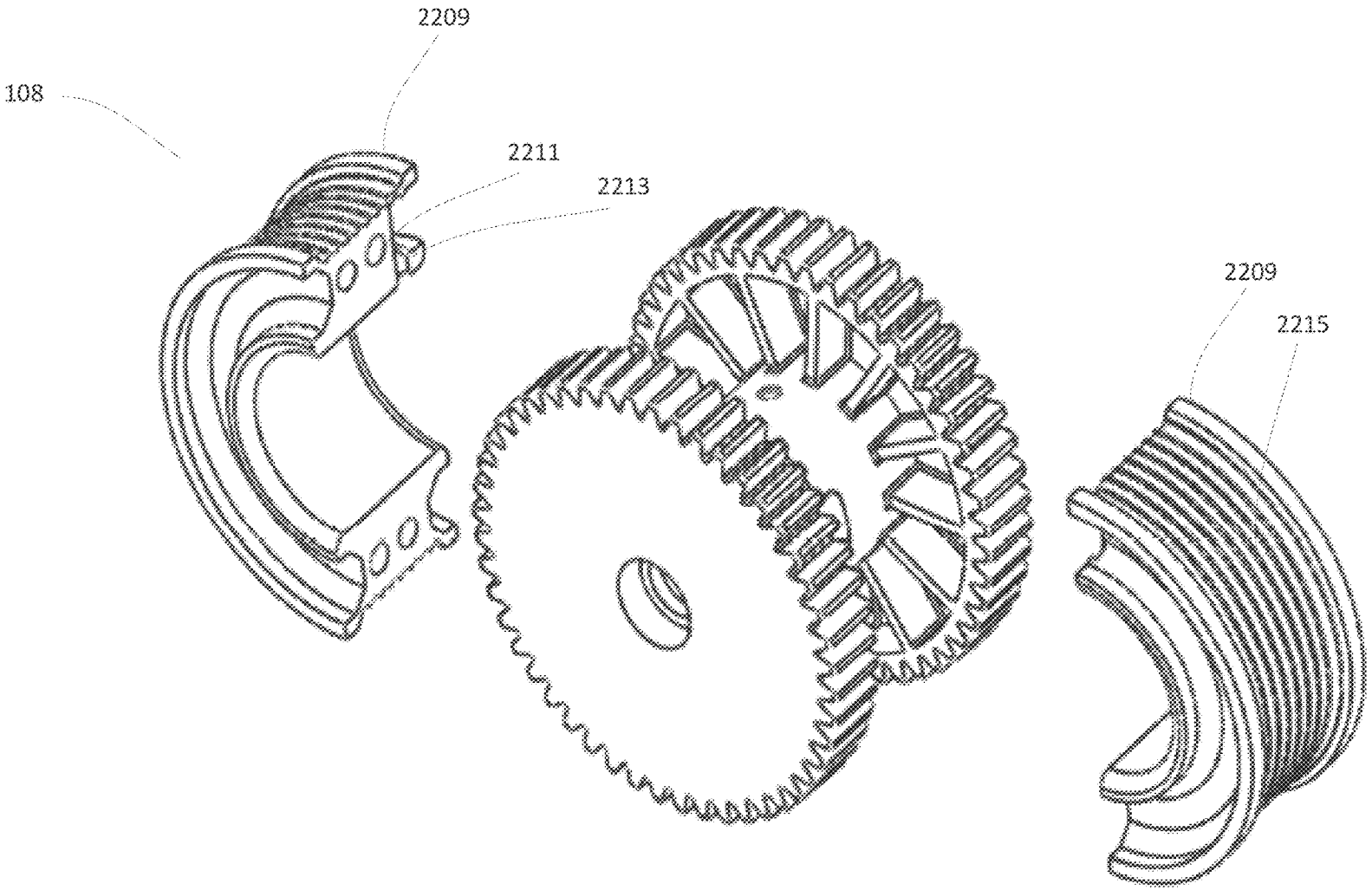

The resistance may also be adjusted by replacing or reconfiguring the cord spool 108, in addition or alternatively to reconfiguring resistance modules. The resistance adjustment via replacement or reconfiguration of the cord spool 108 allows finer tuning of the resistance, which may not be achieved using only resistance modules. FIG. 22A shows the cord spool 108 when installed in the device, and FIG. 22B shows parts of the cord spool 108. The cord spool 108 may comprise removable spool portions 2209, which may be coupled together by magnets 2211. It should be appreciated that the removable spool portions 2209 may be coupled together by other attachment mechanisms. It should also be appreciated that the cord spool 108 may comprise more than two removable spool portions that are coupled together. The removable spool portions 2209 may include a rope guide hole 2213 to which the cord 110 passes through. In some embodiments, the removable spool portions may comprise anti-slip off grooves 2215 that help prevent cord 110 from slipping.

To adjust the resistance, removable spool portions 2209 associated with a first resistance may be removed and replaced with removable spool portions associated with a second resistance. The removable spool portions 2209 may be removed by pulling apart individual spool portions using, e.g., the user's hands. Different removable spool portions may then be installed by positioning the spool portions 2209 around the shaft of the cord spool 108 and in close proximity to one another such that the magnets 2211 of the individual spool portions attract and couple together. In some embodiments, the resistance may be related to the diameter of the removable spool portions 2209. For example, a higher resistance may be selected by using removable spool portions 2209 that have a larger diameter.

Figure 23B:
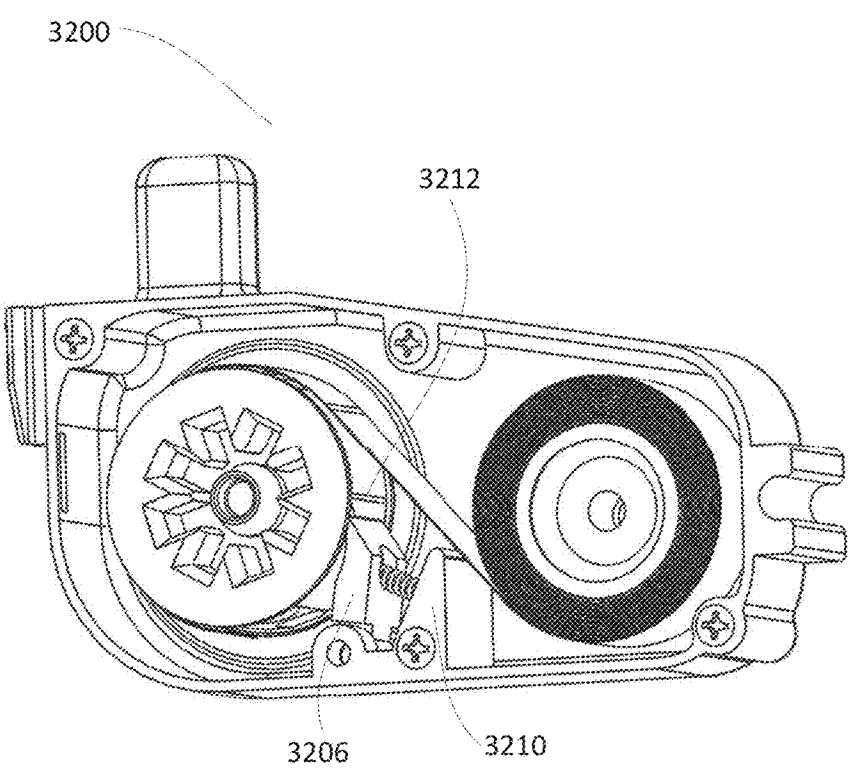
FIG. 23B illustrates another side view of an example resistance module that includes a stopper for preventing the constant-force spring from being over-pulled, according to some embodiments.
Figure 23A:
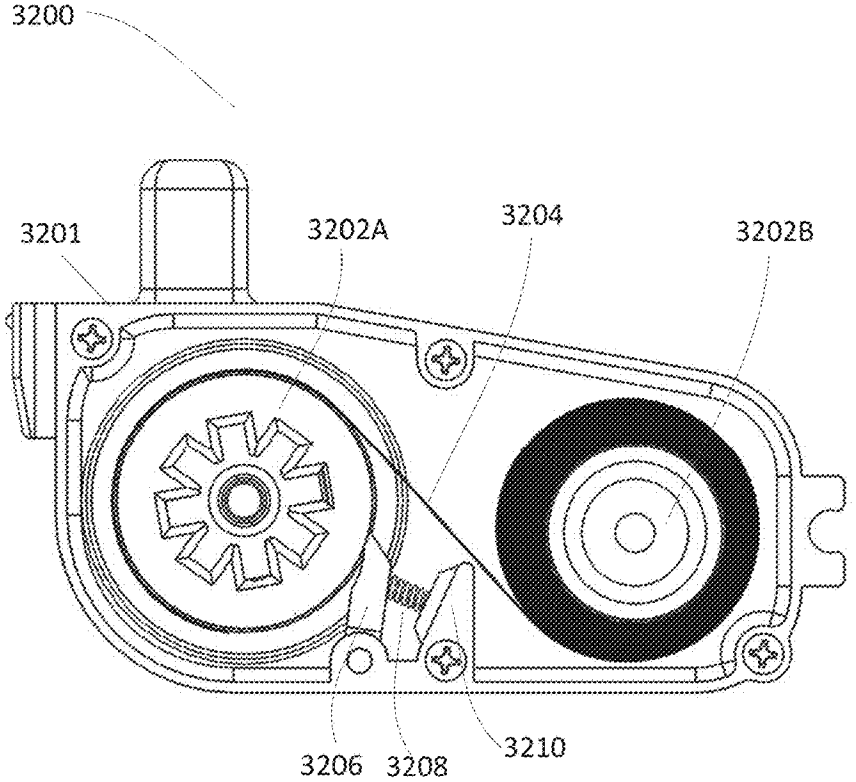
FIG. 23A illustrates a side view of another example resistance module that includes a stopper for preventing the constant-force spring from being over-pulled, according to some embodiments.
Figure 24:
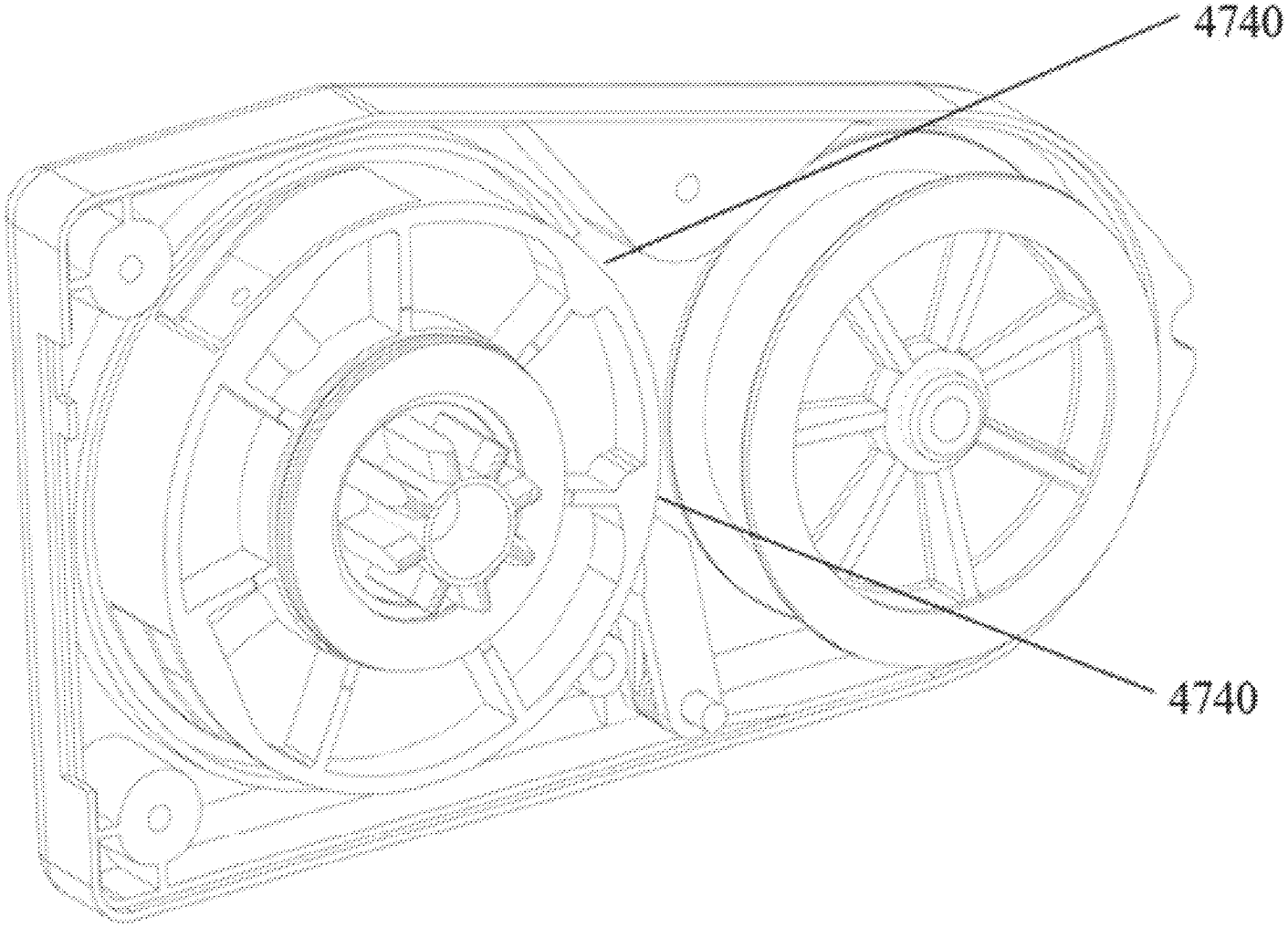
FIG. 24 illustrates a perspective view of the inside of another example resistance module that includes a recess in the storage drum for an end of the constant-force spring, according to some embodiments.

In some instances, a constant-force spring may be over pulled. A stopper may prevent this over pull. FIG. 23A illustrates a side view of an example resistance module that includes a stopper for preventing the constant-force spring from being over pulled. The removable resistance module 3200 includes a housing 3201, a constant-force spring 3204, a first storage drum 3202A, and a second storage drum 3202B. A support 3210 protrudes from the inner surface of the housing and is connected to a stopper 3206 via a loaded spring 3208. When the resistance module is in operation, the constant-force spring 3204 unwinds from the storage drum 3202A and winds onto the storage drum 3202B as the user pulls the cable. As shown in FIG. 23B, the storage drum 3202A includes a slot 3212 and, when the constant-force spring 3204 is unwound such that the slot 3212 is exposed, the stopper 3206 inserts into the slot 3212, thus preventing the constant-force spring from being unwound from the storage drum 3202A further. This mechanism prevents the constant-force spring from being unwound completely from the storage drum 3202A and thus being bent backward, thus improving the durability of the constant-force spring. FIG. 24 shows an example storage drum that includes a recess for an end of the constant-force spring. The recess reduces or eliminates bulging of the constant-force spring as it winds around the storage drum.

The description below describes the use of the device, according to one embodiment. The description may describe any one of the embodiments discussed above, or independent of any previously discussed embodiments.

With reference to FIG. 10, the user replaces the removable resistance module (150, 152, or 154). In one embodiment, the user opens lid attached to lid latch 158 and lid hinges 156A and 156B and removes a removable resistance module (150, 152, or 154) by sliding the removable resistance module (150, 152, or 154) out of the cartridge holder 150A. The user replaces the removable resistance module (150, 152, or 154) with a new removable resistance module.

The user sets the device to a first constant resistance level. The following description assumes that the device 166 is set to the minimum resistance level. At the minimum resistance level, none of the interlocking gears 150C-154C, 150D-154D, and 164 are coupled. Since there is no coupling, none of the removable resistance modules 150, 152, and 154 resist the movement of the cord 110 off of the cord spool 108. This configuration represents the lowest resistance level of device 166.

In some embodiments, the device may be set by the user to a second constant resistance level. Each switch 150K, 152K, and 154K is associated with a resistance module holder 150E, 152E, and 152E. When switch 154K moves from the unset position to the set position, the resistance module holder 154E, along with the entire resistance module 154, moves along the rods 142A, 142B, 142C, and 142D towards the cord spool 108. The interlocking gear 154D of the first removable resistance module 154 engages with the interlocking gear 164 of the removable cord spool cartridge 162. When coupled together the first removable resistance module 154 resists the movement of the cord 110 off of the cord spool 108. This configuration represents the second lowest resistance level since the constant-force spring of removable resistance module 154 is now configured to resist the movement of the cord 110 off of the cord spool 108.

Note that moving the switch 154K from the unset position to the set position does not couple the interlocking gear 152D of the second removable resistance modules 152 with the interlocking gear 154C of the first removable resistance module 154. Also, moving the switch 154K from the unset position to the set position does not couple the interlocking gear 150D of the first removable resistance module 150 with the interlocking gear 152C of the second removable resistance module 152.

The user pulls the cord off of the cord spool. The device 166 provides resistance at a constant level because of the constant-force spring in removable resistance module 154. The user is able to pull the cord off of the cord spool when the user applies enough force to exceed the opposing force provided by the constant-force spring.

The device 166 retracts the cord 110 onto the cord spool 108. The cord 110 will retract onto the cord spool 108 when the user ceases to apply force that opposes that caused by the constant-force springs in the device 166.

The user moves the switch 152K to a second constant resistance level. When switch 152K moves from the unset position to the set position, the resistance module holder 152E, along with the entire second removable resistance module 152, moves along the rods 142A, 142B, 142C, and 142D towards the cord spool 108. The interlocking gear 152D of the second removable resistance module 152 engages with the interlocking gears 154C of the first removable resistance module 154. When coupled together, the first and second removable resistance modules 152 and 154, respectively, resist the movement of the cord 110 off of the cord spool 108. This configuration represents the third lowest resistance level that device 166 provides.

The user pulls the cord 110 off of the cord spool 108. The device 166 provides resistance at a constant level because of the constant-force springs in the removable resistance modules 152 and 154. The user is able to pull the cord 110 off of the cord spool 108 when the user applies enough force to exceed the opposing force provided by the constant-force springs.

The device 166 retracts the cord 110 onto the cord spool 108. The cord 110 will retract onto the cord spool 108 when the user ceases to apply force that opposes the constant-force springs in the device 166.

The resistance level can also be set to a lower level, such as the second lowest resistance level. When switch 152K moves from the set position to the unset position, the resistance module holder 152E, along with the entire second removable resistance module 152, moves along the rods 142A, 142B, 142C, and 142D away from the cord spool 108. The interlocking gear 152D of the second resistance module 152 decouples from the interlocking gear 154C of the first resistance module 154. When resistance modules 152 and 154 are decoupled, only the first removable resistance module 154 is coupled to the cord spool 108. This configuration represents the second lowest resistance level that the device 166 provides.

In some embodiments, the device 166 may be configured for the lowest resistance level. When switch 154K moves from the set position to the unset position, the resistance module holder 154E, along with the entire first resistance module 154, moves along the rods 142A, 142B, 142C, and 142D away from the cord spool 108. The interlocking gear 154D of the first removable resistance module 154 disengages from the interlocking gear 164 of the removable cord spool cartridge 162. When first removable resistance module 154 and the cord spool 108 are decoupled, no resistance module resists the movement of the cord 110 off of the cord spool 108.

Figure 25:
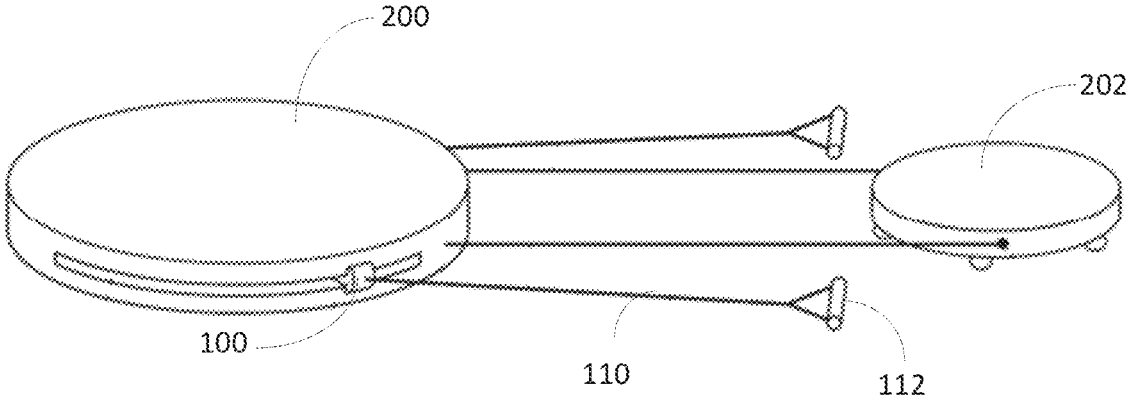
FIG. 25 illustrates an example cable retractor device, configured for use with an example fitness system, used at an angle that is parallel to the ground, according to some embodiments.
Figure 26:
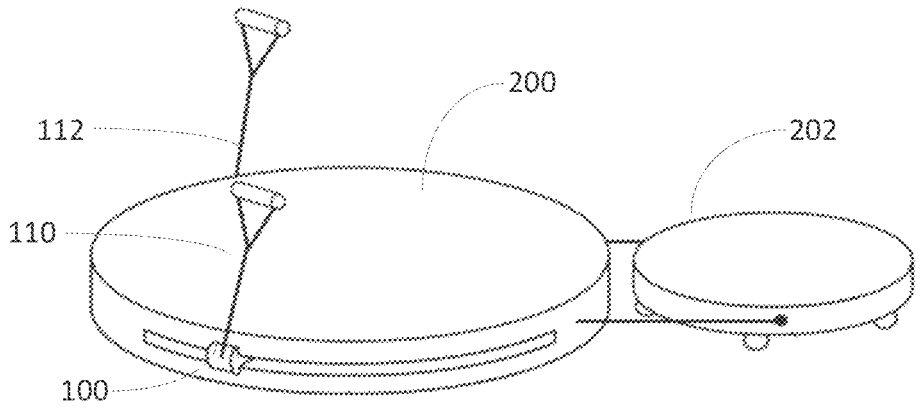
FIG. 26 illustrates an example cable retractor device, configured for use with an example fitness system, used at an angle that is perpendicular to the ground, according to some embodiments.

FIGS. 25 and 26 depict another embodiment of the invention. In FIG. 25, the device 100 is connected to a first user support platform 200, which is attached to a second user support platform 202 via cables. In some embodiments, the cord 110 and handle 112 are at an orientation roughly parallel with the ground, as shown in the figure. When the user pulls on the handle 112, the device 100 provides resistance at a first resistance level. The first resistance level is based on the sum of the resistance level of each resistance module coupled together and with the cord spool.

Similarly, in FIG. 26, the device 100 is connected to a first user support platform 200, which is attached to a second user support platform 202 via cables. In some embodiments, the cord 110 and handle 112 are at an orientation roughly perpendicular with the ground, as shown in the figure. When the user pulls on the handle 112 the device 100 provides resistance at a first resistance level. The first resistance level when the handle is pulled parallel to the ground is nearly identical as the load provided when the handle is pulled perpendicular to the ground. There might be slight differences in the resistance provided by the device 100 in different orientations due to factors like friction, but, in some embodiments, the resistance level may be constant.

When the user adjusts increases the resistance, this causes additional resistance modules to couple together. When the user pulls handle 112 at the same orientation, the device 100 provides resistance at a second resistance level. The second resistance level is based on the sum of the resistance level of each resistance module coupled together and with the cord spool.

Figure 27:
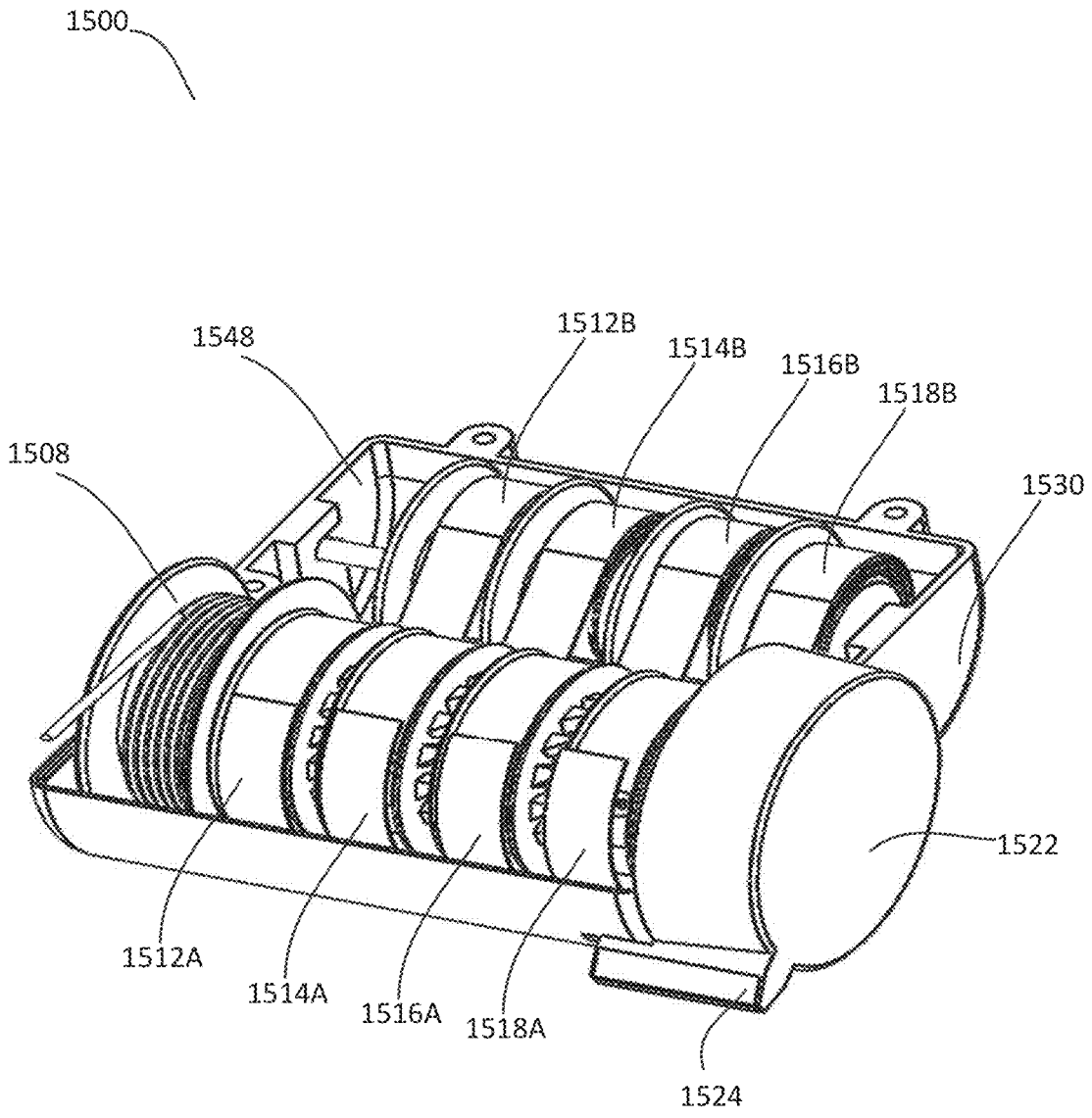
FIG. 27 illustrates a perspective view of another example cable retractor device that includes multiple movable pieces enclosing springs, according to some embodiments.
Figure 28:
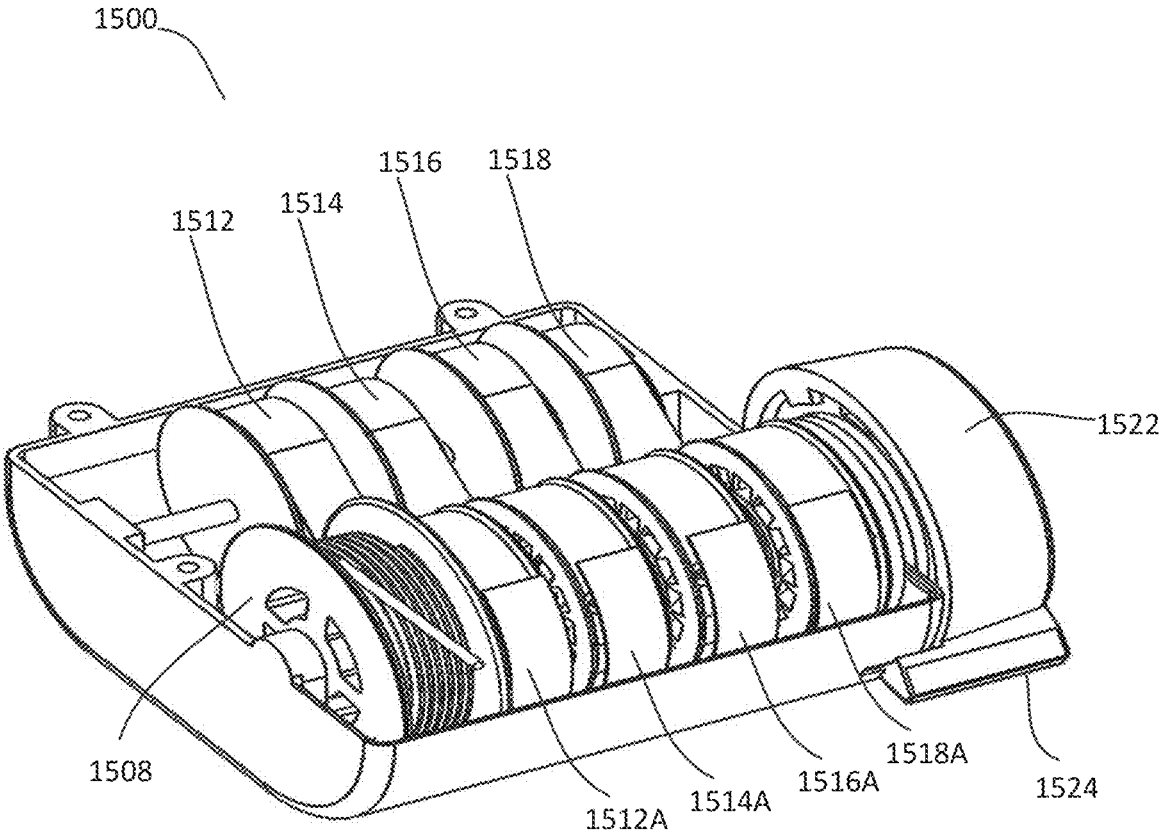
FIG. 28 illustrates another perspective view of the example cable retractor device that includes multiple movable pieces enclosing springs, according to some embodiments.

FIGS. 27 and 28 are perspective views of another example cable retractor device. The device 1500 includes a housing 1548. Enclosed within the housing 1548 are storage drums 1512A-B, 1514A-B, 1516A-B, 1518A-B, and a cord spool 1508 with a cord wrapping around the spool. Four constant-force springs are wound on the storage drums. The constant-force springs are a commercially available type of spring that provides nearly a constant load throughout the spring range of motion, as discussed above. In the depicted embodiment, each constant-force spring is configured to be in an S-shape arrangement, wrapping around the first corresponding storage drum in one direction and wrapping around the second corresponding storage drum in the opposite direction.

The device 1500 further includes a resistance selector. The resistance selector includes an adjustment knob 1522 that may be rotated by the user to adjust the resistance level of the device. The adjustment knob includes a resistance indicator 1524 that displays a visual indication of the current overall resistance level.

Figure 29:
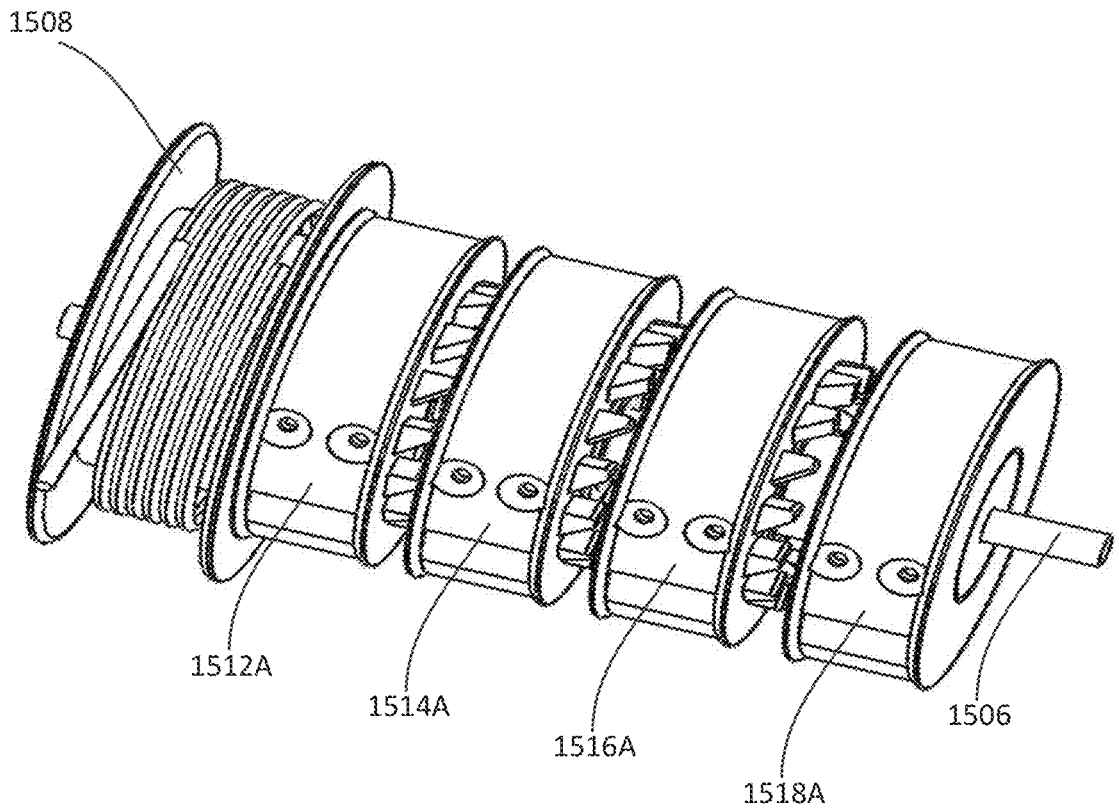
FIG. 29 illustrates a perspective view of the drums of the resistance modules of an example cable retractor device that includes multiple movable pieces enclosing springs, according to some embodiments.

FIG. 29 illustrates an example set of storage drums that may be coupled with each other to create different resistance levels. The set of storage drums includes 1512A, 1514A, 1516A, and 1518A placed on a shaft 1506, with a cable spool 1508 attached to the storage drum 1512A. As shown, each storage drum 1512A, 1514A, 1516A, or 1518A includes an engagement pattern (e.g., a set of teeth) on one side, in a manner similar to FIG. 4. Further, each storage drum 1514A, 1516A, or 1518A includes another engagement pattern (e.g., a set of holes) on the opposite side, in a manner similar to FIG. 5, such that a set of teeth on one storage drum (of one resistance module) can fit into corresponding holes on the adjacent storage drum (of another resistance module). In the depicted example, the storage drum 1512A is permanently attached to the cable spool 1508 such that there is a minimum, first level of resistance to pulling out the cable.

Figure 30A:
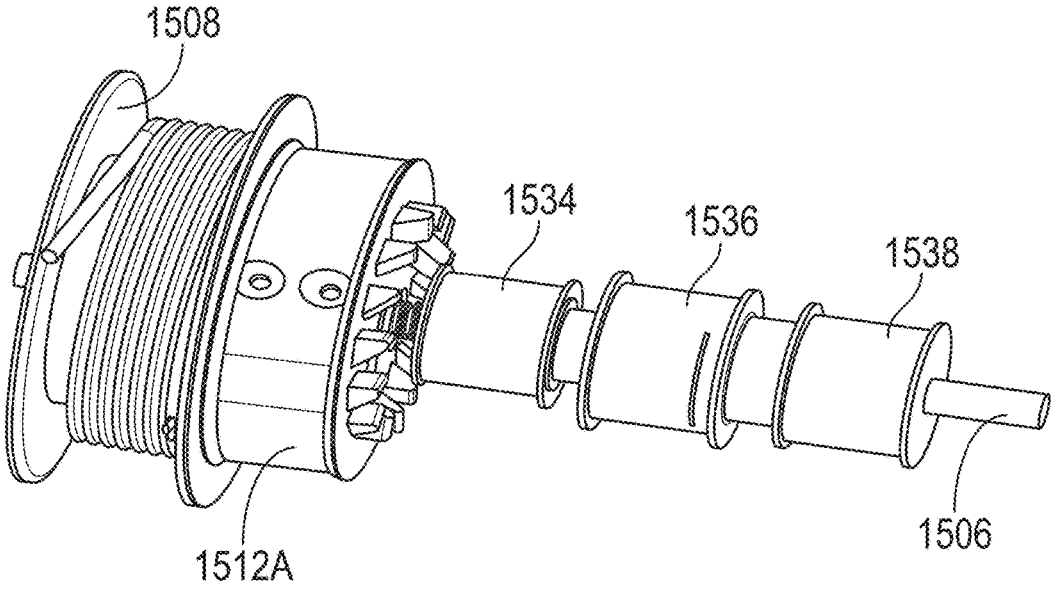
FIG. 30A illustrates a perspective view of the movable pieces enclosing springs of an example cable retractor device, according to some embodiments.
Figure 30B:
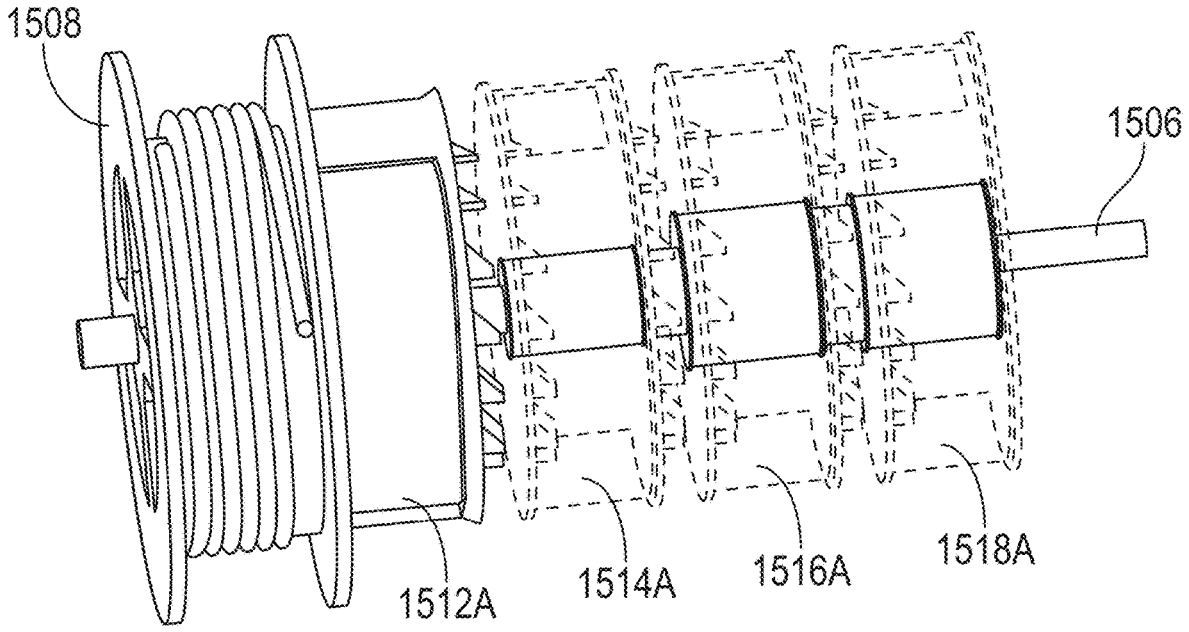
FIG. 30B illustrates another perspective view of the movable pieces enclosing springs of an example cable retractor device, according to some embodiments.

Unlike the embodiment depicted in FIG. 2, the storage drums 1514A, 1516A, and 1518A do not have direct contact with the shaft 1506. Rather, these storage drums are disposed over multiple movable pieces, which can move along the longitudinal axis of the shaft 1506 and allow for better control over the positioning and engagement of storage drums. As depicted in FIG. 30A, movable pieces 1534, 1536, and 1538 are disposed over shaft 1506. In particular, the movable piece 1536 is disposed over an elongated portion of the movable piece 1538. Further, as depicted in FIG. 30B, storage drums 1514A, 1516A, and 1518A are affixed to the movable pieces 1534, 1536, and 1538, respectively.

Figure 31:
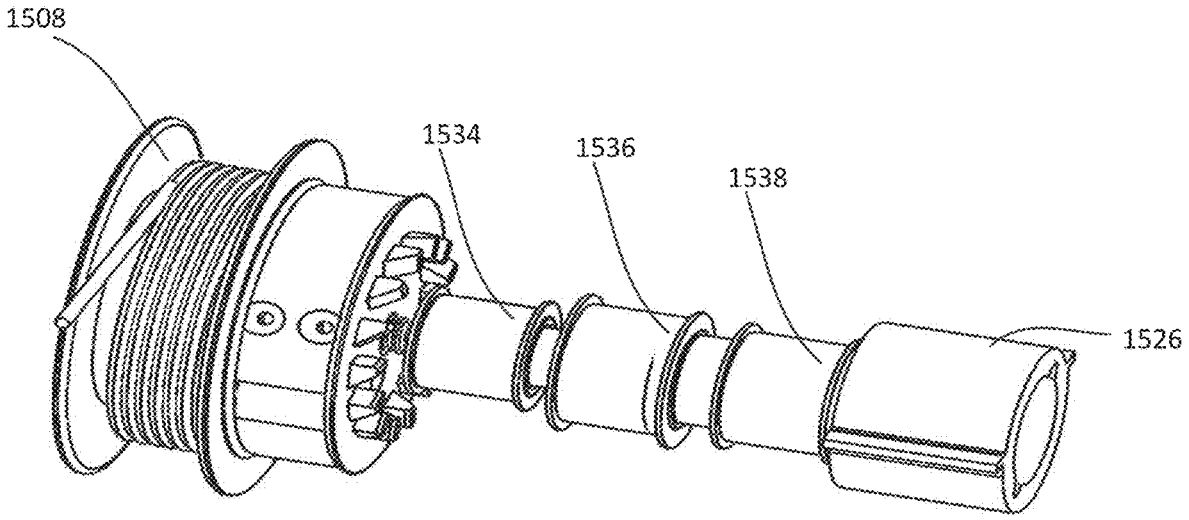
FIG. 31 illustrates another perspective view of the movable pieces enclosing springs of an example cable retractor device, according to some embodiments.
Figure 32:
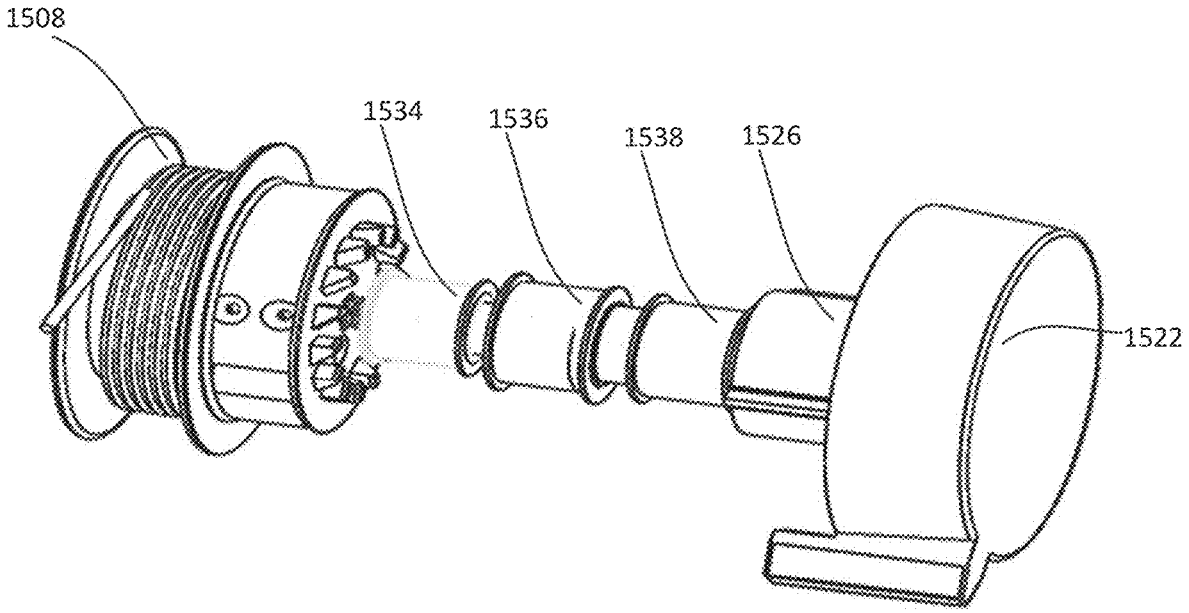
FIG. 32 illustrates another perspective view of the movable pieces enclosing springs of an example cable retractor device, according to some embodiments.

In some embodiments, the movable piece 1538 is affixed to a resistance selector, which comprises an adjustment knob 1522 and a pusher 1526, as illustrated in FIGS. 31 and 32. The resistance selector may operate in a similar manner as described with reference to FIG. 6. When the user rotates the adjustment knob 1522, the pusher 1526 is forced to move along the shaft in a direction determined by the direction that the resistance selector is rotated.

Figure 33A:
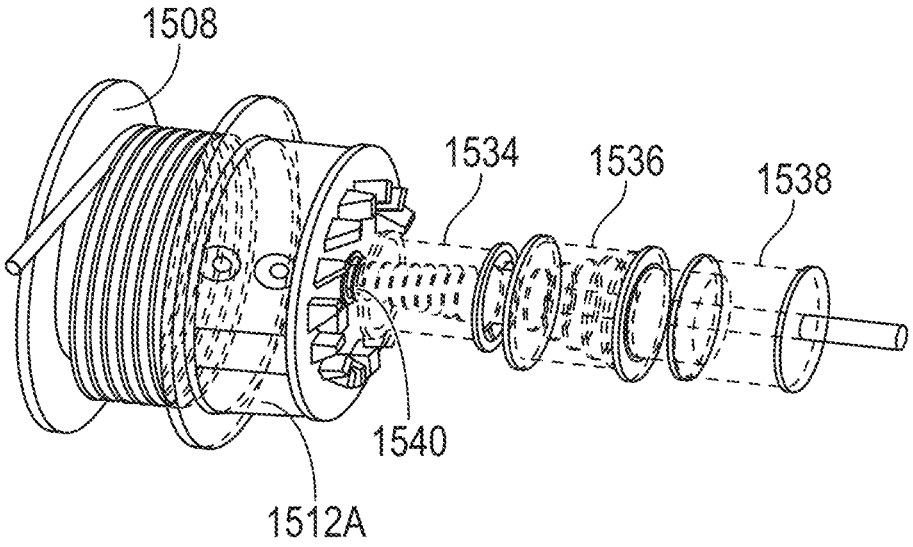
FIG. 33A illustrates another perspective view of the movable pieces enclosing springs of an example cable retractor device, according to some embodiments.
Figure 33B:
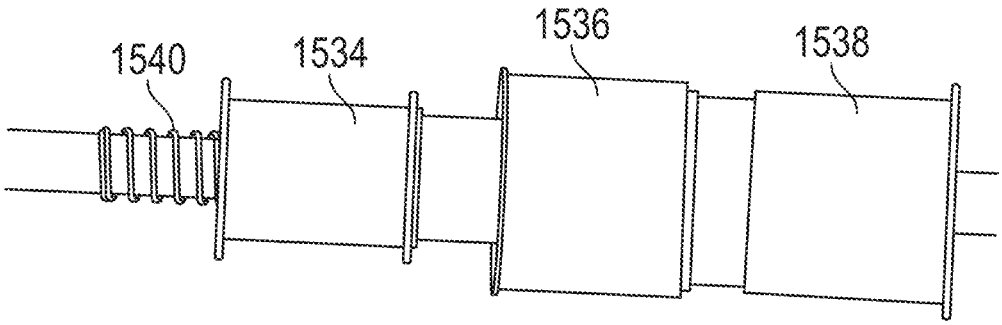
FIG. 33B illustrates another perspective view of the movable pieces enclosing springs of an example cable retractor device, according to some embodiments.
Figure 33C:
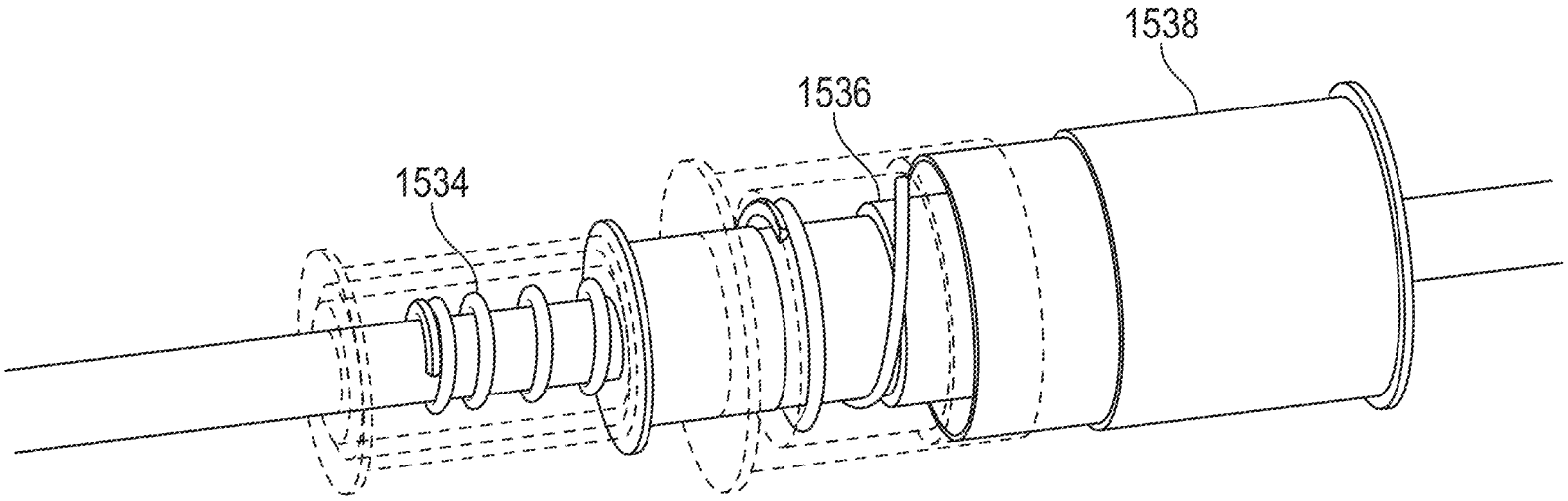
FIG. 33C illustrates another perspective view of the movable pieces enclosing springs of an example cable retractor device, according to some embodiments.

FIGS. 33A-C illustrate the operation of movable pieces 1534, 1536, and 1538. As the user rotates the adjustment knob (not depicted) to engage the storage drums, a spring 1540 is compressed, and the movable pieces 1534, 1536, and 1538 (along with the storage drums affixed to the movable pieces) all move in the direction toward the cable spool 1508. As the spring 1540 is retracted into the movable piece 1534, the storage drum 1514A, which is affixed to the movable piece 1534, becomes engaged with the cable spool 1508 and the permanently attached storage drum 1512A. In this configuration, if the user pulls the cord, the device will provide a second level of resistance provided by the constant-force strings around the storage drums 1512A and 1514A. The spring 1540 is configured to push the assembly of movable pieces back to their original position when the adjustment knob is turned in reverse.

When the storage drums 1512A and 1514A are engaged together, the movable piece 1534 cannot move further toward the cable spool. As the user continues rotating the adjustment knob, the movable piece 1534 partially collapses into the movable piece 1536, and the storage drum around the movable piece 1534 is engaged with the storage drum around the moving piece 1536. In this configuration, if the user pulls the cord, the device will provide a third level of resistance provided by the constant springs around the storage drums 1512A, 1514A, and 1516A.

As the user continues rotating the adjustment knob, the movable piece 1538 is the only movable piece that continues to move toward the cord spool, allowing the storage drum 1518A to become engaged with the storage drum 1516A. In this configuration, if the user pulls the cord, the device will provide a fourth and highest level of resistance provided by the constant springs around the storage drums 1512A, 1514A, 1516A, and 1518A.

FIG. 33C depicts the movable pieces 1534 and 1536 as transparent to show the internal springs that return these pieces to their original positions to disengaged the movable pieces. It should be appreciated that more springs and more layers to this assembly may be added to enable additional resistance levels. Unlike embodiments shown in FIGS. 8 and 10, in which resistance modules are configured to slide along shaft(s) to engage and disengage with each other, the embodiments shown in FIGS. 27-32 move the storage drums via internal springs, thus reducing the friction (e.g., introduced by the shaft) and making the adjustment process easier and less error-prone.

Figure 34A:
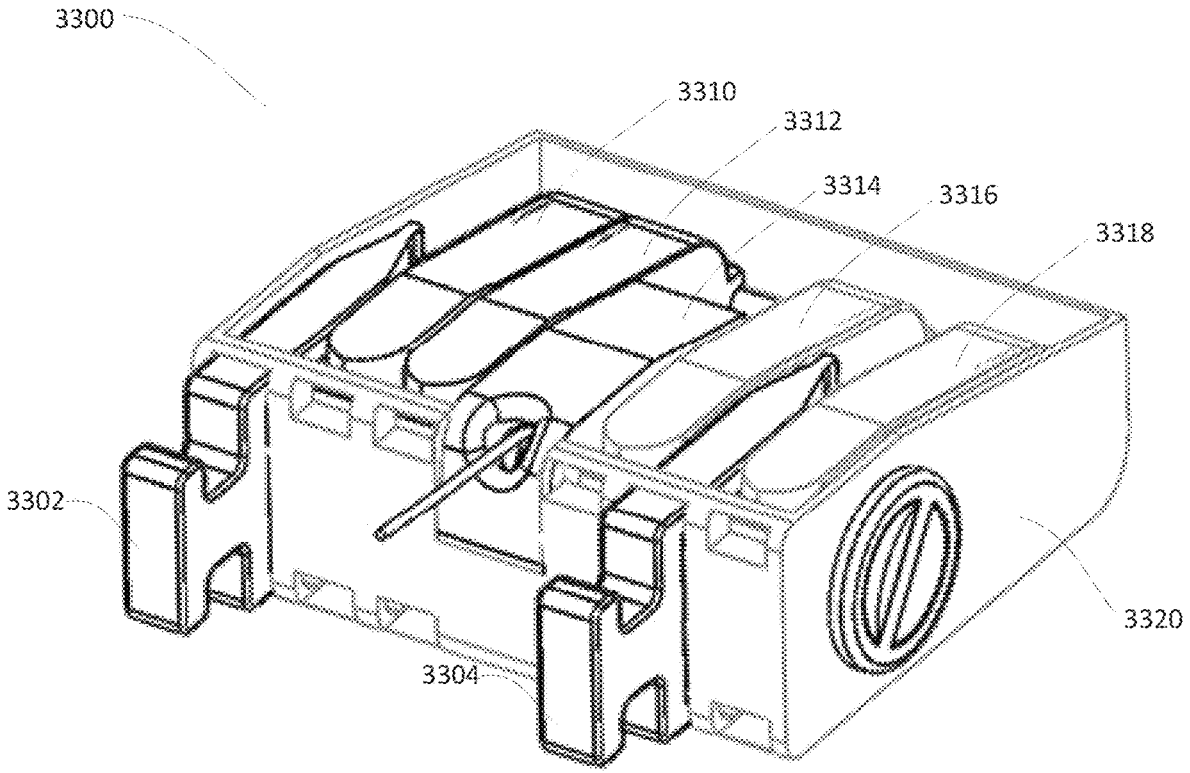
FIG. 34A illustrates a perspective view of another example cable retractor device that includes multiple detachable key pins for setting the resistance level of the device, according to some embodiments.
Figure 34B:
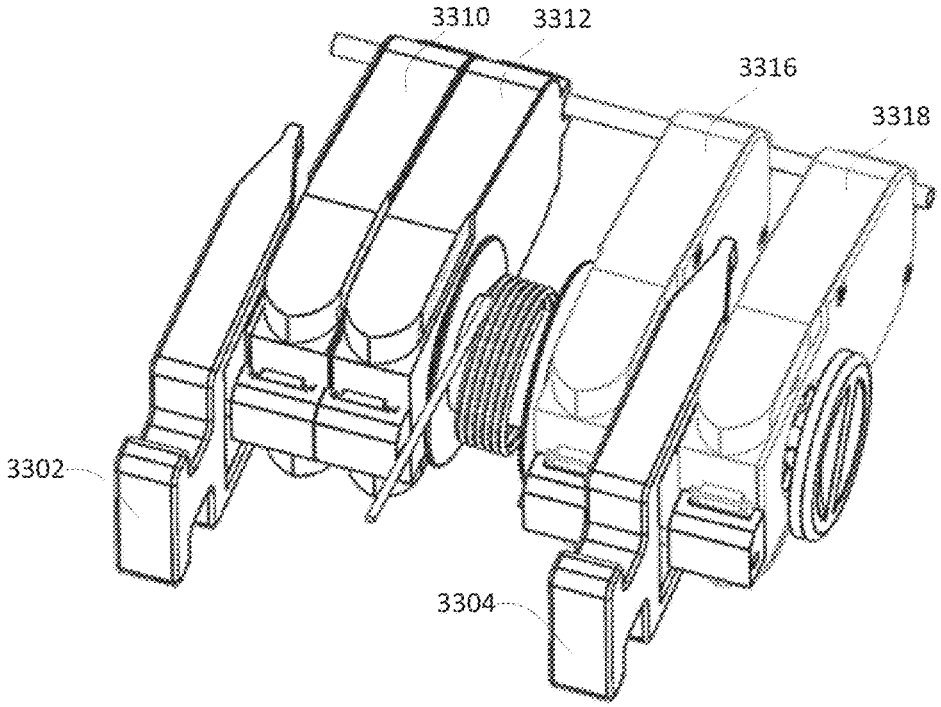
FIG. 34B illustrates another perspective view of an example cable retractor device that includes multiple detachable key pins for setting the resistance level of the device, according to some embodiments.
Figure 34C:
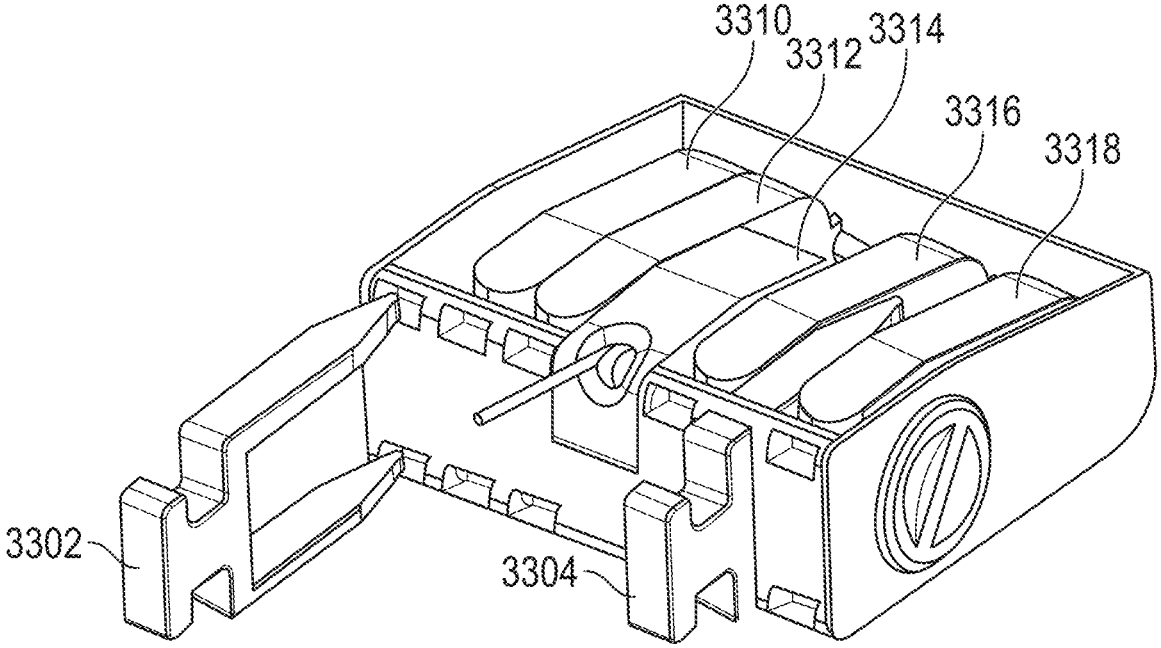
FIG. 34C illustrates another perspective view of an example cable retractor device that includes multiple detachable key pins for setting the resistance level of the device, according to some embodiments.

FIGS. 34A-D illustrate an example cable retractor device that includes multiple detachable key pins for setting the resistance level of the device. As shown in FIG. 34A, the device 3300 includes a housing 3320, a cord/spool component 3314, and four resistance modules 3310, 3312, 3314, and 3318. The cord/spool component 3314 is disposed in the middle of the housing 3320 between resistance modules 3312 and 3316 and remains stationary relative to the housing 3320. The cord/spool component includes engagement patterns on both sides such that the resistance module 3312 and/or the resistance module 3316 can be pushed into and couple with the cord/spool component. Each resistance module 3312 or 3316 includes engagement patterns on both sides such that either resistance module can be coupled with the cord/spool component and/or the neighboring resistance module (3310 or 3318). Further, each of the resistance modules 3310 and 3318 includes engagement patterns on the side that can contact the neighboring resistance module (3312 or 3316) such that modules 3310 and 3312 may be coupled and modules 3316 and 3318 may be coupled.

Figure 34D:
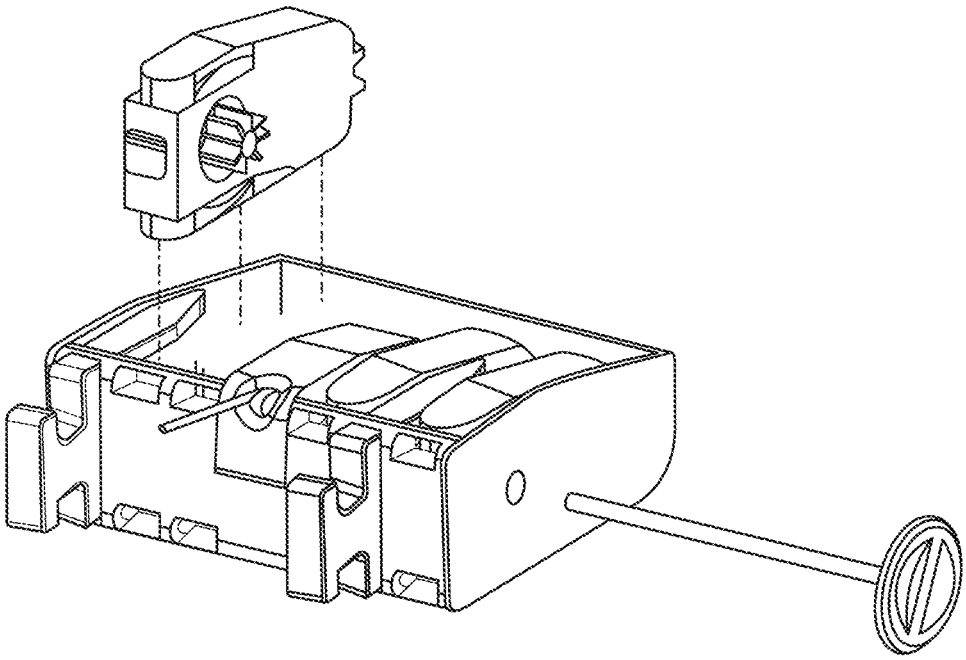
FIG. 34D illustrates another perspective view of an example cable retractor device that includes multiple detachable key pins for setting the resistance level of the device, according to some embodiments.

The system further includes two detachable key pins 3302 and 3304 for adjusting the resistance level of the device. The two key pins can be inserted between resistance modules, between a resistance module and a lateral surface of the housing, and/or between a resistance module and the cord/spool component. In the depicted example in FIGS. 34A-C, the key pin 3302 is inserted between a lateral wall of the housing and the resistance module 3310. As such, the key pin 3302 pushes the resistance module 3310 and the resistance module 3312 toward the cord/spool component 3314 such that they are coupled together. Further, the key pin 3304 is inserted between the resistance modules 3316 and 3318. As such, the cord/spool component 3314 is coupled with the resistance module 3316, while the resistance modules 3316 and 3318 are not coupled together. Accordingly, in the depicted configuration, the device provides a resistance level that is a combination of resistance modules 3310, 3312, and 3316. One of ordinary skill in the art should appreciate that the device provides five possible resistance levels: no resistance module, one resistance module, two resistance modules, three resistance modules, and four resistance modules. In some embodiments, at least a portion of the top surface of the device is exposed such that the user can view the interactions between the key pin(s) and the resistance modules. As depicted in FIG. 34D, each resistance module can be removed and replaced, for example, with another resistance module having a different resistance level.

In the depicted embodiment, the key pin 3302 includes two branches such that the key pin does not come in contact with a protruding interlocking gear of a resistance module when the key pin is inserted. Further, each branch has an attenuating distal end such that the key pin can be easily inserted. It should be appreciated that the key pin can include any number of branches and each branch can be of other shapes. For example, the bottom branch of the key pin may include a slot that can engage with a tooth on the housing of the device to secure the key pin in place once it is inserted.

When the cord/spool component is placed on one side of the box, pulling the cable may cause the device to turn sideways and cause the cable to rub against the housing of the device. Positioning the cord/spool component in the middle of the device allows even distribution of the force on the device when the user pulls the cable and minimizes damage to the cable.

Figure 35:
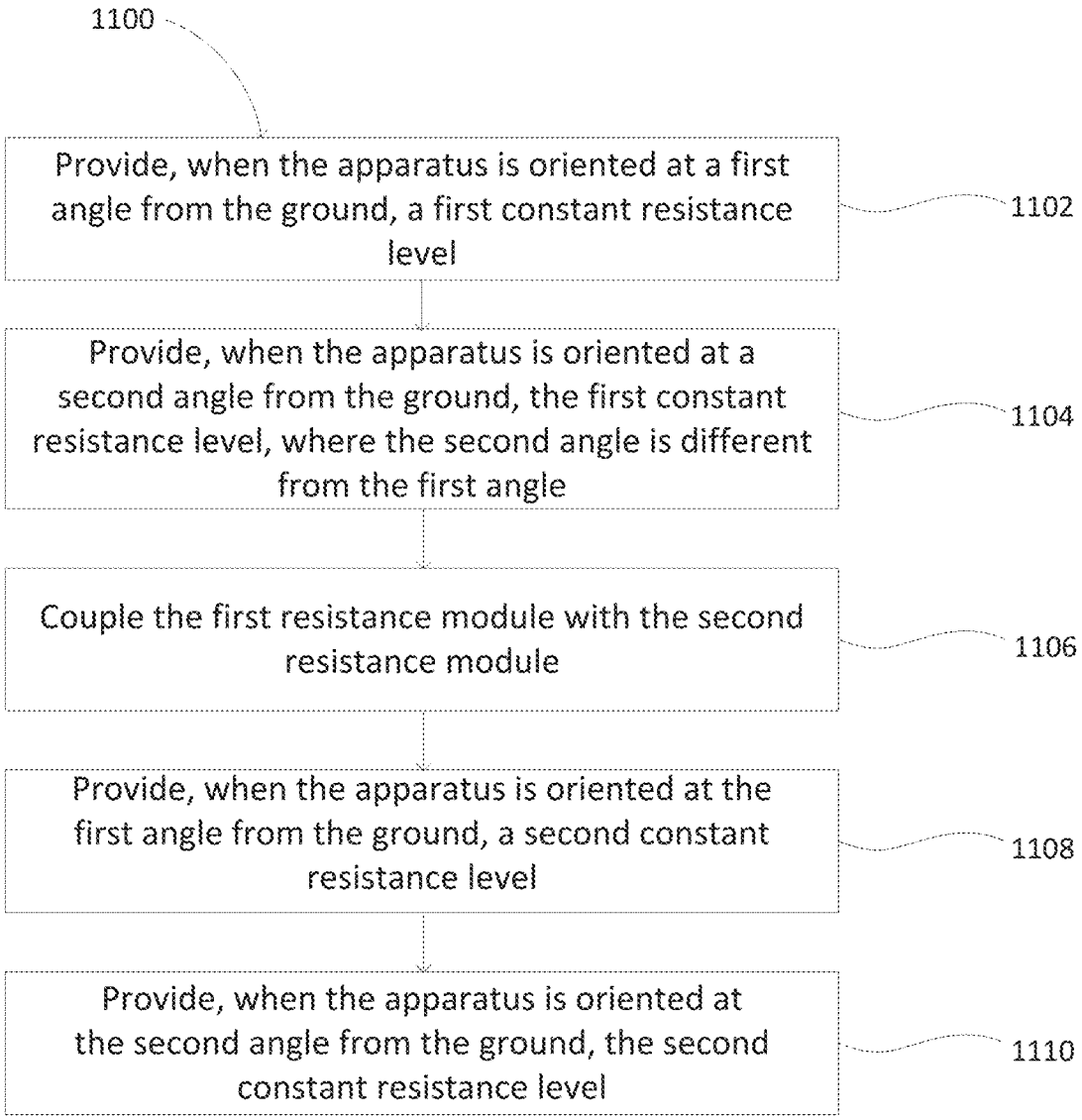
FIG. 35 illustrates an example method for using the cable retractor device, according to some embodiments.

Embodiments of the disclosure may comprise an apparatus for providing a constant level of resistance, the apparatus having a first resistance module and a second resistance module. FIG. 35 illustrates an example method for using the cable retractor device. When the apparatus is oriented at a first angle from ground, a first constant resistance level is provided (step 1102 of method 1100). When the apparatus is oriented at a second angle from the ground, the first constant resistance level is provided, wherein the second angle is different from the first angle (step 1104). The first resistance module may be coupled with the second resistance module (step 1106). In some embodiments, when the apparatus is oriented at the first angle from ground, a second constant resistance level may be provided (step 1108). When the apparatus is oriented at the second angle from ground, the second constant resistance level may be provided (step 1110).

Figure 36:
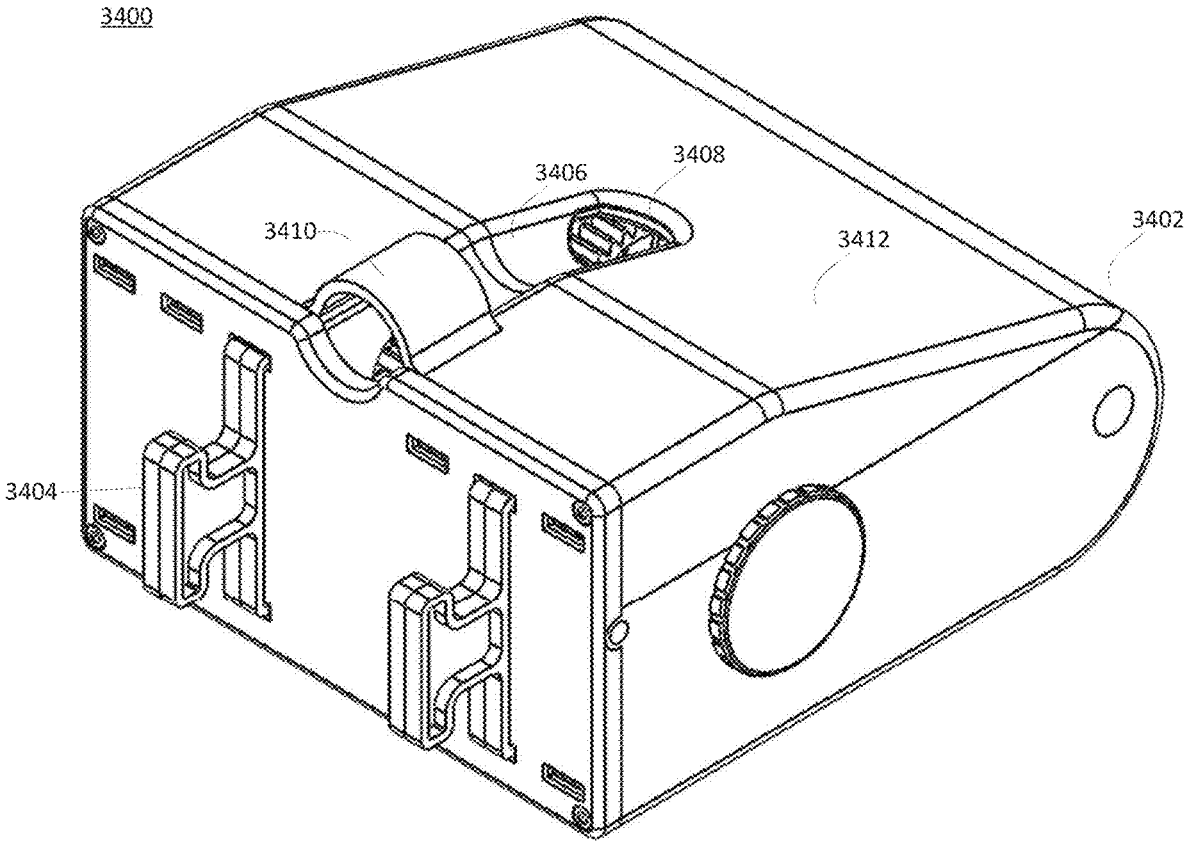
FIG. 36 illustrates a perspective view of an example cable retractor device, according to some embodiments.

FIG. 36 illustrates an example cable retractor device 3400. Cable retractor device 3400 can comprise an outer housing 3402 and one or more detachable key pins 3404. Outer housing 3402 can comprise a cable channel 3406 that terminates in a cable hole 3408. In use, a cable can extend from the cable hole 3408 and be fed through cable channel 3406 and under arch 3410. Outer housing 3402 can further comprise a top portion 3412.

Figure 37:
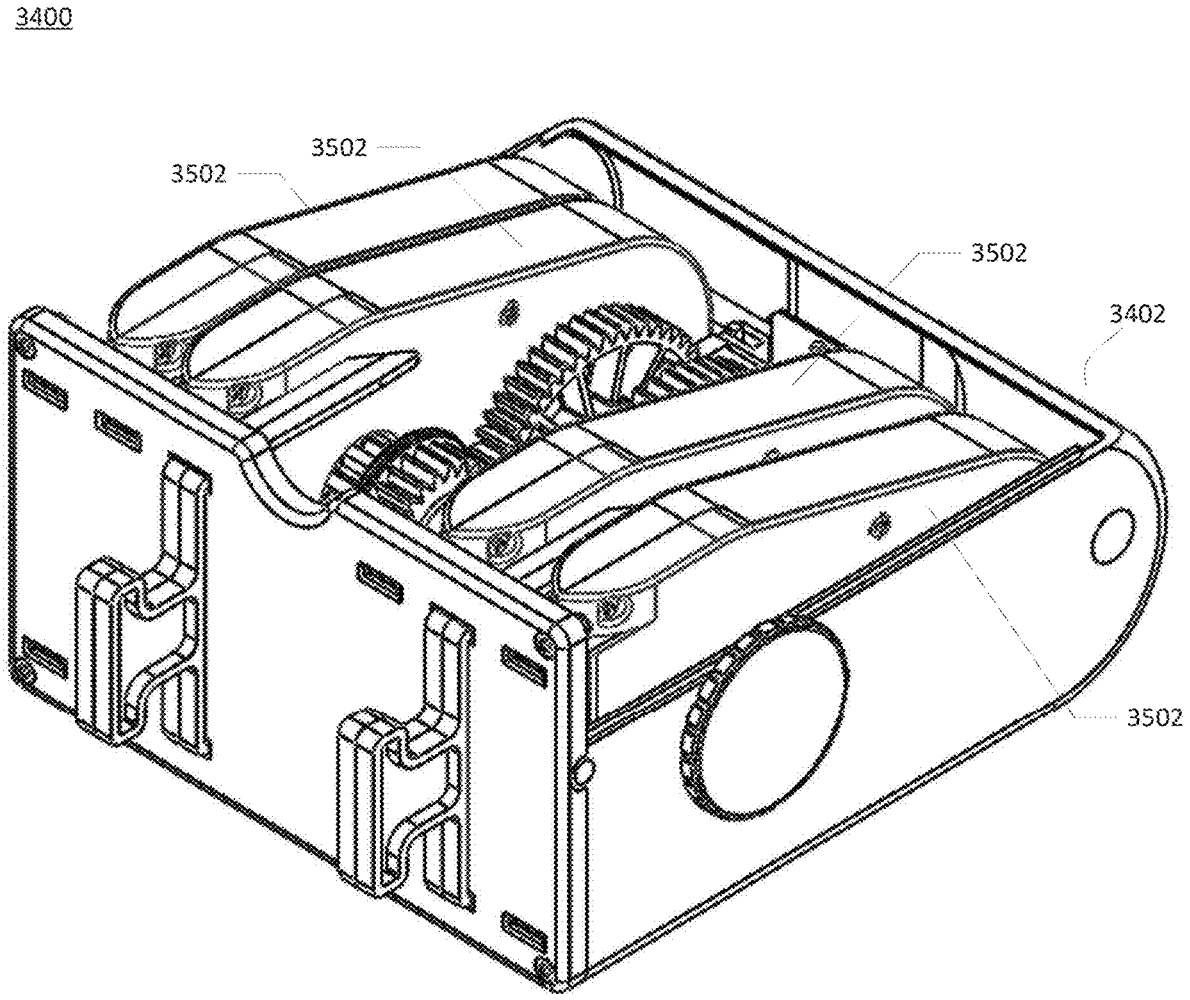
FIG. 37 illustrates a perspective view of components of an example cable retractor device, according to some embodiments.
Figure 38:
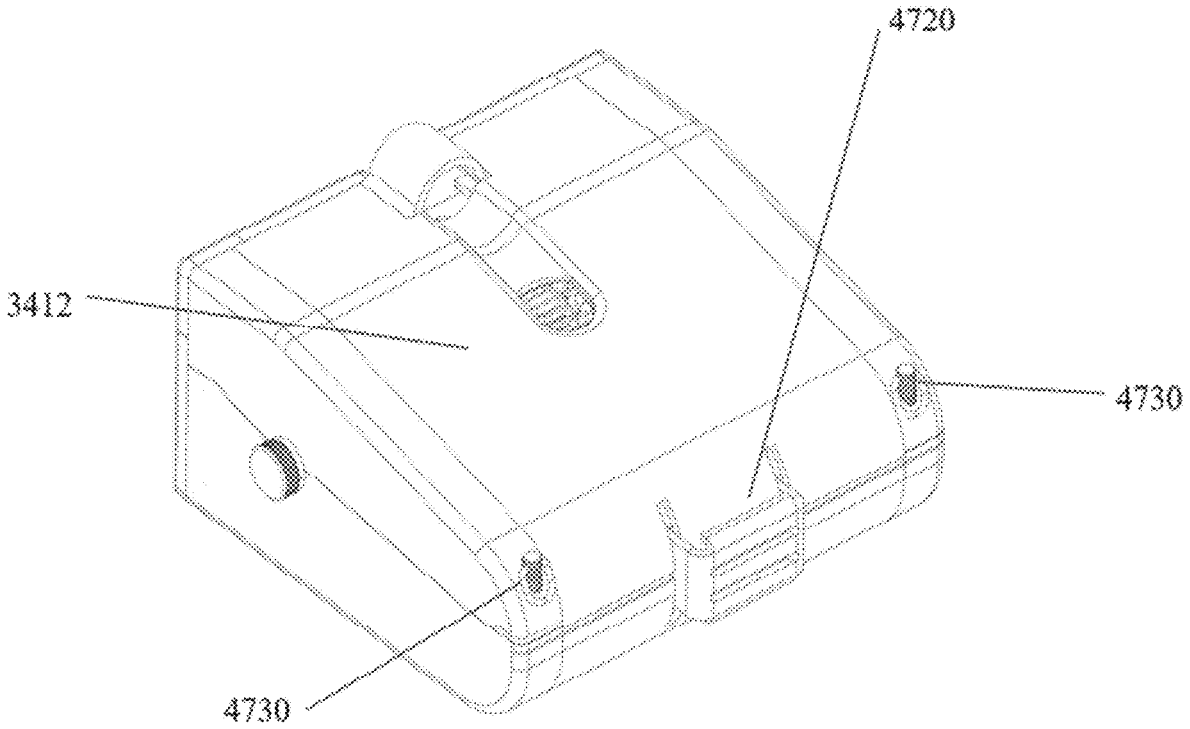
FIG. 38 illustrates a perspective view of an example cable retractor device showing a top portion with thumb screws, according to some embodiments.

FIG. 37 illustrates a view of the example cable retractor device 3400 with the top portion 3412 of outer housing 3402 removed. Cable retractor device 3400 can comprise one or more resistance modules 3502, which can correspond to resistance modules 150, 2708, 2740, 3200, and/or 3310. In certain embodiments, the cable retractor device 3400 can be between 5 inches and 15 inches wide, between 6 inches and 12 inches wide, between 7 inches and 9 inches wide, or between 7 inches and 8 inches wide. In certain embodiments, the cable retractor device 3400 can be between 3 inches and 6 inches high, between 3.5 inches and 5.5 inches high, or between 4 inches and 5 inches high. In certain embodiments, the cable retractor device 3400 can be between 5 inches and 15 inches deep, between 6 inches and 12 inches deep, between 7 inches and 9 inches deep, or between 7 inches and 8 inches deep. FIG. 38 shows an embodiment where top portion 3412 is held in place by at least one thumb screw 4730, such as two, for easy opening and closing by the user. In some embodiments, the at least one thumb screw 4730 is secured with a retaining ring to prevent separation of the thumb screws 4730 from top portion 3412.

Figure 39A:
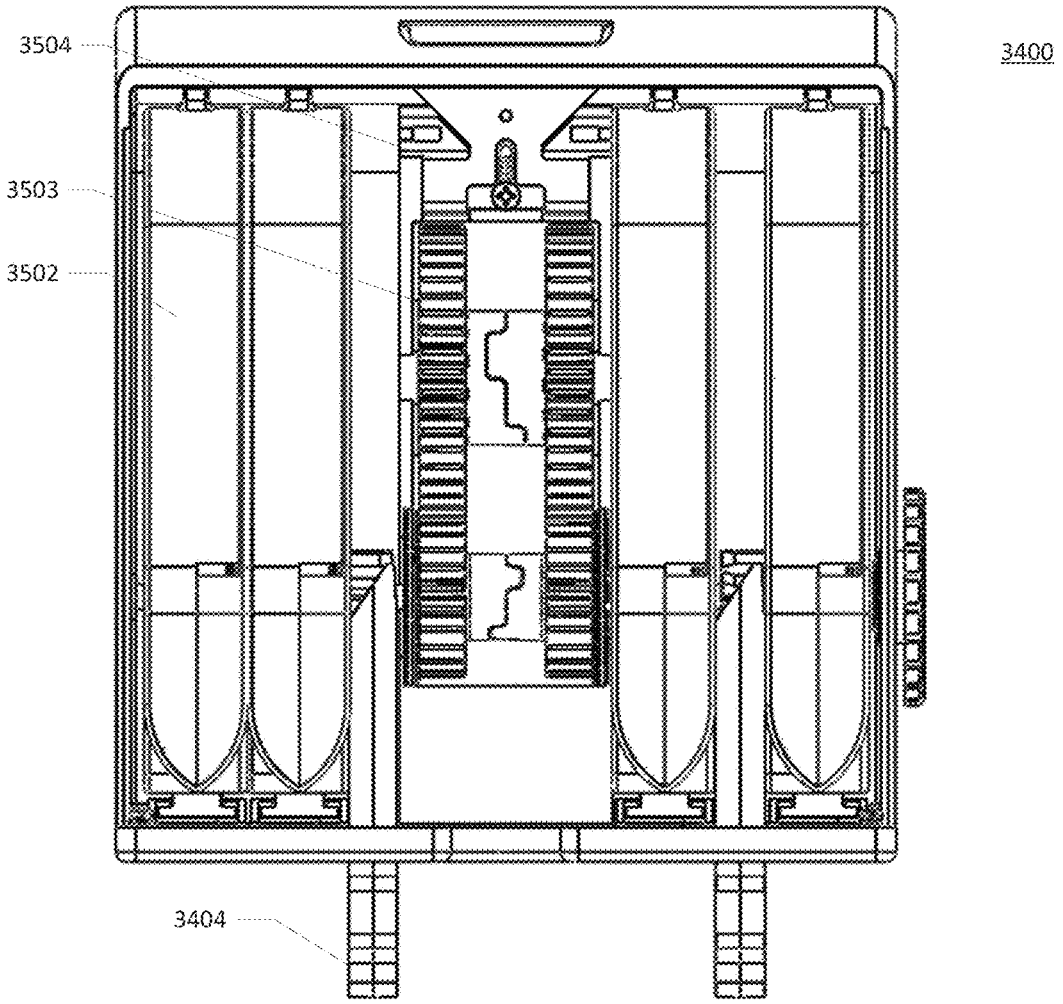
FIG. 39A illustrates a plan view of components of an example cable retractor device, according to some embodiments.
Figure 39B:
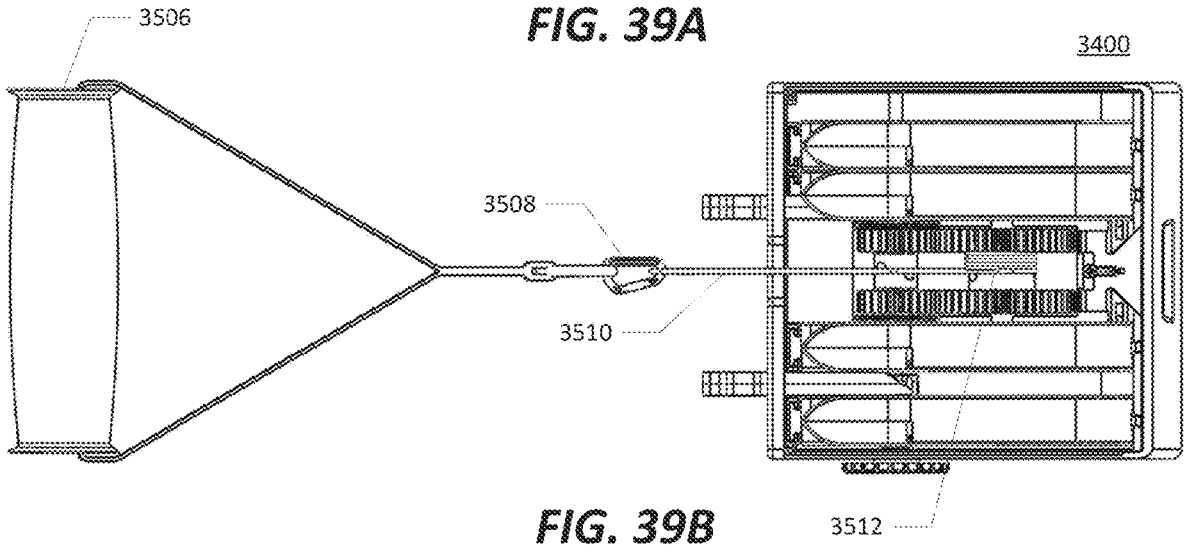
FIG. 39B illustrates another plan view of components of an example cable retractor device, according to some embodiments.

FIGS. 39A and 39B illustrate a top-down view of an example cable retractor device 3400. As shown in FIG. 39A, cable retractor device 3400 can comprise one or more resistance modules 3502, a gear system 3503, and a locking system 3504. As shown in FIG. 39B, cable retractor device 3400 can also comprise a cable 3510, which can connect on a first end to a carabiner clip 3508. The carabiner clip 3508 can serve to connect a handle 3506 to a cable 3510. In other embodiments, a handle 3506 can connect to a cable 3510 via other suitable means (e.g., via a buckle), or a handle 3506 can be directly connected to a cable 3510. In some embodiments, cable 3510 can connect on a second end to a cable spool 3512. Cable spool 3512 can optionally be a part of a gear system 3503, or the cable spool 3512 can be attached to the gear system 3503 in any suitable manner such that unwinding a cable from the cable spool can exert a force on the gear system.

Figure 40:
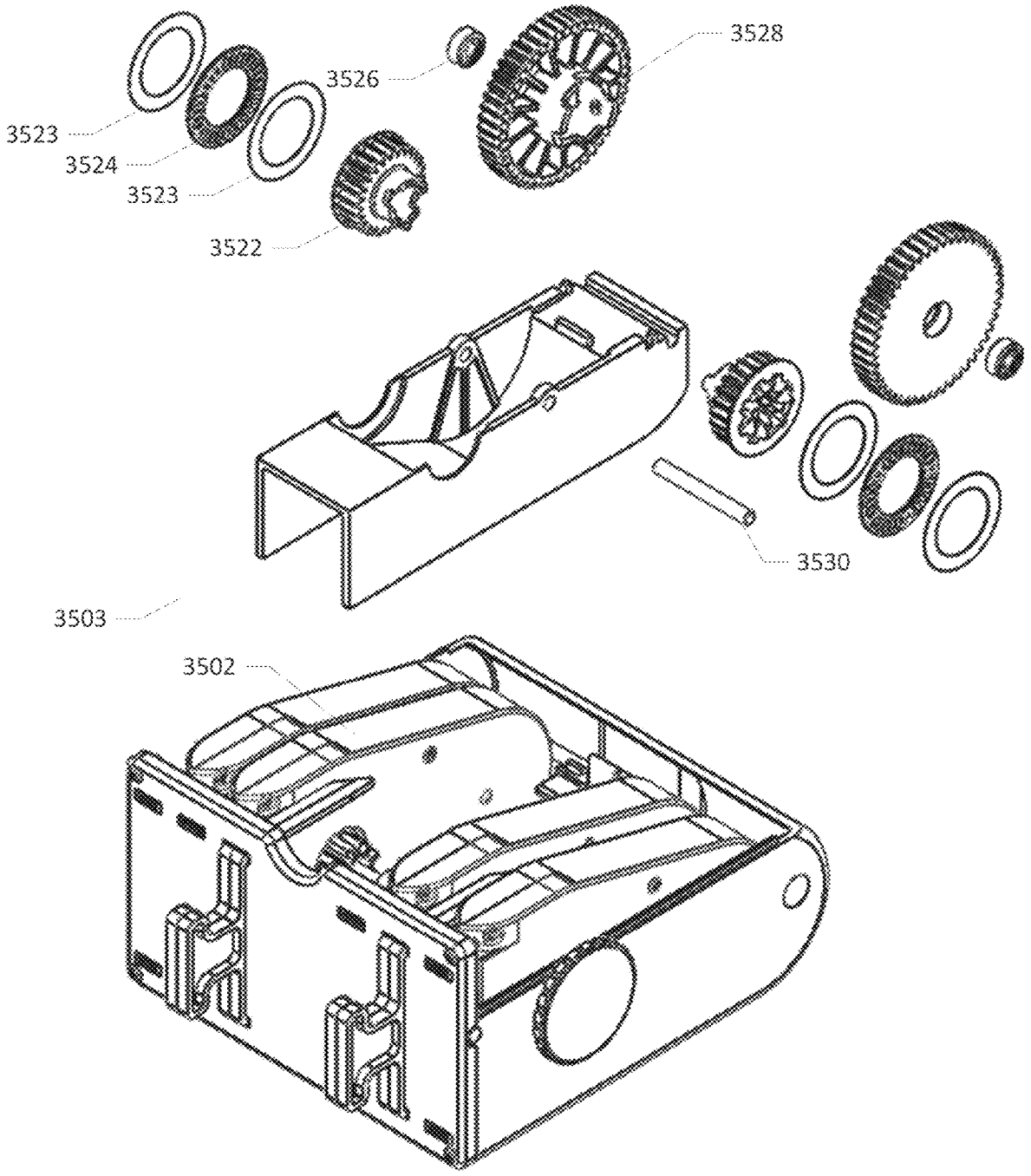
FIG. 40 illustrates an exploded view of a gear system of an example cable retractor device, according to some embodiments.

FIG. 40 is an exploded view of an example gear system 3503. Gear system 3503 can comprise one or more driven gears 3522, one or more thrust bearings 3524, and one or more washers 3523. In use, thrust bearing 3524 can help prevent gears from seizing up under axial load when one or more resistance modules 3502 are engaged. In some embodiments, thrust bearing 3524 can have a washer 3523 on each side of the thrust bearing so that the thrust bearing 3524 can ride on washers 3523 to prevent damaging other parts, which can be plastic. However, the use of two washers 3523 can be optional. Only one washer 3523 may be used on one side of the thrust bearing 3524, or no washers may be used with the thrust bearing 3524. Gear system 3503 can also comprise one or more driving gears 3528, one or more bearings 3526, and a shaft 3530. Bearing 3526 can be a ball bearing and can allow shaft 3530 to remain stationary while a driving gear 3528 rotates. In the depicted embodiment, driving gear 3528 can mate with and drive driven gear 3522 (e.g., by having the same teeth spacing). Driving gear 3528 may have a larger radius than driven gear 3522, which can amplify a torque required to drive driven gear 3522 by a gear ratio between driving gear 3528 and driven gear 3522. However, it is also contemplated that other gear trains can be used (e.g., a smaller driving gear mated with a larger driven gear such that a torque required to drive a driven gear is reduced).

In some embodiments, a gear ratio between the driving gear 3528 and driven gear 3522 for actuating the spring may be tuned based on a ratio between a desired constant-force resistance (e.g., the incremental force provided by the device 100) and a constant force provided by the spring. The gear ratio may be expressed as follows:

$$\text{Gear Ratio} = \frac{F_{resistance\,module}}{F_{spring}}$$

Where $F_{resistance\ module}$ is a constant-force resistance provided by a resistance module (e.g., an incremental force provide by a device comprising the resistance module), and $F_{spring}$ is a spring force of the spring in the resistance module. As discussed above, in some embodiments, $F_{resistance}$ module is greater than or equal to $F_{spring}$. Therefore, in some embodiments, the gear ratio is 1:1 or greater. The incremental force provide by the device 100 may be 0.5 to 100 pounds (e.g., 1, 2, 2.5, 3, 5, 10, 15, 20, 25, 30, 40, 50, 75, 100 pounds). The incremental force provide by the device 100 may be 0.5 to 50 pounds (e.g., 1, 2, 2.5, 3, 5, 10, 15, 20, 25, 30, 40, 50 pounds). Therefore, $F_{spring}$ may be less than or equal 0.5 to 50 pounds. If a resistance module is configured to provide a force of 3 pounds, then the resistance module comprises a spring that is configured to provide a force of less than 3 pounds. As examples, the ratio of the larger driven gear to the smaller drive gear is between 5:1 and 1.2:1 (e.g., $F_{resistance\ module}$ is 1.2 to 5 times greater than $F_{spring}$), is between 4:1 and 1.4:1 (e.g., $F_{resistance\ module}$ is 1.4 to 4 times greater than $F_{spring}$), is between 3:1 and 1.6:1 (e.g., $F_{resistance\ module}$ is 1.6 to 3 times greater than $F_{spring}$), or is 2:1 (e.g., $F_{resistance\ module}$ is 2 times greater than $F_{spring}$).

The example gear ratios may advantageously allow smaller springs (e.g., springs 114D, 116D, 118D, 1540) to be used. For example, without the example gear ratios, the springs may need to be larger to create enough resistance and be durable enough to tolerate a threshold amount of pull-cycles. The larger springs would cause device housing to be larger and the device to be less portable. The example gear ratios may also advantageously allow more cheaper springs (e.g., springs 114D, 116D, 118D, 1540) to be used, increasing the longevity and reducing cost of the cable retractor device. For instance, the example gear ratios allow the cable retractor device to tolerate larger spring manufacturing variations (cheaper), while providing a resistance suitable for a user of the device.

In the depicted embodiment of example gear system 3503, two identical gear trains are used, and each gear train may comprise a driving gear 3528 and a driven gear 3522. It can be beneficial to use a gear system with two gear trains to minimize the connections required to engage each resistance module 3502. For example, the depicted embodiment can use four resistance modules 3502, but a given resistance module 3502 can be no more than one resistance module away from gear system 3503. However, it is also contemplated that a gear system can use a single gear train, with one or more resistance modules engaged with the gear train.

In the depicted embodiment of example gear system 3503, two driving gears 3528 can be used, and each driving gear 3528 can comprise an interlocking central protrusion. Two driving gears 3528 can interlock with each other using each driving gear's interlocking central protrusion. Two driving gears 3528 can therefore form a cylindrical connection as a result of the interlocked central protrusions. A cylindrical connection between two driving gears 3528 can serve as a cable spool (which can correspond to cable spool 3512 depicted in FIG. 39B) to which a cable can be attached. However, it is also contemplated that a cable spool is a separate component from driving gears 3528 and can be mechanically attached to driving gears 3528 via any suitable means.

Figure 41:
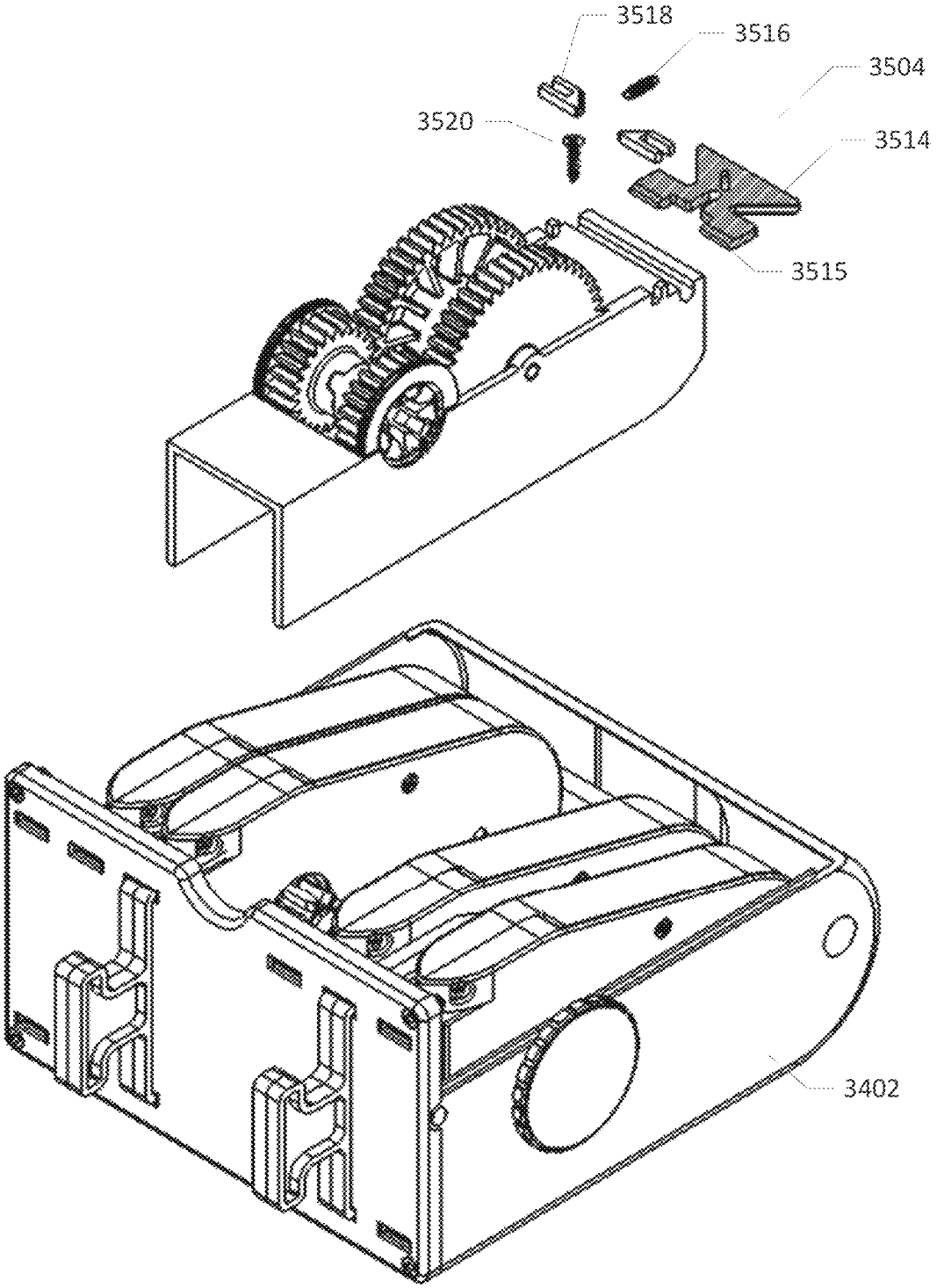
FIG. 41 illustrates an exploded view of a locking system of an example cable retractor device, according to some embodiments.
Figure 42A:
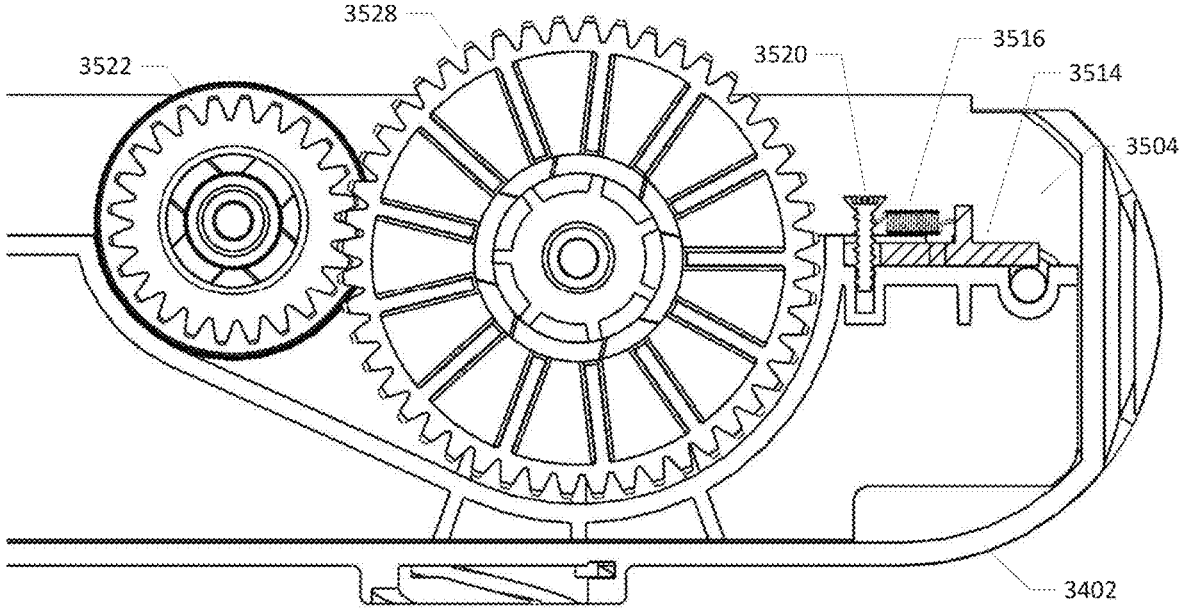
FIG. 42A illustrates a side view of the locking system of an example cable retractor device, according to some embodiments.
Figure 42B:
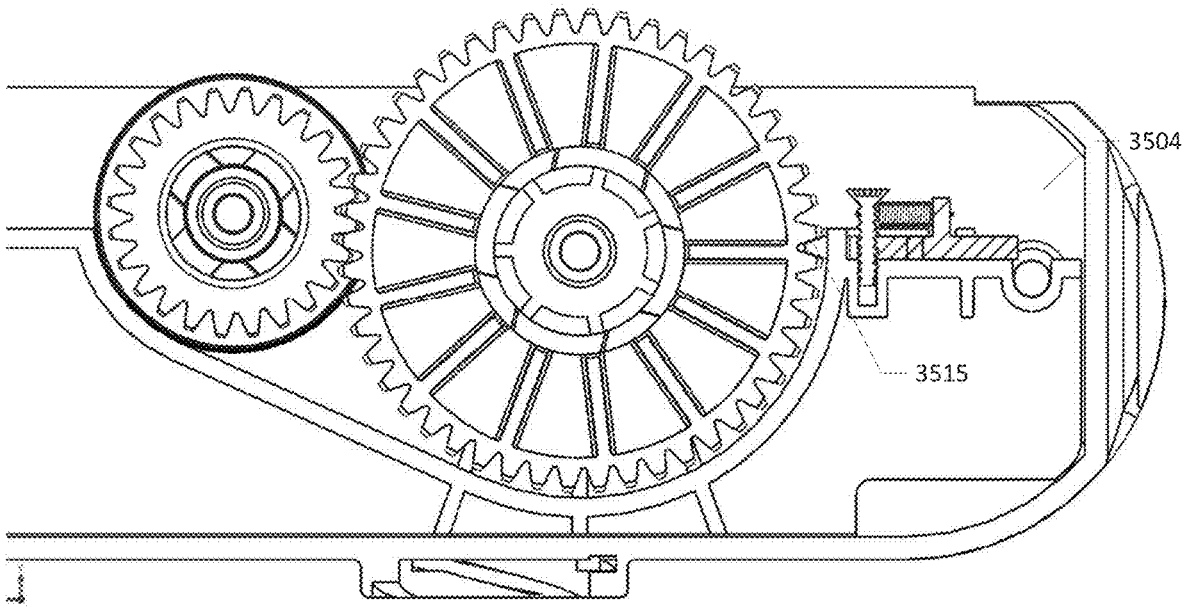
FIG. 42B illustrates another side view of the locking system of an example cable retractor device, according to some embodiments.

FIG. 41 is an exploded view of an example locking system 3504. A locking system 3504 can be beneficial to prevent a cable spool from unwinding when no resistance modules are engaged (e.g., when a detachable key pin has separated a gear system from all resistance modules). Locking system 3504 can comprise a wedge 3514, a spring 3516, one or more side sliders 3518, and an anchoring screw 3520. Wedge 3514 can comprise one or more wedge ends 3515. FIGS. 42A and 42B illustrate an example locking system 3504 in use. According to some embodiments, wedge 3514 can be attached to anchoring point 3520 (in some embodiments, anchoring point 3520 can be an anchoring screw) via a spring 3516. Anchoring screw 3520 can be fixed relative to outer housing 3402, and wedge 3514 can slide laterally (left and right as shown in FIGS. 42A and 42B) relative to outer housing 3402. FIG. 42A illustrates an example locking system 3504 in an unlocked state. According to some embodiments, an unlocked state can be achieved by pushing wedge 3514 away from anchoring screw 3520 such that a spring 3516 is extended. FIG. 42B illustrates an example locking system 3504 in a locked state. According to some embodiments, a locked state can be achieved by releasing wedge 3514 such that spring 3516 pulls wedge 3514 towards an anchoring screw 3520. In a locked state, one or more wedge ends can be inserted into one or more driving gears 3528 such that driving gears 3528 cannot rotate. Because two connected driving gears 3528 can form a cable spool, locking mechanism 3504 can prevent a cable from unwinding when driving gears 3528 are prevented from rotating. According to some embodiments, wedge 3514 can have two wedge ends 3515, and each wedge end 3515 can engage a separate driving gear 3528. However, in other embodiments, a single wedge end 3515 can engage a single driving gear 3528 as well.

Figure 43A:
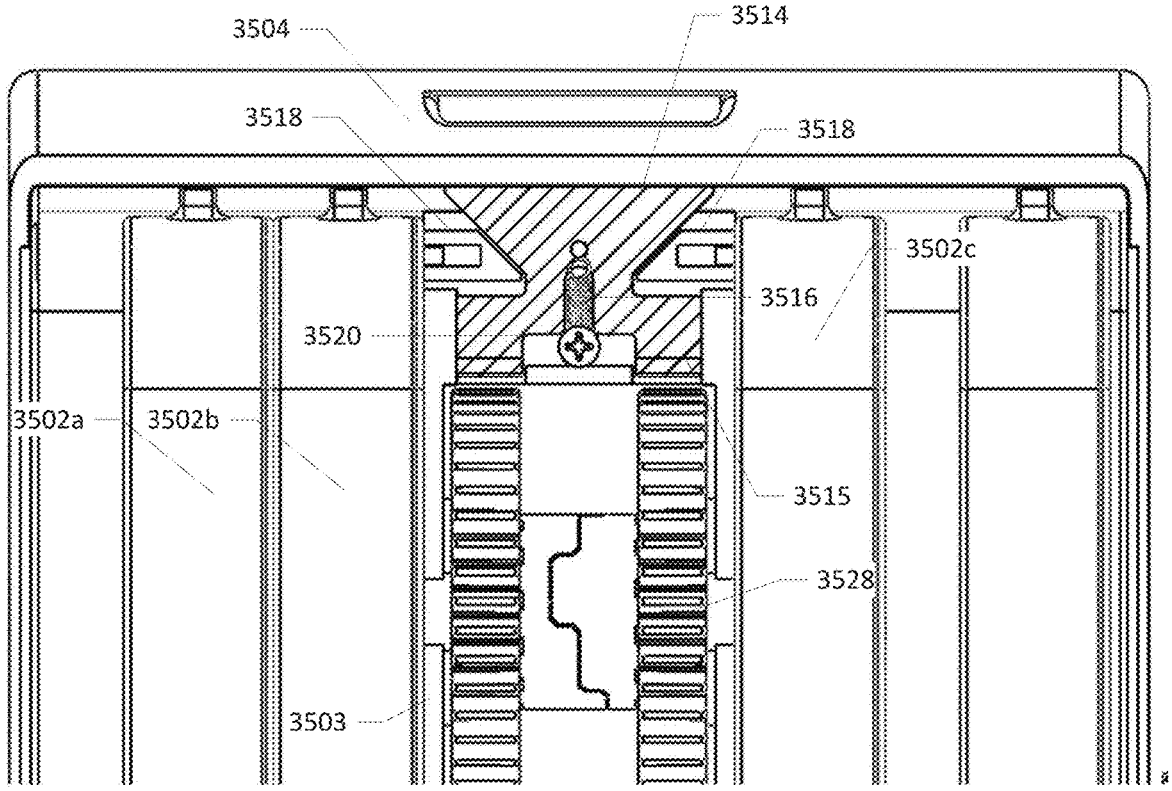
FIG. 43A illustrates a plan view of the locking system of an example cable retractor device, according to some embodiments.
Figure 43B:
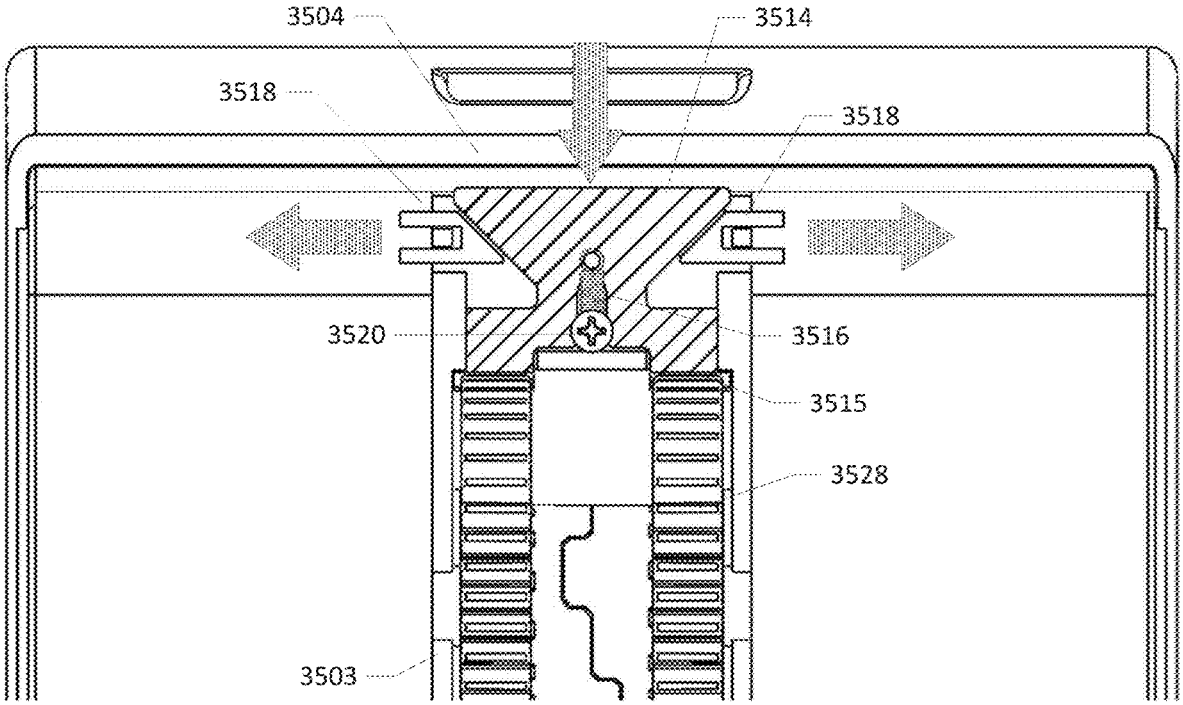
FIG. 43B illustrates another plan view of the locking system of an example cable retractor device, according to some embodiments.
Figure 44A:
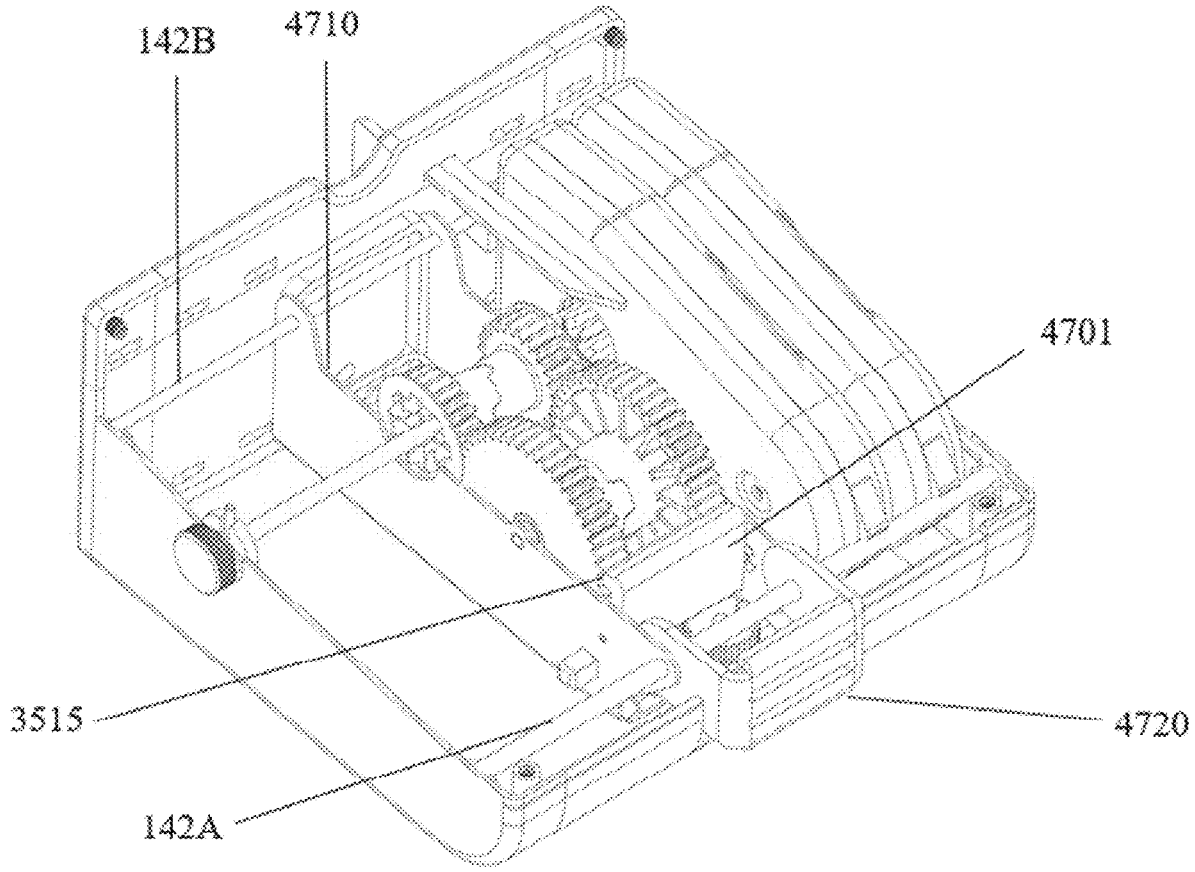
FIG. 44A illustrates a perspective view of an example cable retractor device showing an alternative wedge and an internal gear housing with rods extending through the internal gear housing, according to some embodiments.
Figure 44B:
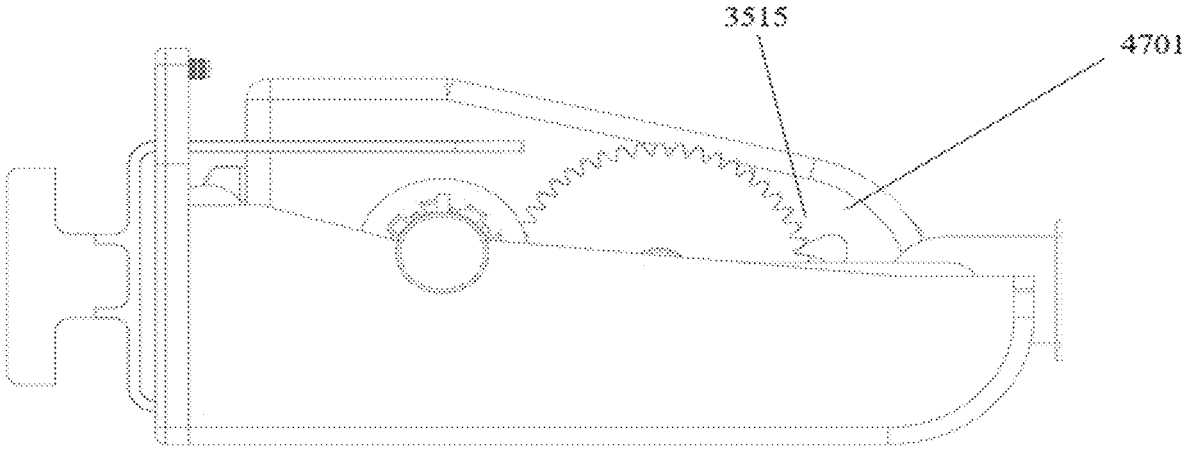
FIG. 44B illustrates a side view of an example cable retractor device showing an alternative wedge, according to some embodiments.
Figure 44C:
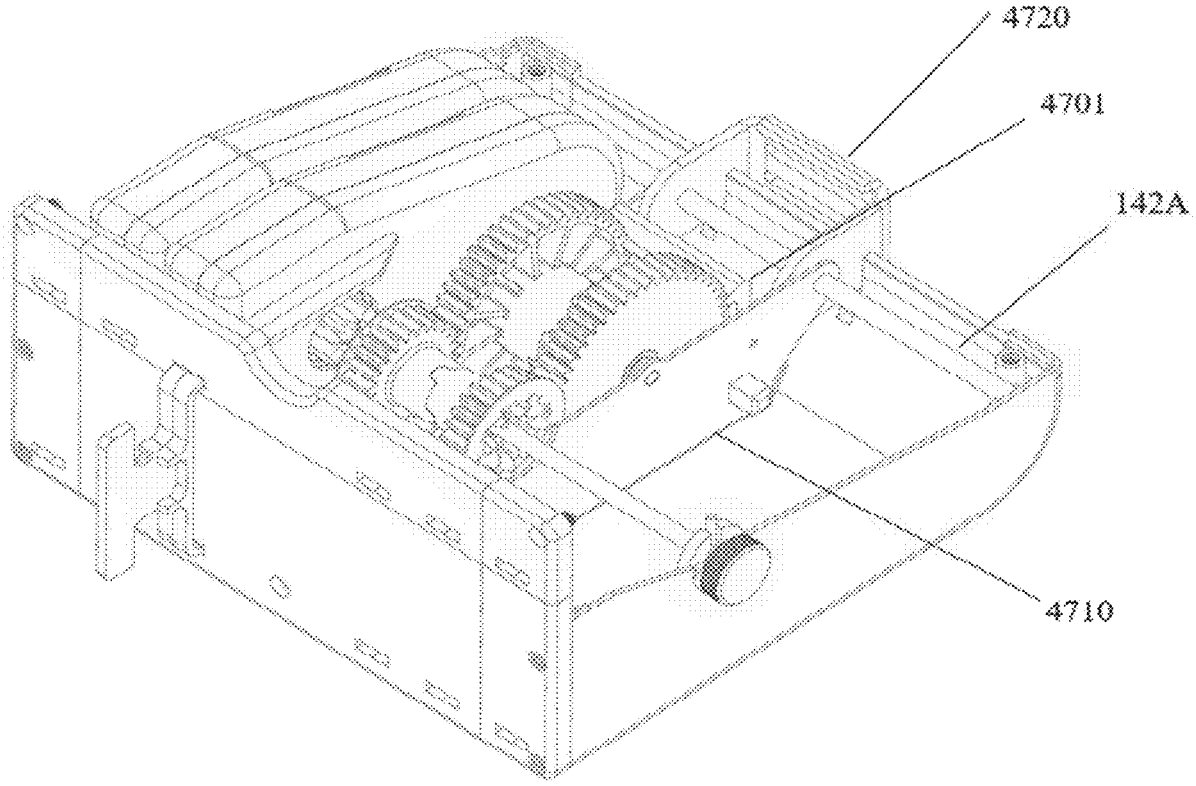
FIG. 44C illustrates another perspective view of an example cable retractor device showing an alternative wedge and a gear housing with rods extending through the internal gear housing, according to some embodiments.
Figure 44D:
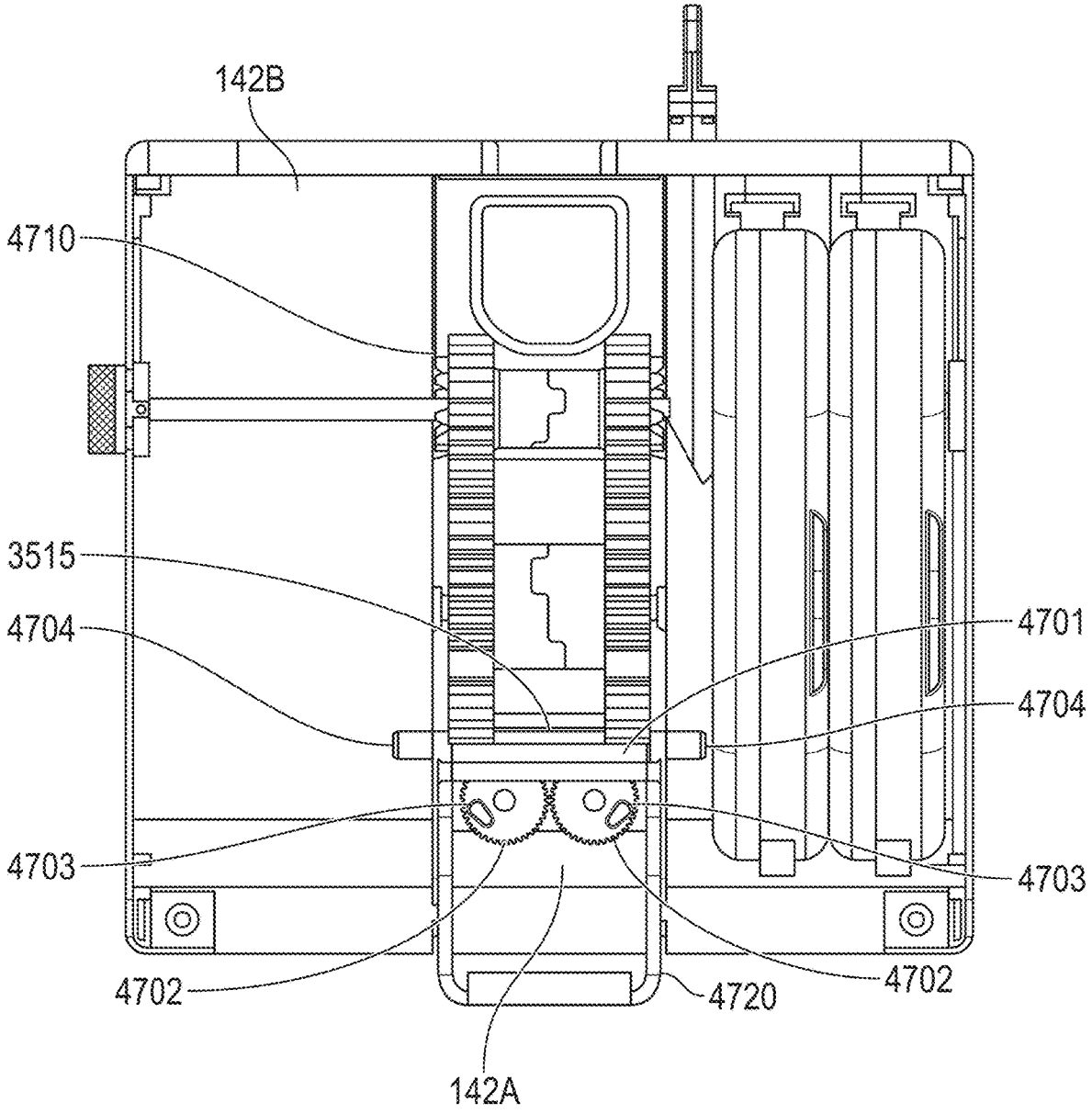
FIG. 44D illustrates a top view of an example cable retractor device showing an alternative wedge with gears for disengaging and an internal gear housing with rods extending through the internal gear housing, according to some embodiments.
Figure 44E:
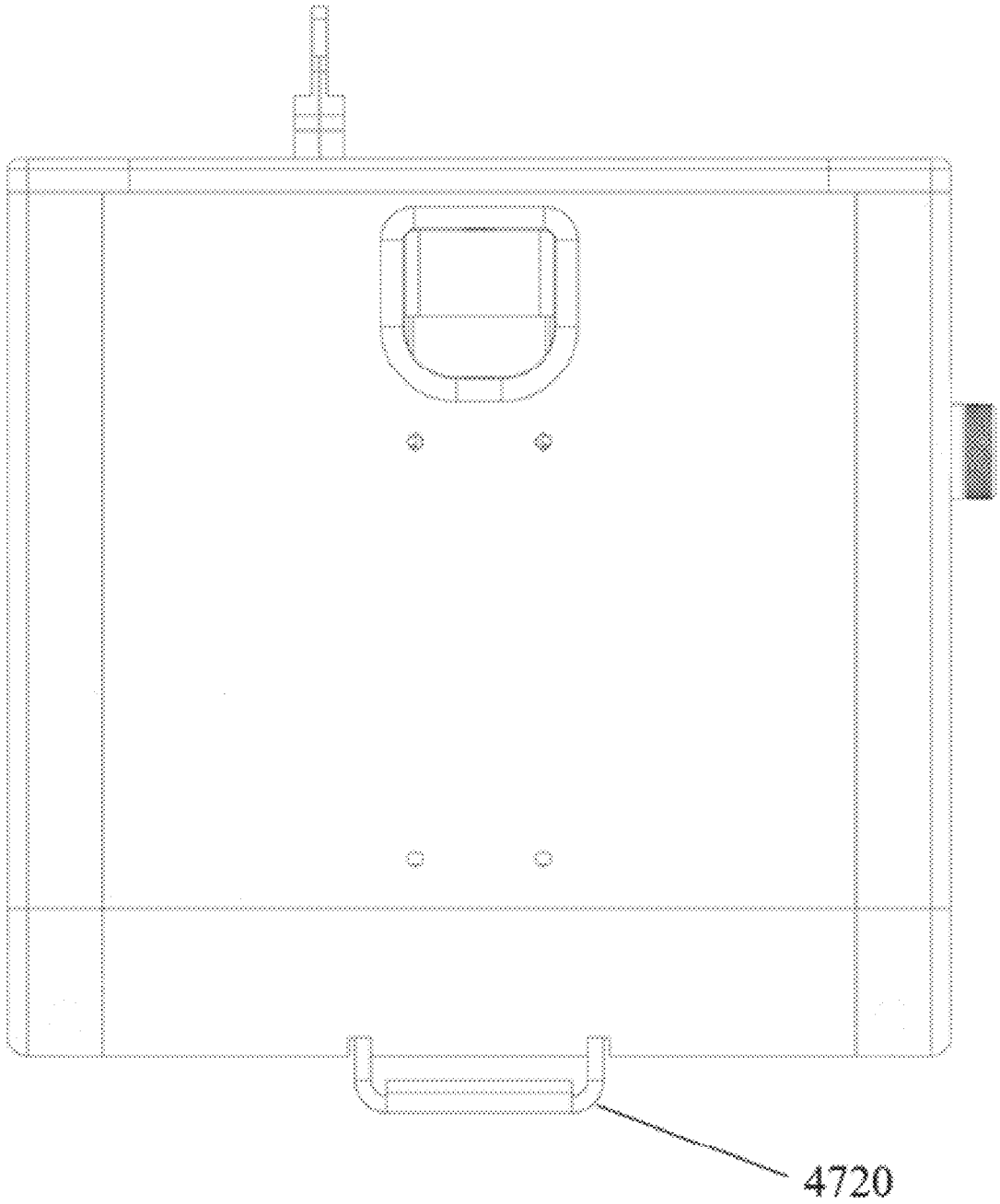
FIG. 44E illustrates a bottom view of an example cable retractor device showing an alternative means for mounting a portable belt, according to some embodiments.
Figure 44F:
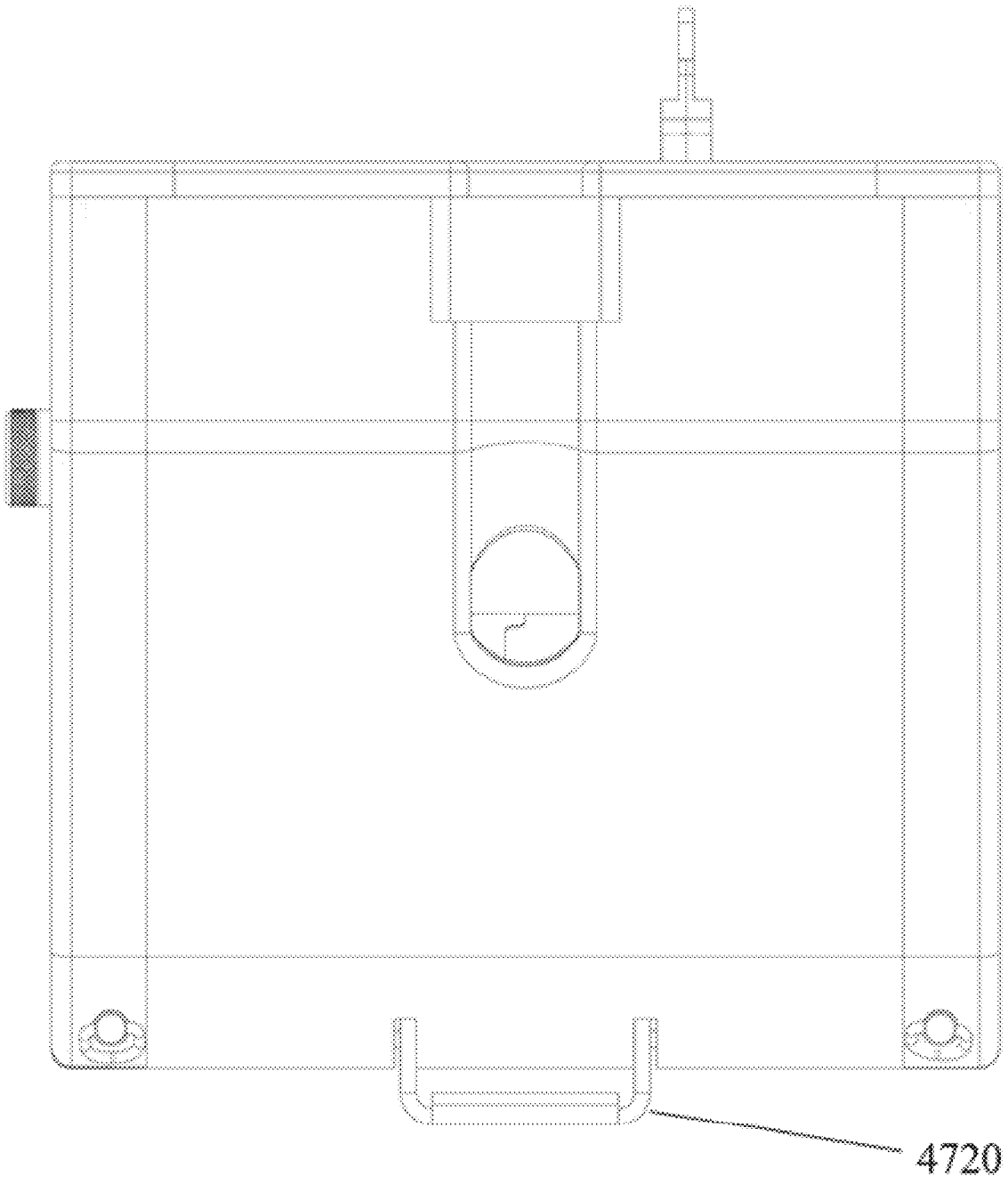
FIG. 44F illustrates a top view of an example cable retractor device showing an alternative means for mounting a portable belt, according to some embodiments.

FIGS. 43A and 43B illustrate an example locking system 3504 in an unlocked state and in a locked state, respectively. FIG. 43A illustrates an example locking system 3504 in an unlocked state. In the depicted embodiment, resistance modules 3502*a*, 3502*b*, and 3502*c* are engaged to gear system 3503. Resistance modules 3502*b* and 3502*c* can push one or more side sliders 3518 towards a center of a cable retractor device such that one or more side sliders 3518 engage one or more wedged areas of wedge 3514. In the depicted embodiment, as side sliders 3518 slide laterally inwards, wedge 3514 can be pushed upwards and away from anchoring screw 3520 and extending spring 3516 such that wedge ends 3515 do not contact driving gears 3528. FIG. 43B illustrates an example locking system 3504 in a locked state. In the depicted embodiment, no resistance modules are engaged to gear system 3503, so no lateral force is exerted on side sliders 3518. Spring 3516 can pull wedge 3514 towards anchoring screw 3520 such that one or more wedge ends 3515 come into contact with one or more driving gears 3528.

FIGS. 44A-D illustrate a second example locking mechanism with the wedge 3515 at a first end of an arm 4701. In the illustrations, the wedge 3515 engages with the driving gear (or second gear) 3528, but in an alternative embodiment, the wedge may engage with the driven gear (or first gear). The wedge 3515 may be disengaged by rotation of one or more gears 4702, such as two, with stubs 4703 that press against a second end of the arm 4701 causing the arm 4701 to rotate, pulling wedge 3515 away from the gear system. Nobs 4704 perform a similar role as sliders 3518 in allowing the mating of the resistance modules on either side to disengage the wedge. When mated with the driven gear, the resistance module presses against nob 4704, which through a rack and pinion system, rotates the one or more gears 4702 causing stubs 4703 to press against the arm 4701, disengaging the wedge 3515.

Figure 45A:
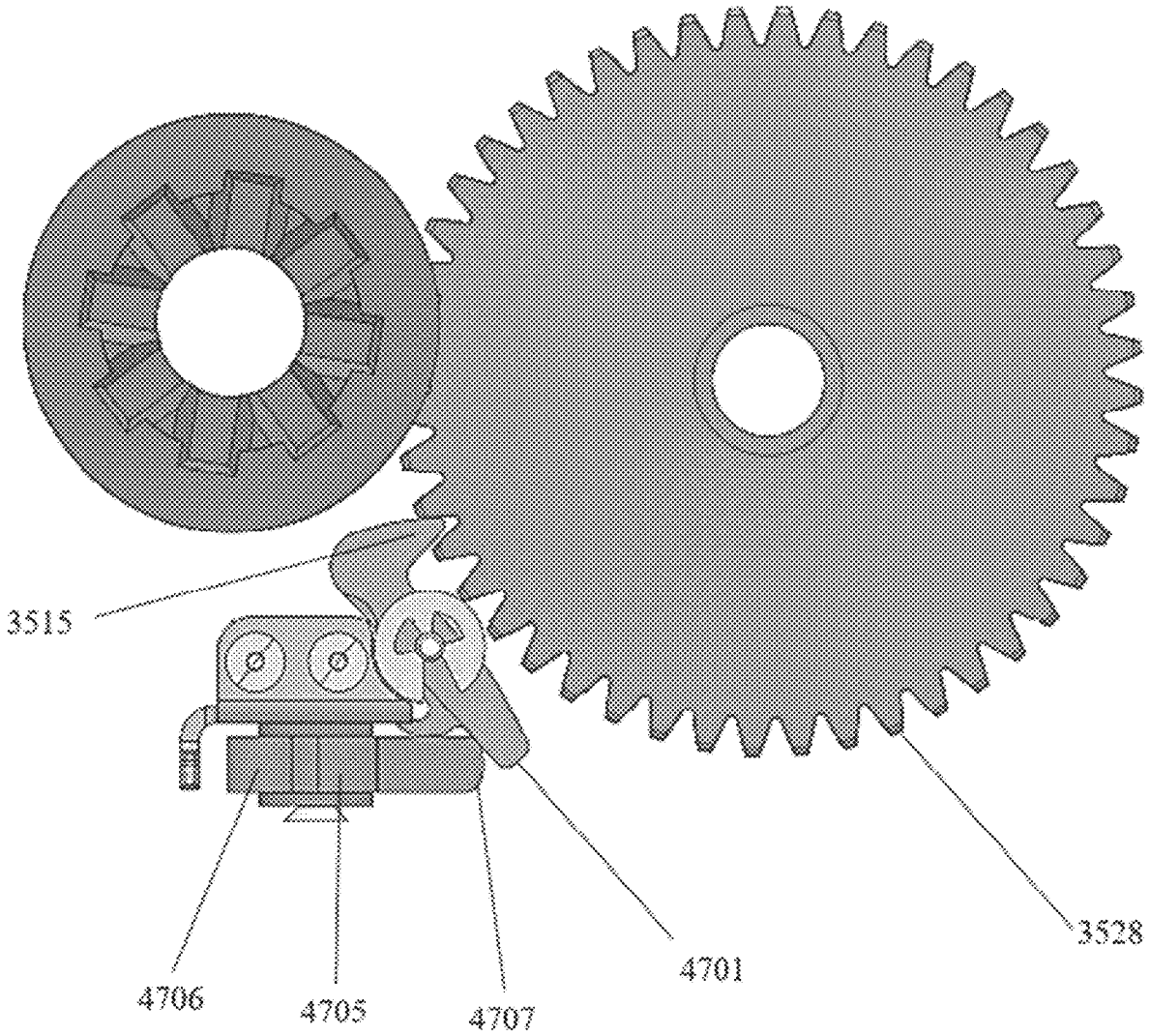
FIGS. 45A and 45B illustrate side and perspective views, respectively, of a second alternative wedge and a gear housing, according to some embodiments.
Figure 45B:
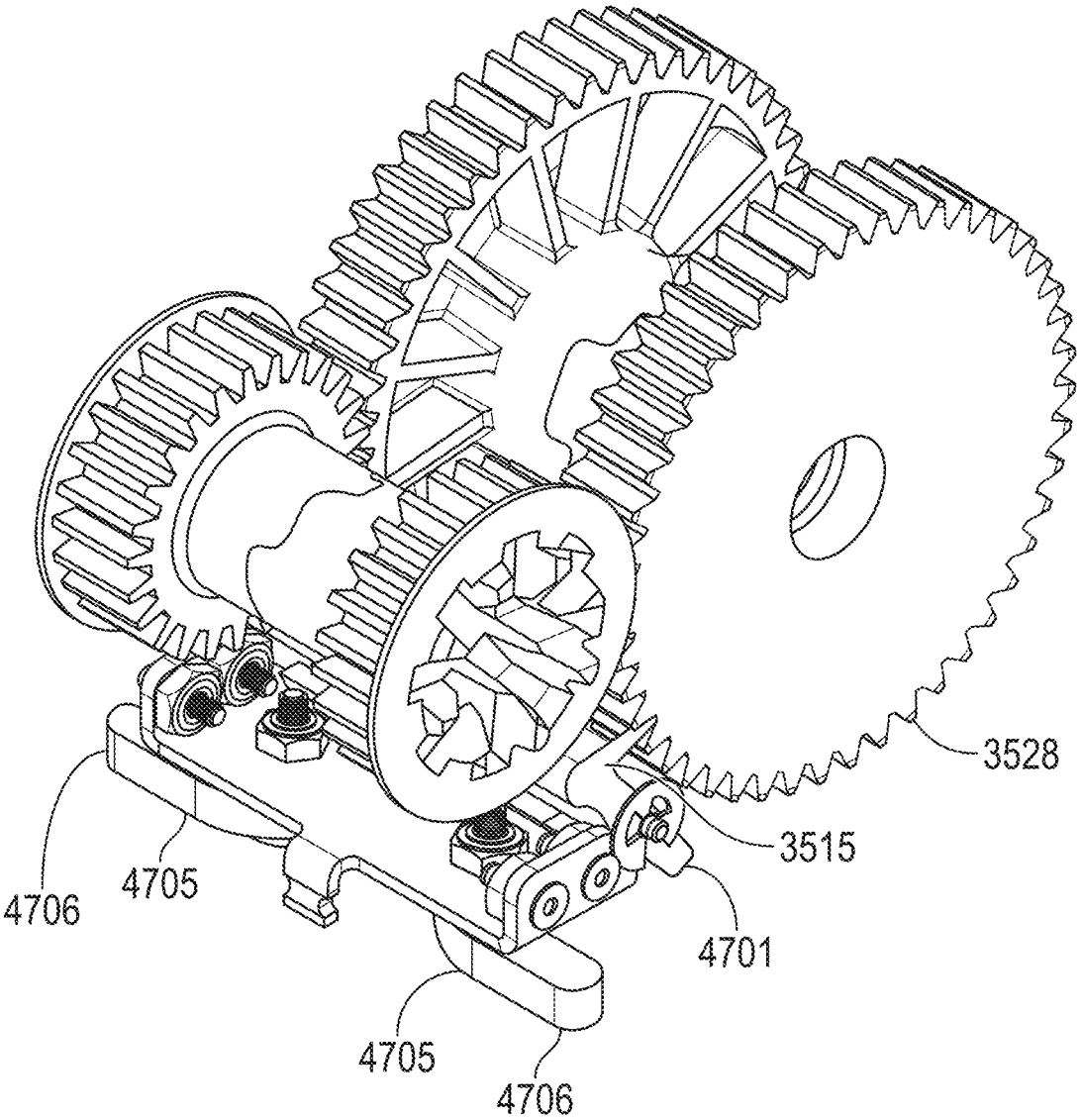

FIGS. 45A and 45B illustrate a third example locking mechanism with the wedge 3515 at a first end of an arm 4701. In the illustrations, the wedge 3515 engages with the driving gear (or second gear) 3528, but in an alternative embodiment, the wedge may engage with the driven gear (or first gear). The wedge 3515 may be disengaged by rotation of one or more levers 4705, such as two, that press against a second end of the arm 4701, causing the arm 4701 to rotate pulling wedge 3515 away from the gear system. Levers 4705 perform a similar role as sliders 3518 in allowing the mating of the resistance modules on either side to disengage the wedge. In embodiments with two levers 4705, the two levers 4705 are coupled so that mating of a resistance module to the driven gear on one side rotates both levers 4705 so that the levers 4705 act together in rotating arm 4701. When mated with the driven gear, the resistance module presses against a first end 4706 of lever 4705, which rotates the lever 4705 causing a second end 4707 of lever 4705 to press against the second end of arm 4701, disengaging the wedge 3515.

Figure 46A:
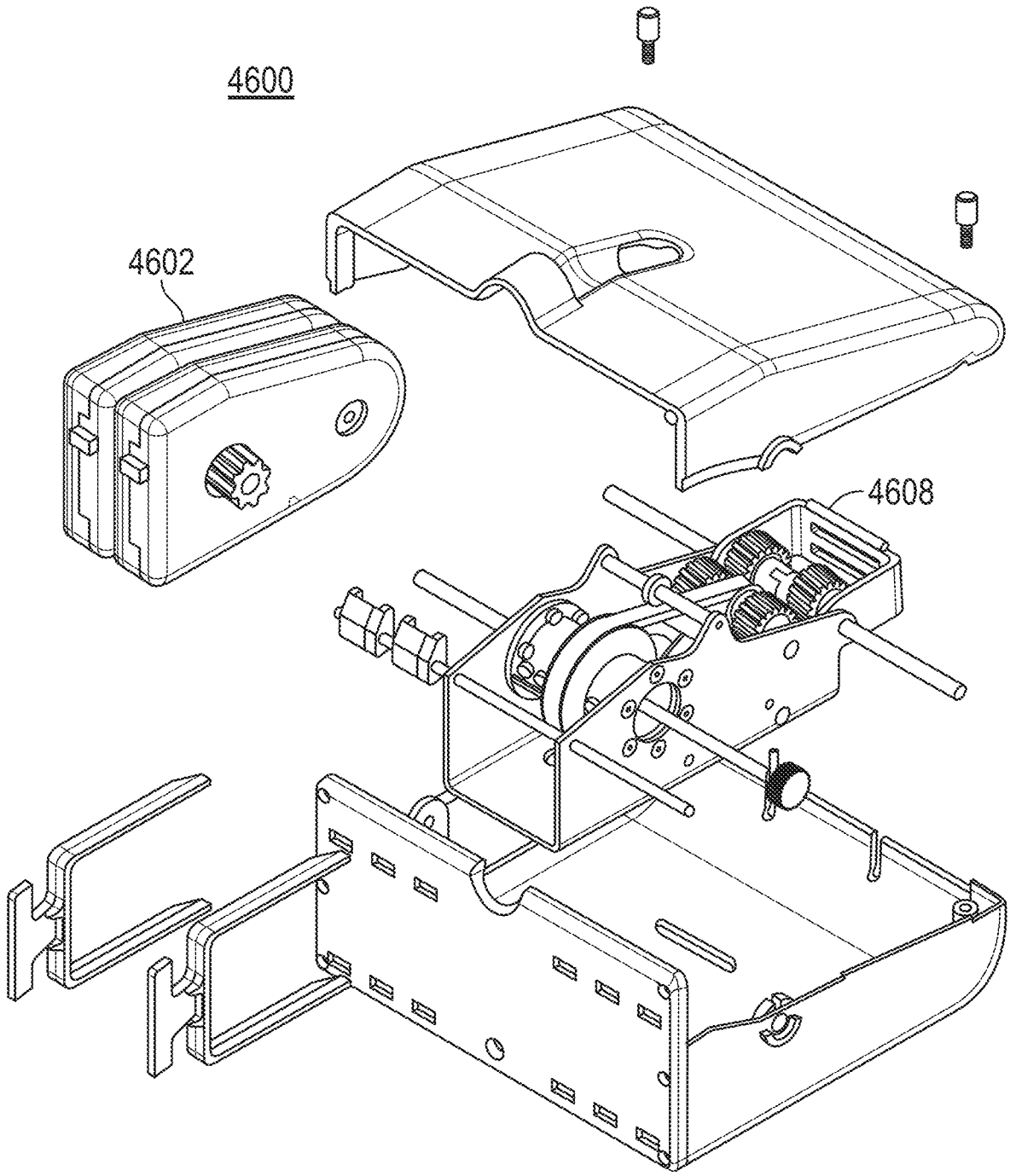
FIGS. 46A and 46B illustrate perspective and top views, respectively, of a cable retractor device having continuously-variable resistance, according to some embodiments.
Figure 46B:
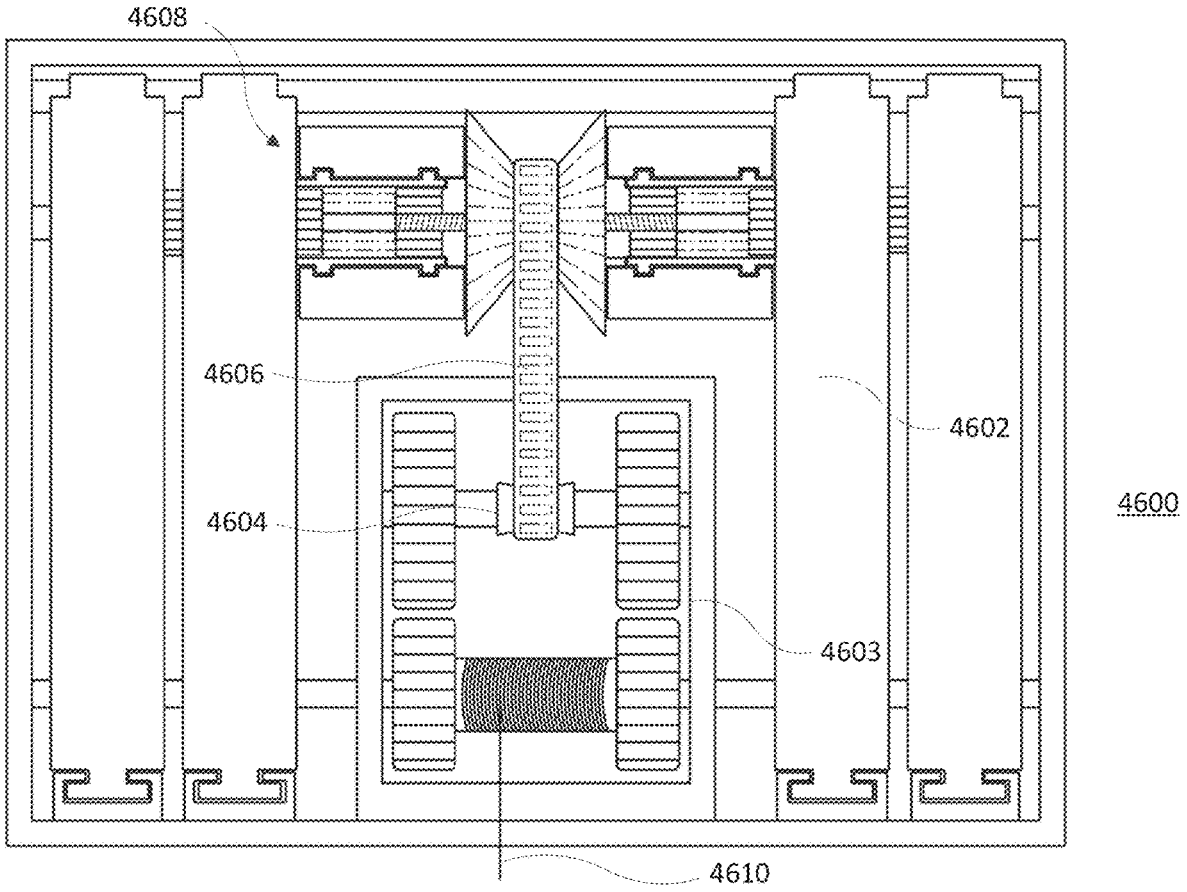

In some embodiments, the cable retractor device may provide a continuously-variable resistance. FIGS. 46A and 46B illustrate perspective and top views, respectively, of a cable retractor device 4600 for providing a continuously-variable resistance. It can be desirable to use a continuously-variable gear system to enable a cable retractor device to provide decreasing force at greater extensions. Conventional exercise devices (e.g., elastic bands or weights) may be unable to provide decreasing force as a user extends the muscles further. Elastic bands, for example, may only provide increasing force as a user extends the muscles due to spring forces increasing proportionally to extension distance. It can be desirable for an exercise device to provide decreasing force at greater extensions because injuries can often occur at longer muscle extensions. A muscle may be at its weakest state when it is fully extended, but an elastic band may be exerting its maximum force at that time. This can lead to muscle tearing and/or other injuries as a result of exercise. Furthermore, this can lead to compensatory patterns where the body may be forced to engage muscles not unintended to exercise, potentially leading to postural issues. A continuously-variable gear system (e.g., continuously-variable gear system 4608) may allow a cable retractor device to decrease the force exerted on a user's muscles as the cable (and accordingly, the user's muscles) extend further. The continuously-variable gear system may advantageously promote proper form and/or posture by encouraging proper mechanical form with respect to gravity. Without proper posture and/or form, unnecessary muscle engagement may result in pain and injury.

In some embodiments, cable retractor device 4600 can correspond to cable retractor device 3400. Cable retractor device 4600 can include one or more resistance modules 4602, which can correspond to resistance modules 150, 2708, 2740, 3200, 3310, and/or 3502. In some embodiments, cable retractor device 4600 can include a gear system 4603, which can correspond to gear system 3503. In some embodiments, a driving gear 4607 of gear system 4603 (e.g., a gear configured to engage a cable spool) may have a larger diameter than a driven gear 4609 of gear system 4603 (e.g., a gear configured to engage sleeve 4604). In some embodiments, a driving gear of gear system 4603 may have a smaller diameter than a driven gear of gear system 4603. In some embodiments, continuously-variable gear system 4608 can include a belt 4606. In some embodiments, belt 4606 can be a grooved belt and/or be configured to mate with gear teeth. In some embodiments, belt 4606 can drive and/or be driven by sleeve 4604, which can drive and/or be driven by gear system 4603. For example, sleeve 4604 may be attached to an axle of gear system 4603 such that when sleeve 4604 rotates, the axle also rotates at the same rotational velocity. In some embodiments, sleeve 4604 can be a gear configured to mate with belt 4606. In some embodiments, sleeve 4604 can be a continuously-variable gear configured to mate with belt 4606. In some embodiments, applying a force on cable 4610 can engage gear system 4603, which can engage belt 4606, which can engage continuously-variable gear system 4608, which can engage one or more resistance modules 4602.

Figure 47A:
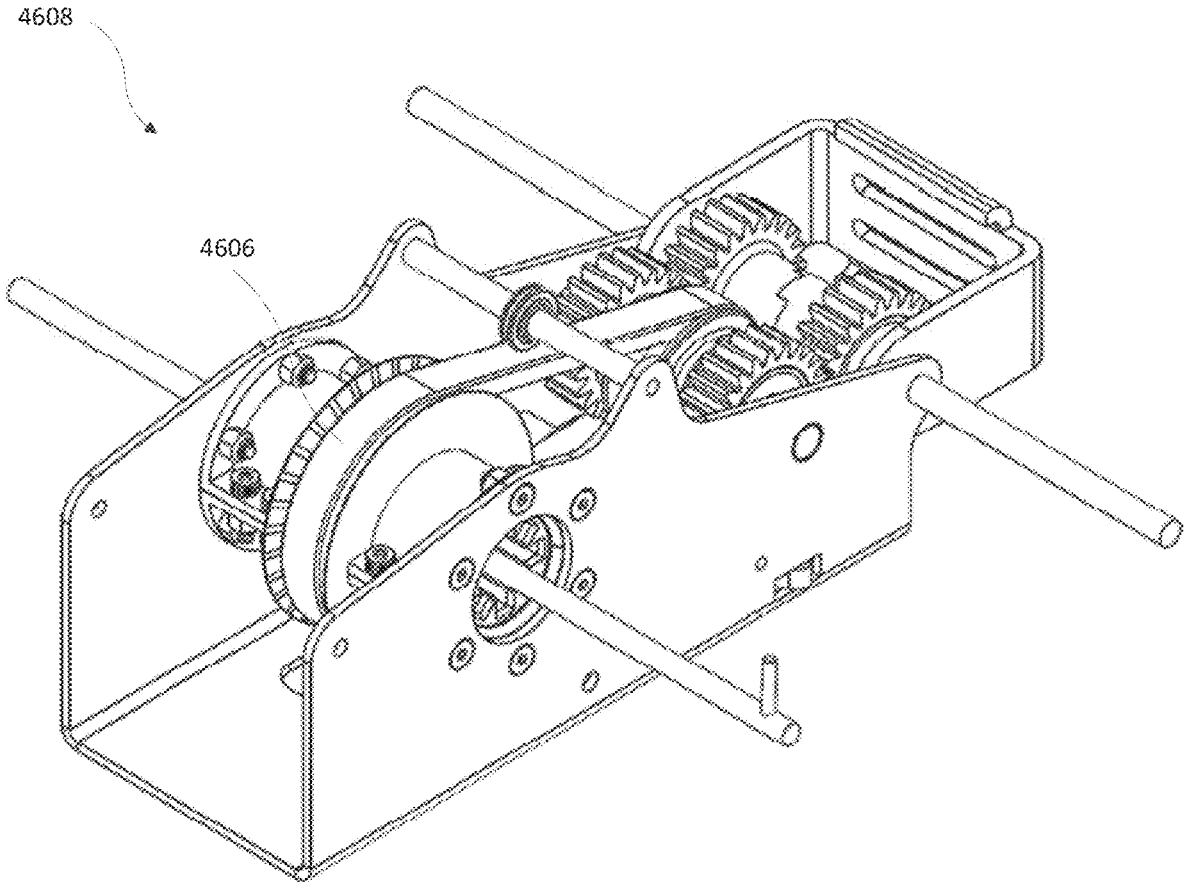
FIGS. 47A-47C illustrate perspective and cross-sectional views, respectively, of an example continuously-variable gear system, according to some embodiments.
Figure 47B:
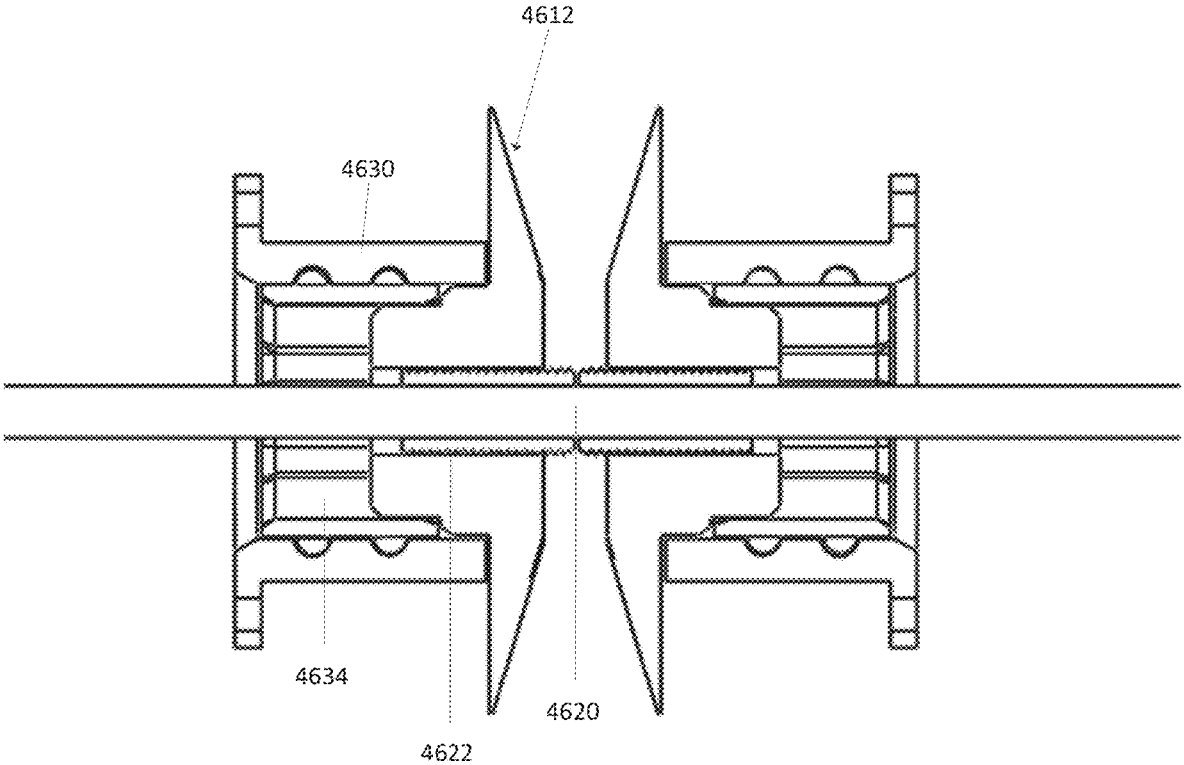

FIGS. 47A and 47B illustrate perspective and cross-sectional views, respectively, of an example continuously-variable gear system 4608. In some embodiments, continuously-variable gear system 4608 can include primary axle 4620, which may function as an anchor and/or rotation axis for components of cable retractor device 4600 (e.g., resistance module 4602 and continuously-variable gear system 4608). In some embodiments, resistance module 4602 may be anchored in place at least in part by primary axle 4620. In some embodiments, resistance module 4602 may include interlocking gear 4634 (which can correspond to interlocking gear 154C), which may rotate along primary axle 4620.

Figure 47C:
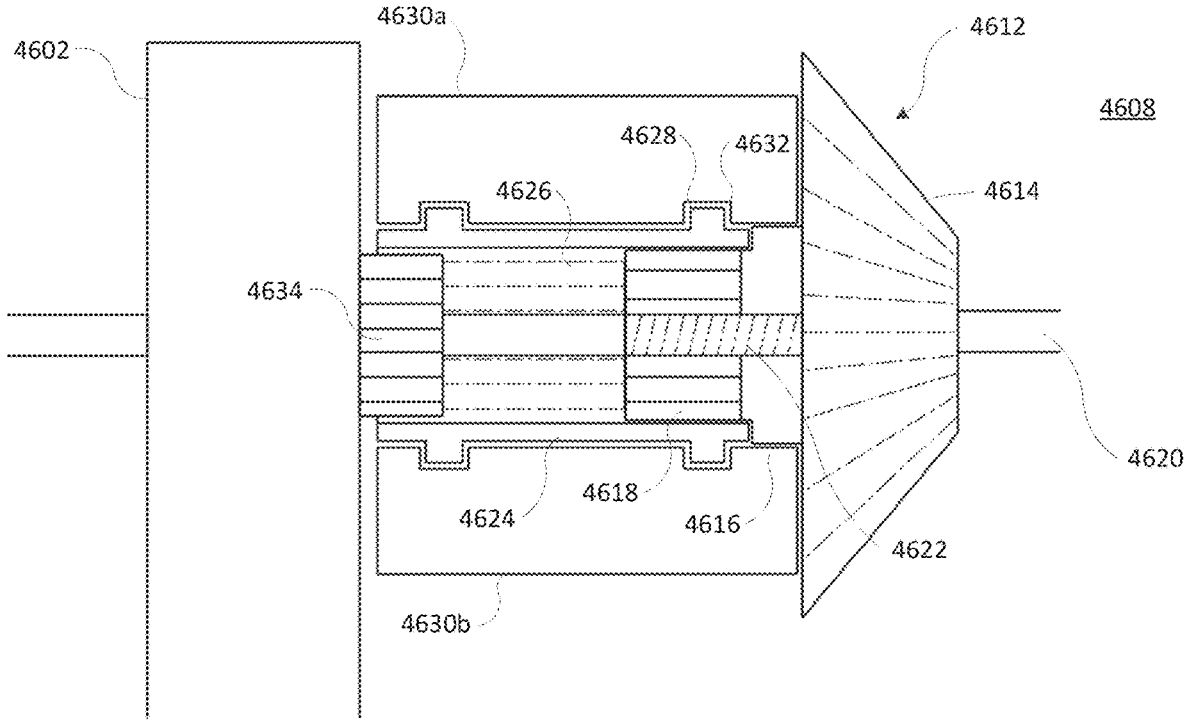

FIG. 47C illustrates a portion of an example continuously-variable gear system 4608. Continuously-variable gear system 4608 can include continuously-variable gear 4612. In some embodiments, continuously-variable gear 4612 may have a conical portion 4614, which may have a continuously-variable diameter. For example, conical portion 4614 of continuously-variable gear 4612 can have a conical frustum shape. In some embodiments, continuously-variable gear 4612 can be configured to mate with belt 4606 (e.g., continuously-variable gear 4612 can be used to drive and/or be driven by belt 4606). For example, continuously-variable gear 4612 can include grooves (e.g., gear teeth), which may mate with corresponding grooves on belt 4606. In some embodiments, a fixed number of grooves may extend along the length of continuously-variable gear 4612 such that the grooves have a larger spacing between grooves at a first end of continuously-variable gear 4612 and a smaller spacing between grooves at a second end of continuously-variable gear 4612. A continuously-variable diameter and corresponding continuously-variable groove spacing can allow continuously-variable gear 4612 to deliver increasing/decreasing amounts of torque, depending on the diameter being used to drive and/or be driven by belt 4606. In some embodiments, conical portion 4614 can include a hole configured to receive primary axle 4620. In some embodiments, the hole can be approximately in the center of conical portion 4614, and continuously-variable gear 4612 can be configured to rotate about primary axle 4620. The diameter of the continuously-variable gear 4612 may readily be determined by the desired reduction ratio to be achieved. In some embodiments, the core diameter of the driven gear is approximately 0.70 inches, and the range for the conical portion 4614 is between 1.40 inches and 2.1 inches, which provides a range of speed ratios between 2:1 to 3:1.

In some embodiments, continuously-variable gear 4612 can include a cylindrical portion 4616. In some embodiments, cylindrical portion 4616 can be mated to conical portion 4614 (e.g., cylindrical portion 4616 can be glued, welded, and/or screwed to cylindrical portion 4616). In some embodiments, cylindrical portion 4616 and conical portion 4614 can form a single piece, which may be formed by machining or injection molding. In some embodiments, cylindrical portion 4616 can be configured to mate with grooved sleeve 4624. Sleeve 4624 may transmit torque between resistance module 4602 and continuously-variable gear 4612. For example, unspooling cable 4610 may engage gear system 4603, which may engage sleeve 4604, which may engage belt 4606, which may engage continuously-variable gear 4612, which may engage sleeve 4624, which may engage interlocking gear 4634, which may engage resistance module 4602. In some embodiments, sleeve 4624 can be hollow and have grooves 4626 along an interior surface of sleeve 4624. In some embodiments, grooves 4626 may be spaced to engage grooved portion 4618 of cylindrical portion 4616. In some embodiments, grooves 4626 may be spaced to engage interlocking gear 4634 (e.g., via grooves on interlocking gear 4634). In some embodiments, interlocking gear 4634 may have the same groove spacing as grooved portion 4618. In some embodiments, interlocking gear 4634 may have a multiple (e.g., 0.5, 2, 3) of the groove spacing in grooved portion 4618.

In some embodiments, primary axle 4620 can have a grooved portion 4622. In some embodiments, grooved portion 4622 can be threaded and can be configured to mate with a grooved hole extending through continuously-variable gear 4612. In some embodiments, as continuously-variable gear 4612 rotates (e.g., as a result of belt 4606 spinning), continuously-variable gear 4612 may slide along primary axle 4620 such that continuously-variable gear 4612 begins to extend out from sleeve 4624. Continuously-variable gear 4612 extending out from sleeve 4624 may cause conical portion 4614 to stretch belt 4606 due to it contacting the larger diameter part of the conical portion 4614, which may correspondingly alter the torque required to drive and/or be driven by belt 4606. In some embodiments, continuously-variable gear 4612 may continue to engage sleeve 4624 through grooved portion 4618 as it extends beyond sleeve 4624. This may allow continuously-variable gear 4612 to continue driving and/or be driven by interlocking gear 4634 via sleeve 4624. In some embodiments, primary axle 4620 may be rotationally fixed to allow continuously-variable gear 4612 to traverse along primary axle 4620.

In some embodiments, rotating the continuously-variable gear 4612 in a first angular direction (clockwise or counter-clockwise direction) about a rotational axis (e.g., an axis of the axle 4620) causes the continuously-variable resistance to decrease, and rotating the continuously-variable gear 4612 in a second angular direction (in a reverse angular direction to the first angular direction) about the rotational axis causes the continuously-variable resistance to increase. For example, as the continuously-variable gear 4612 is rotating in the first angular direction (e.g., caused by the belt 4606 spinning and engaging the continuously-variable gear), due to the conical portion of the gear, diameters associated with points of contact between the belt and the conical portion are decreasing, causing the associated force provided by the device to decrease (as a function of a force provided by resistance modules coupled to the gear). Conversely, as the continuously-variable gear 4612 is rotating in the second angular direction (e.g., caused by the belt 4606 spinning and engaging the continuously-variable gear), due to the conical portion of the gear, diameters associated with points of contact between the belt and the conical portion are increasing, causing the associated force provided by the device to increase (as a function of a force provided by resistance modules coupled to the gear).

In some embodiments, the rate of varying force is based on an angle of the conical portion 4614, a rate of rotation of the continuously-variable gear 4612, or both. For example, if an angle of the conical portion 4614 is greater (relative to axle 4620), then the rate of varying force is greater because the greater angle causes the diameter of conical portion to vary more quickly. As another example, if the rate of rotation of the continuously-variable gear 4612 is greater, then the rate of varying force is greater because the faster rotation causes the diameter of conical portion to vary more quickly. Accordingly, in some embodiments, the angle of the conical portion 4614 and/or rotation speed of continuously-variable gear 4612 may be configured to achieve a desired rate of force variance.

In some embodiments, rotating the first continuously-variable gear in the first angular direction causes the continuously-variable gear to move away from the second continuously-variable gear along the axis of rotation, and rotating the first continuously-variable gear in the second angular direction causes the continuously-variable gear to move toward the second continuously-variable gear along the axis of rotation. For example, the axle 4620 is threaded and mated with the grooved portion of the continuously-variable gear 4612. The thread of the axle 4620 and the grooved portion are patterned such that when the continuously-variable gear 4612 is rotating, the gear moves along the axle 4620 (e.g., away from the center when rotating in the first angular direction, toward the center when rotating in the second angular direction). The device may comprise a second continuously-variable gear and a second axle symmetrically located about a center of the device, and the thread of the second axle is reversely-threaded, such that such that when the second continuously-variable gear is rotating, the second gear moves along the second axle away from the first gear when rotating in the first angular direction and toward the first gear when rotating in the second angular direction.

In some embodiments, sleeve 4624 may be held in place by blocks 4630*a* and 4630*b*. In some embodiments, blocks 4630*a* and 4630*b* can be two separate pieces. In some embodiments, blocks 4630*a* and 4630*b* can form a single piece with a hollow region configured to receive sleeve 4624. In some embodiments, sleeve 4624 can have one or more raised lips 4628, which may be configured to mate with one or more grooves 4632. In some embodiments, sleeve 4624 can have one or more bearings, which may allow sleeve 4624 to rotate while fixed between blocks 4630*a* and 4630*b*.

Figure 48A:
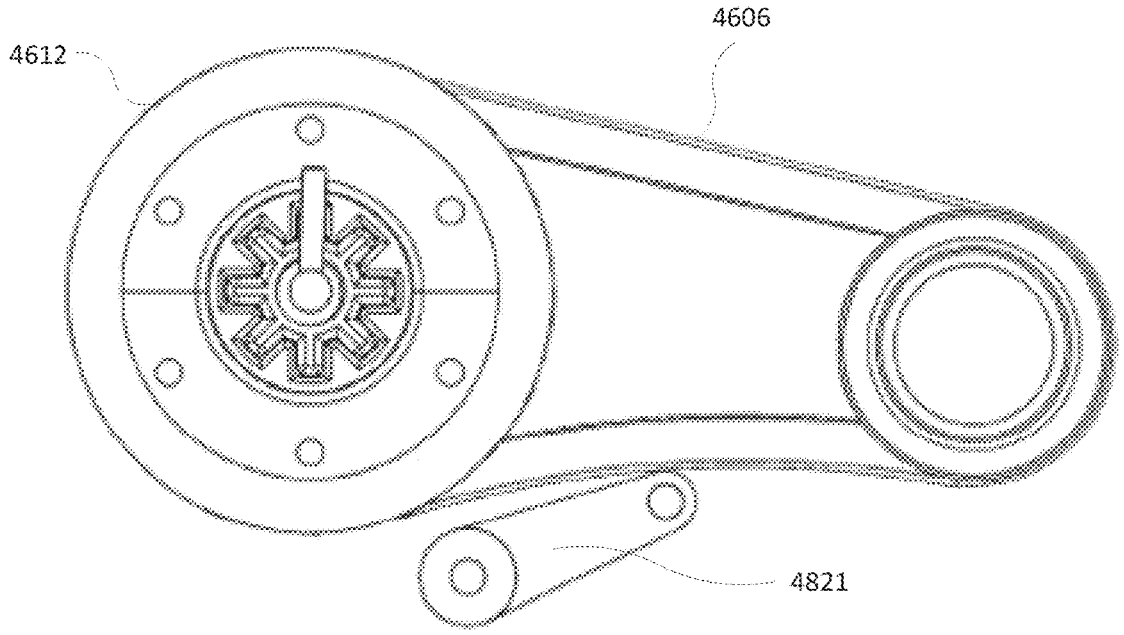
FIGS. 48A and 48B illustrate cross-sectional views of a tensioner, belt, and continuously-variable gear, according to some embodiments.
Figure 48B:
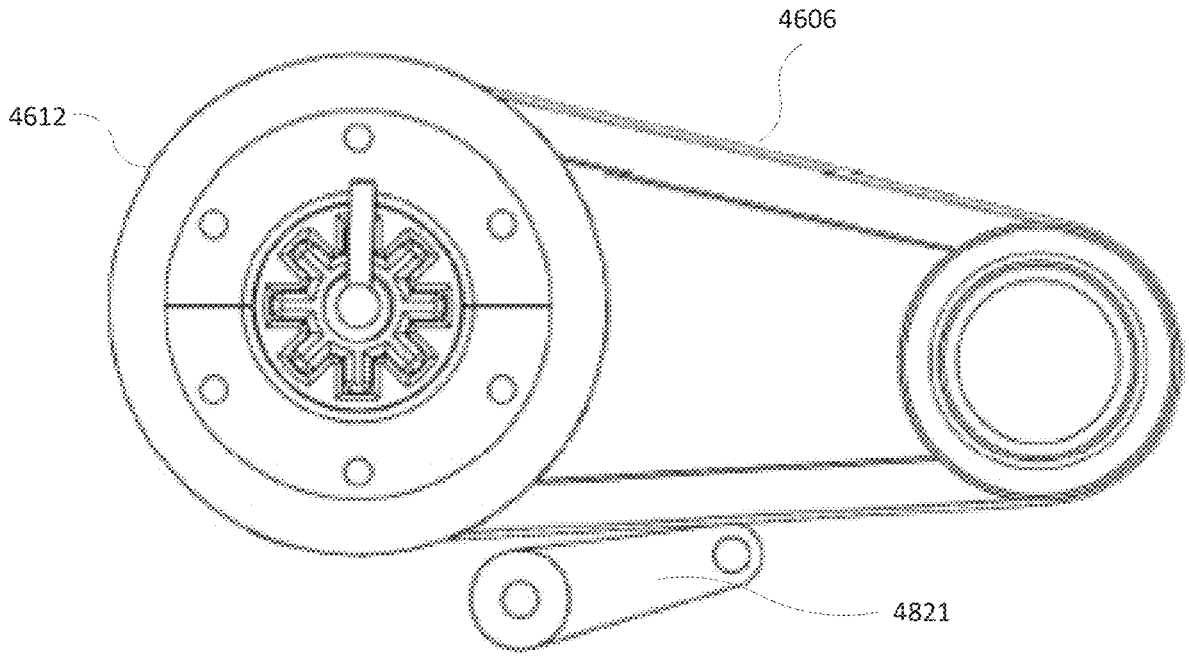

In some embodiments, the continuously-variable gear system 4608 may comprise a tensioner that compensates for slack in the belt 4606 when the conical portions 4614 are separated (e.g., a certain distance apart). FIGS. 48A and 48B illustrate cross-sectional views of a tensioner 4821, belt 4606, and continuously-variable gear 4612. When applied, the tensioner 4821 may cause the belt 4606 to tighten, reducing the amount of slack in the belt 4606, as shown in FIG. 48A. The tensioner 4821 may be released, as shown in FIG. 48B, when, e.g., the conical portions 4614 are in close proximity to one another.

Figure 49A:
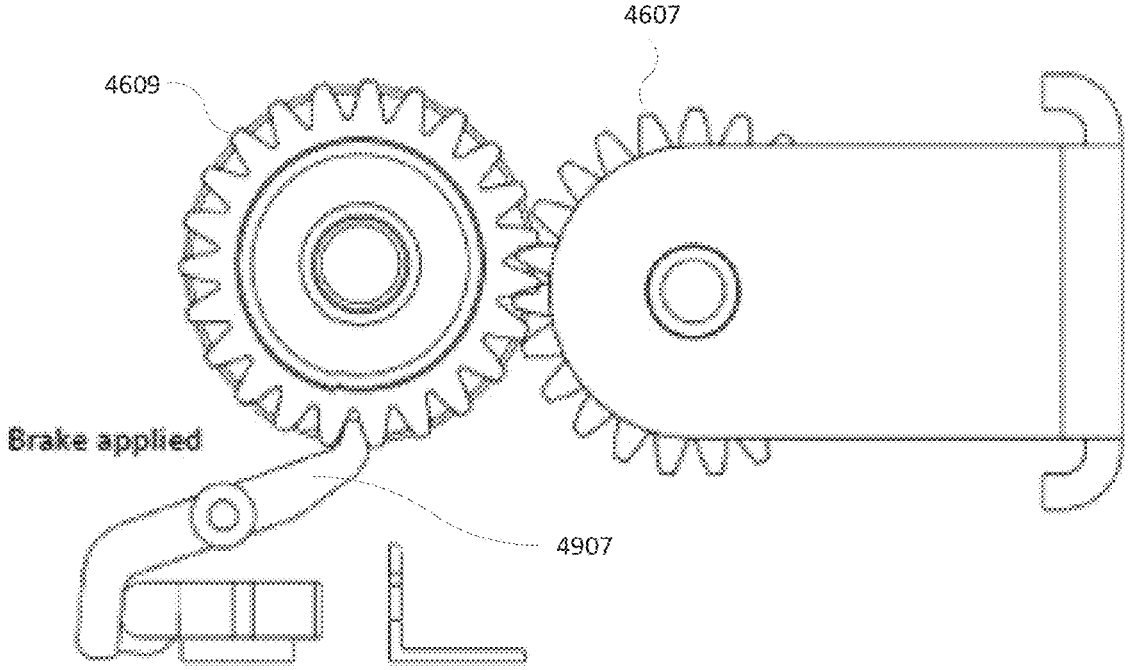
FIGS. 49A and 49B illustrate cross-sectional views of the gear system 4603 having a gear brake 4907, according to some embodiments.
Figure 49B:
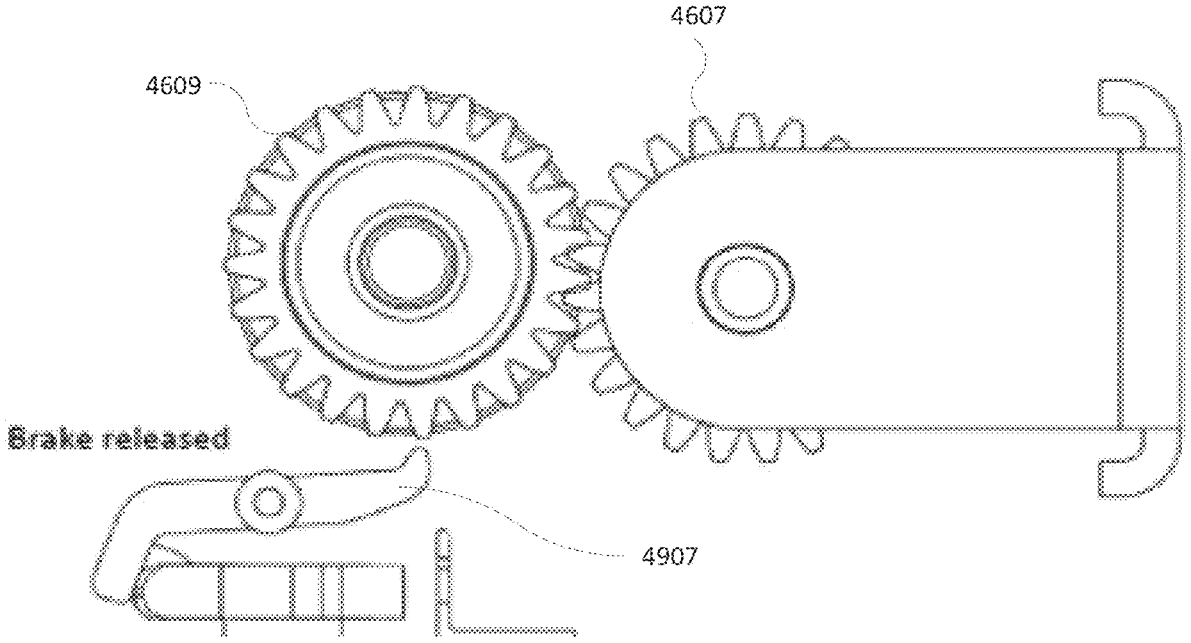

In some embodiments, the gear system 4603 may comprise a gear brake to prevent the gears from moving. FIGS. 49A and 49B illustrate cross-sectional views of the gear system 4603 having a gear brake 4907. When the gear brake 4907 is applied, the driving and driven gears 4607 and 4609, respectively, may not be able to move, setting the resistance of the continuously-variable gear system 4608. In some embodiments, the gear brake 4907 may comprise a plate that is positioned within a notch of the driven gear 4609 when the gear brake 4907 is applied, as shown in FIG. 49A. The plate may be removed from the notch of the driven gear 4609 when the gear brake 4907 is released, as shown in FIG. 49B.

Embodiments of the disclosure may include a mounting mechanism for the cable retractor device 3400. The mounting mechanism may be a pole, mounting bracket, belt strap, portable belt, or the like, as described in more detail below. Although the descriptions and figures illustrate a single cable retractor device 3400 mounted to a mounting mechanism, embodiments of the disclosure may include two, three, four, or another number of cable retractor devices 3400 mounted to a mounting mechanism.

Figure 50A:
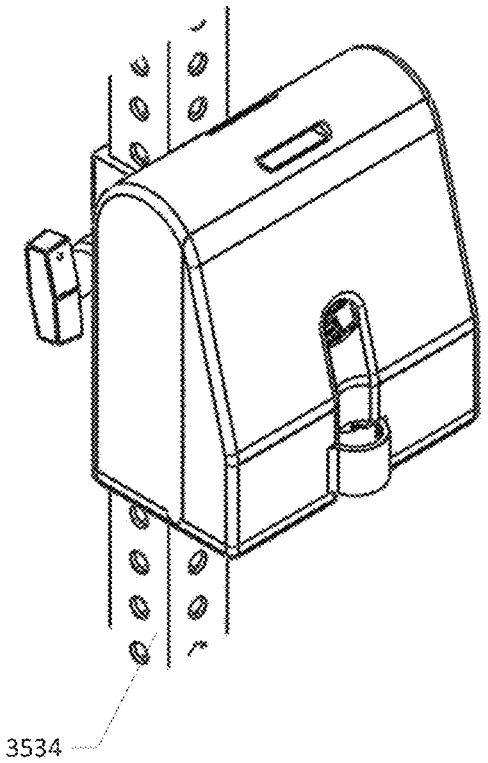
FIG. 50A illustrates a perspective view of an example cable retractor device, according to some embodiments.
Figure 50B:
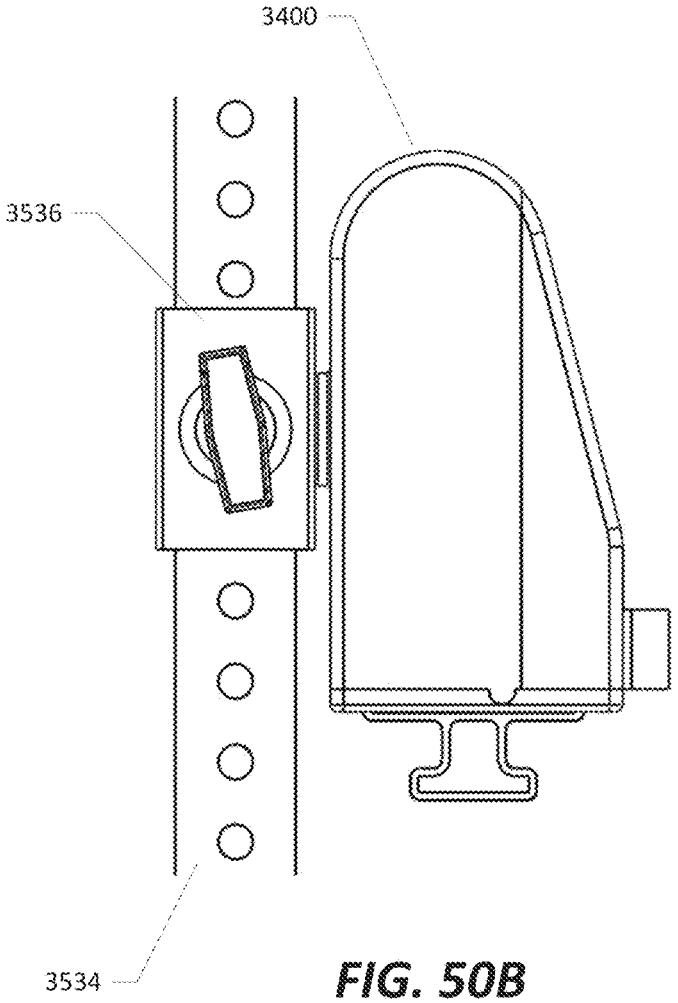
FIG. 50B illustrates a side view of an example cable retractor device, according to some embodiments.
Figure 50C:
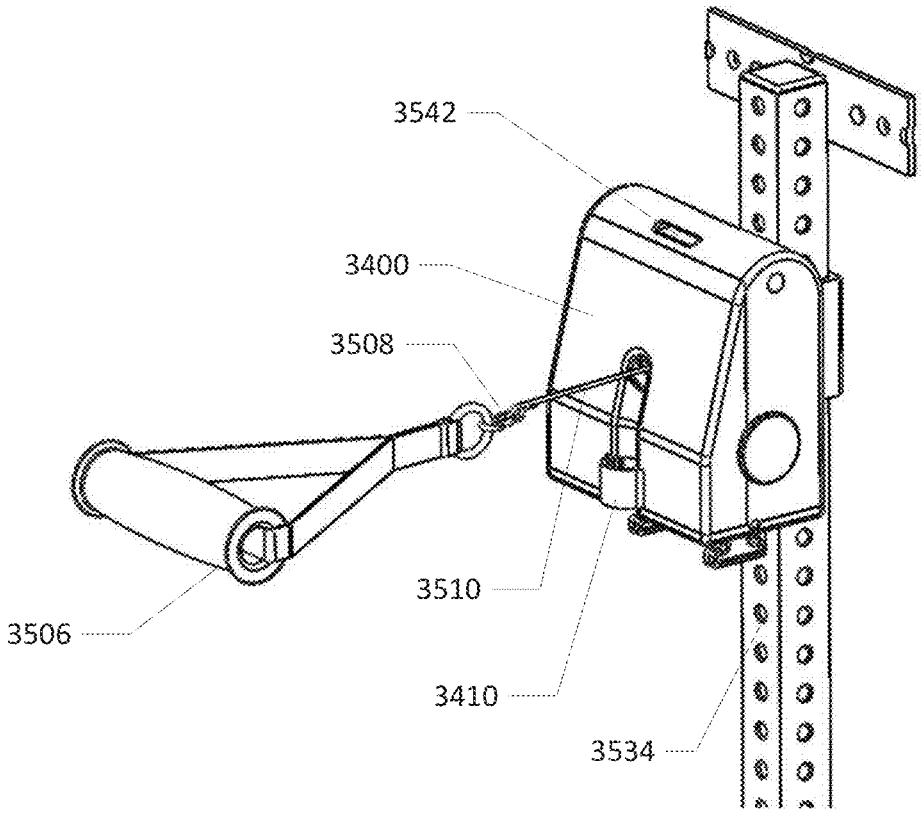
FIG. 50C illustrates a perspective view of an example cable retractor device in use, according to some embodiments.

FIGS. 50A and 50B illustrate an example mounting mechanism for cable retractor device 3400. Cable retractor device 3400 can be mounted onto a pole 3534 to anchor cable retractor device 3400 in place while a user uses the device. Cable retractor device 3400 can be attached to a mounting bracket 3536, which can slidably move along pole 3534. Mounting bracket 3536 can lock into place using any suitable means (e.g., using a screw to insert into a hole along pole 3534). FIG. 50C illustrates an example cable retractor device 3400 in use, where the cable retractor device 3400 is mounted to a pole 3534.

Figure 51A:
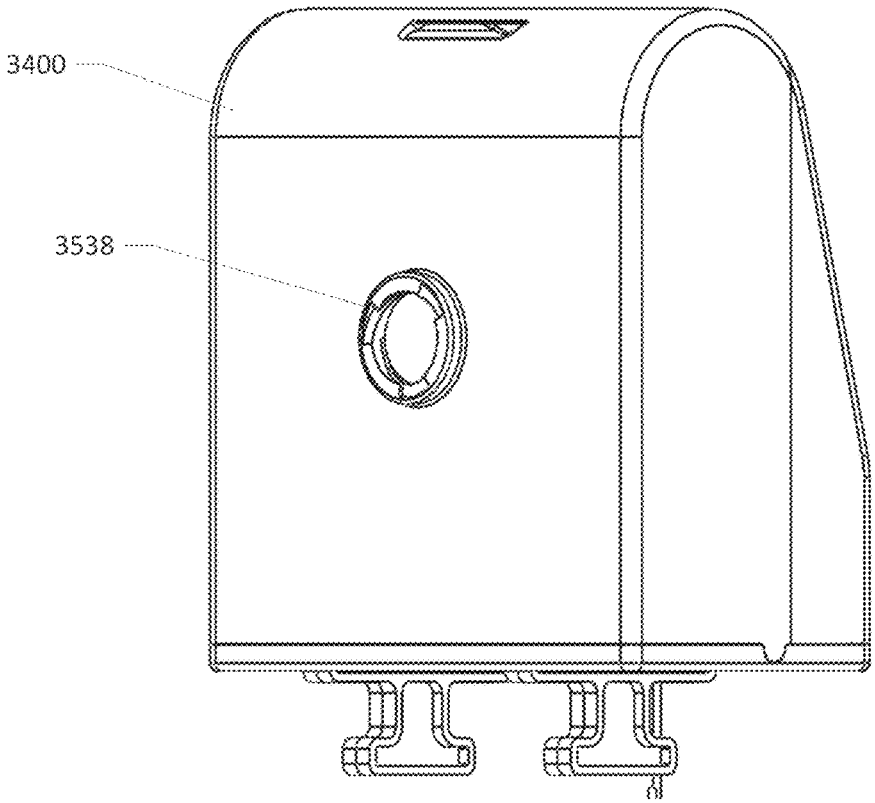
FIG. 51A illustrates another perspective view of an example cable retractor device, according to some embodiments.
Figure 51B:
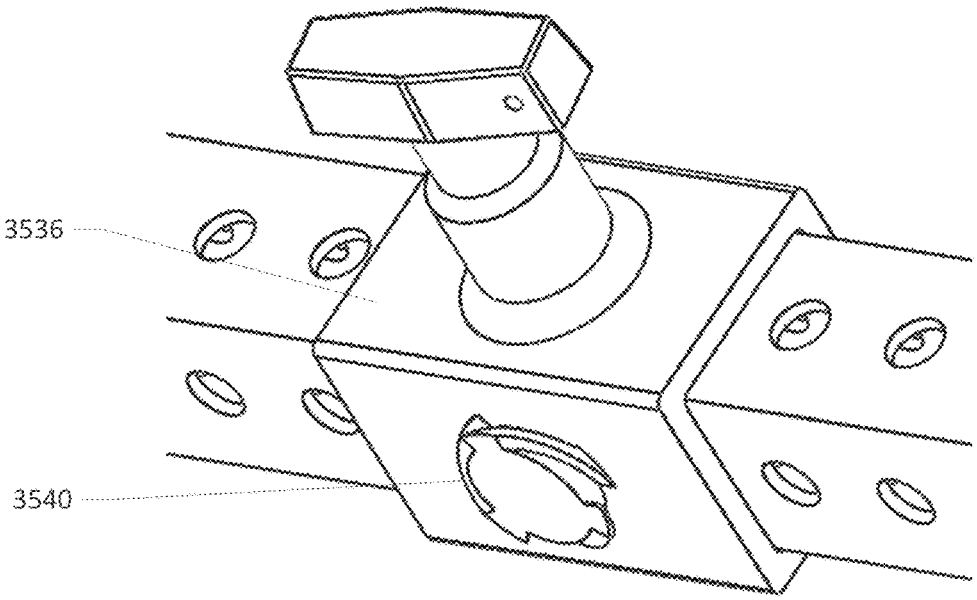
FIG. 51B illustrates a perspective view of an example mounting bracket, according to some embodiments.

FIGS. 51A and 51B illustrate an example mounting mechanism between cable retractor device 3400 and mounting bracket 3536. Cable retractor device can have a rotational mount 3538 configured to mate with a rotational mount 3540 on mounting bracket 3536. In some embodiments, rotational mount 3540 can be aligned to insert into rotational mount 3538, and then rotated 90 degrees to secure cable retractor device 3400 on mounting bracket 3536. However, other rotational angles may be used, and rotational mount 3538 can be inserted into rotational mount 3540 as well. In some embodiments, rotational mount 3538 can be located opposite of cable hole 3408 (shown in FIG. 36) such that when a user pulls on a cable protruding from cable hole 3408, little to no torque is exerted on rotational mount 3538.

Figure 52A:
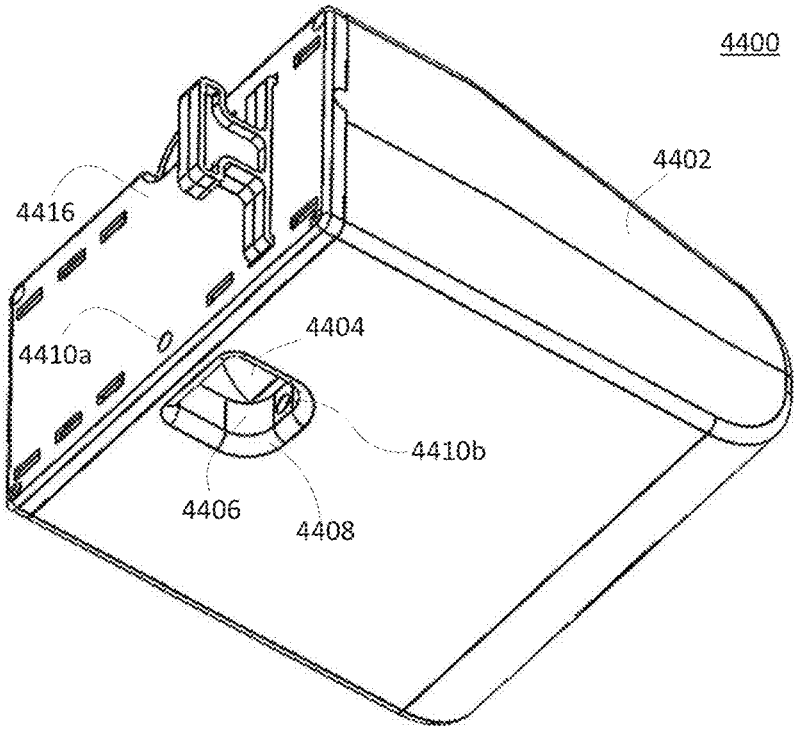
FIG. 52A illustrates a perspective view of an example cable retractor device, according to some embodiments.
Figure 52B:
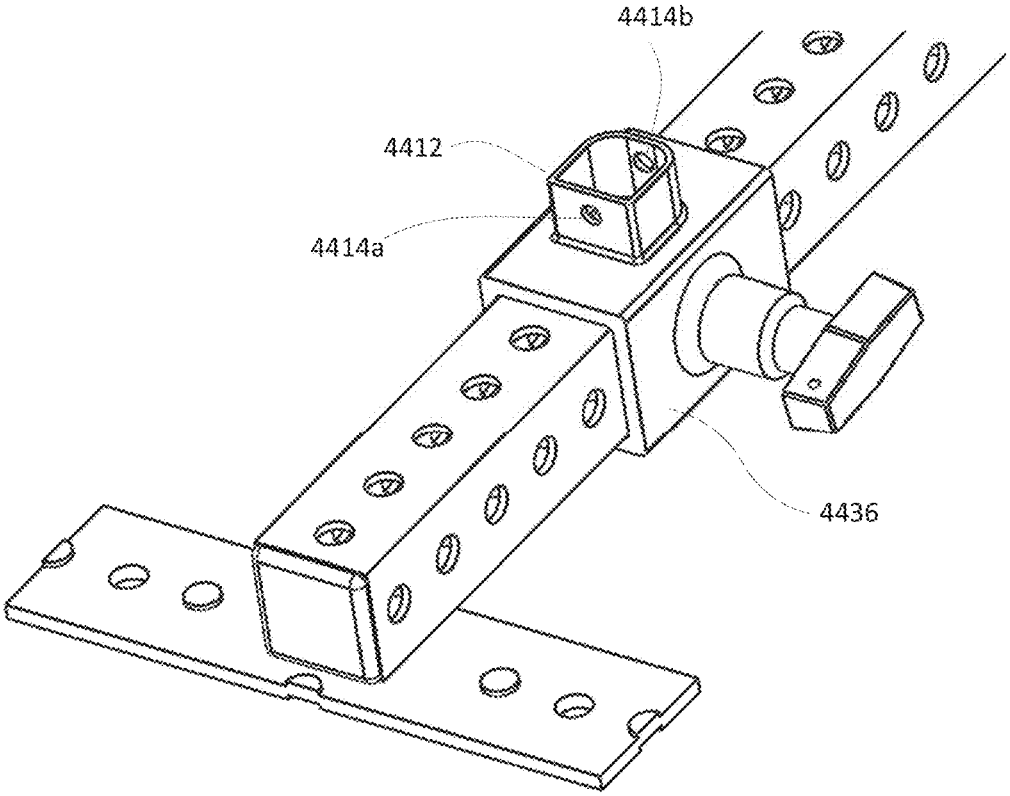
FIG. 52B illustrates a perspective view of an example mounting bracket, according to some embodiments.

FIGS. 52A and 52B illustrate an example mounting system for a cable retractor device. FIG. 52A illustrates an example cable retractor device 4400, which can correspond to cable retractor device 3400. Cable retractor device 4400 can comprise an outer housing 4402, which can correspond to outer housing 3402. In some embodiments, outer housing 4402 can include a mounting hole 4404. Mounting hole 4404 can be configured to mate with a mounting bracket (e.g., mounting bracket 4412 shown in FIG. 52B). In some embodiments, mounting hole 4404 can include and/or be defined in part by mounting hole walls 4406. Mounting hole walls 4406 may extrude into outer housing 4402. In some embodiments, mounting hole 4404 can include a bezel 4408 where mounting hole walls 4406 connect to outer housing 4402. Bezel 4408 can be rounded, angled, or otherwise suitably shaped. Bezel 4408 can help guide insertion of a mounting bracket (e.g., mounting bracket 4412) into mounting hole 4404. In some embodiments, mounting hole walls 4406 may provide additional structural support to cable retractor device 4400 (e.g., outer housing 4402 of cable retractor device 4400) when cable retractor device 4400 is mounted to a mounting bracket (e.g., mounting bracket 4412). In some embodiments, mounting hole 4404 may be defined by an absence of material in outer housing 4402, and mounting hole 4404 may not include mounting hole walls.

Mounting hole 4404, which may be defined at least in part by mounting hole walls 4406, can have a rectangular shape. In some embodiments, mounting hole 4404 may be rectangular with one or more rounded corners. In some embodiments, rounded corners may indicate a directionality of mounting hole 4404, and the rounded corners may correspond to rounded corners on a mounting bracket (e.g., mounting bracket 4412). Although a rectangular shape is depicted, mounting hole 4404 can take any shape, including circular/elliptical, polygonal, and/or a combination of the two.

In some embodiments, outer housing 4402 can include a key pin insertion surface 4416 which can include a locking pin hole 4410*a*. In some embodiments, locking pin hole 4410*a* can be configured to receive a locking pin (e.g., locking pin 4418 shown in FIG. 53A), which may function to hold a mounting bracket in mounting hole 4404. In some embodiments, mounting hole wall 4406 can include a locking pin hole 4410*b*, which may be coaxial with locking pin hole 4410*a*. A locking pin may be received in both locking pin hole 4410*a* and 4410*b*, for example, by protruding through a mounting bracket to hold the mounting bracket in place. Any type of locking pin can be used. For example, a rod (e.g., a metal rod or a plastic rod) can be used as a locking pin. In some embodiments, a rod with an attached ring can be used, and the attached ring can make it easier to remove the locking pin. In some embodiments, a rod can have a small protrusion at an end configured to enter locking hole 4410*b* that may help hold the rod in place (e.g., via friction).

FIG. 52B illustrates an example mounting bracket 4436, which can correspond to mounting bracket 3536. In some embodiments, mounting bracket 4436 can include a mounting extrusion 4412, which can be configured to insert into mounting hole 4404. Mounting extrusion 4412 can be rectangular in shape. In some embodiments, mounting extrusion 4412 can include one or more rounded corners to indicate a directionality of mounting extrusion 4412. In some embodiments, mounting extrusion 4412 can have a shape and/or size corresponding to mounting hole 4404. In some embodiments, mounting extrusion 4412 can be hollow (e.g., a volume inside mounting extrusion 4412 can be empty). In some embodiments, mounting extrusion 4412 can include an inner volume of material (e.g., the same material used for the outer walls of a mounting extrusion). In some embodiments, mounting extrusion 4412 can include a locking pin hole 4414*a* and a locking pin hole 4414*b*. Locking pin holes 4414*a* and 4414*b* can be coaxial, and can be configured to receive a locking pin. In some embodiments, locking pin holes 4414*a* and 4414*b* can be coaxial with locking pin holes 4410*a* and 4410*b*, and locking pin holes 4414*a*, 4414*b*, 4410*a*, and 4410*b* can be configured to receive a single locking pin when mounting bracket 4436 is inserted in mounting hole 4404. In certain embodiments, the mounting hole 4404 is between 1.4 inches and 1.0 inches square, is between 1.3 inches and 1.1 inches square, or is approximately 1.18 inches square. In some embodiments, the mounting hole 4404 has rounded corners. In some embodiments, the mounting hole has rounded corners. In some embodiments, the mounting extrusions 4412 is approximately 0.02 inches smaller (e.g., approximately 1.16 inches square) to ensure secure engagement.

Figure 53A:
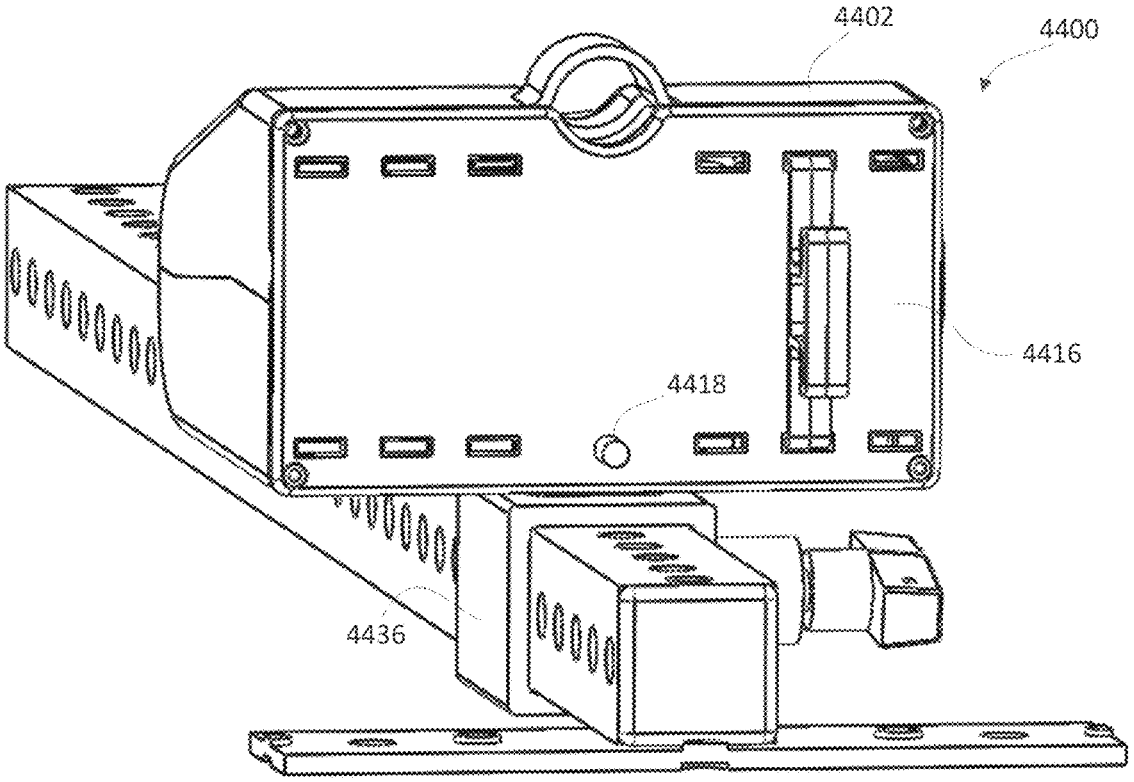
FIG. 53A illustrates a perspective view of an example cable retractor device mounted to an example mounting bracket, according to some embodiments.
Figure 53B:
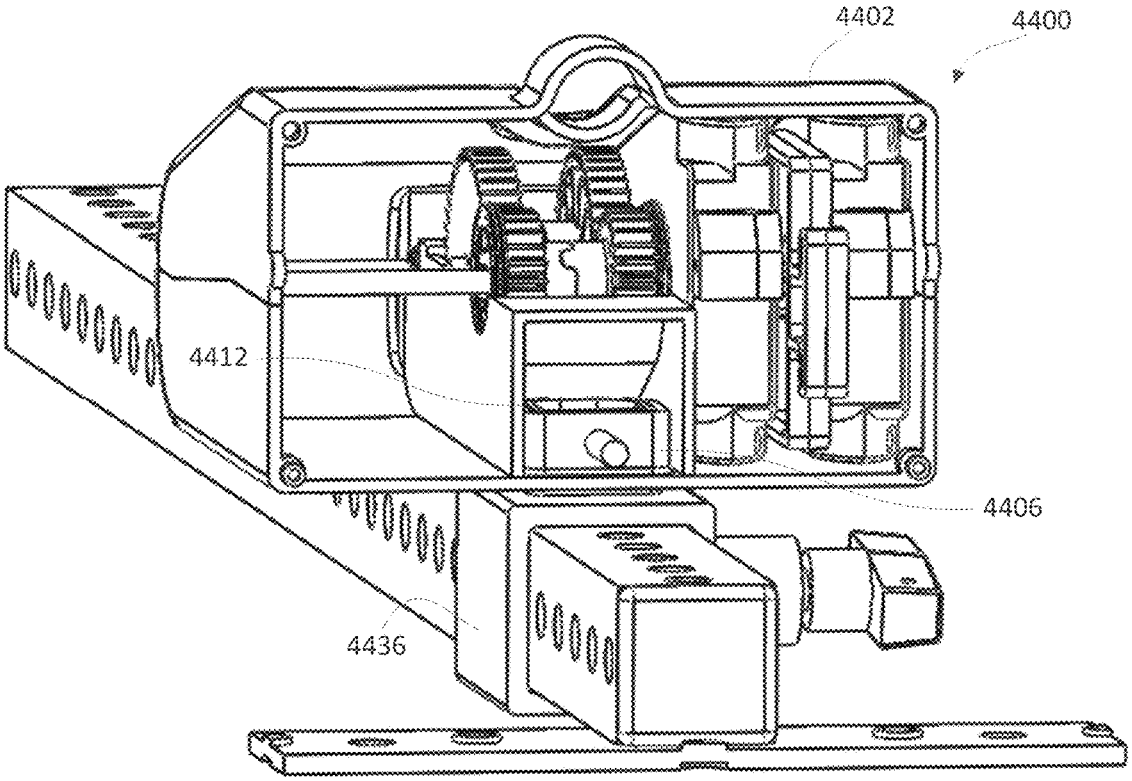
FIG. 53B illustrates a perspective view of an example cable retractor device mounted to an example mounting bracket, according to some embodiments.

FIGS. 53A and 53B illustrate an example cable retractor device mounted on an example mounting bracket. In FIG. 53A, an outer housing of an example cable retractor device is shown with a key pin insertion surface 4416. In some embodiments, a locking pin 4418 can be used to maintain a connection between cable retractor device 4400 and mounting bracket 4436. In some embodiments, key pin insertion surface 4416 can be configured to face upwards (e.g., away from a ground surface) in use of cable retractor device 4400. Locking pin 4418 may be held in place using gravity. In some embodiments, a mechanical attachment (e.g., a small protrusion at the bottom of locking pin 4418) can also be used to hold locking pin 4418 in place.

FIG. 53B illustrates an example mating mechanism between cable retractor device 4400 and mounting bracket 4436. In some embodiments, mounting hole wall 4406 can be configured to conform (e.g., wrap around) mounting extrusion 4412. Mounting hole wall 4406 may provide additional structural support to secure the connection between cable retractor device 4400 and mounting bracket 4436.

Figure 54C:
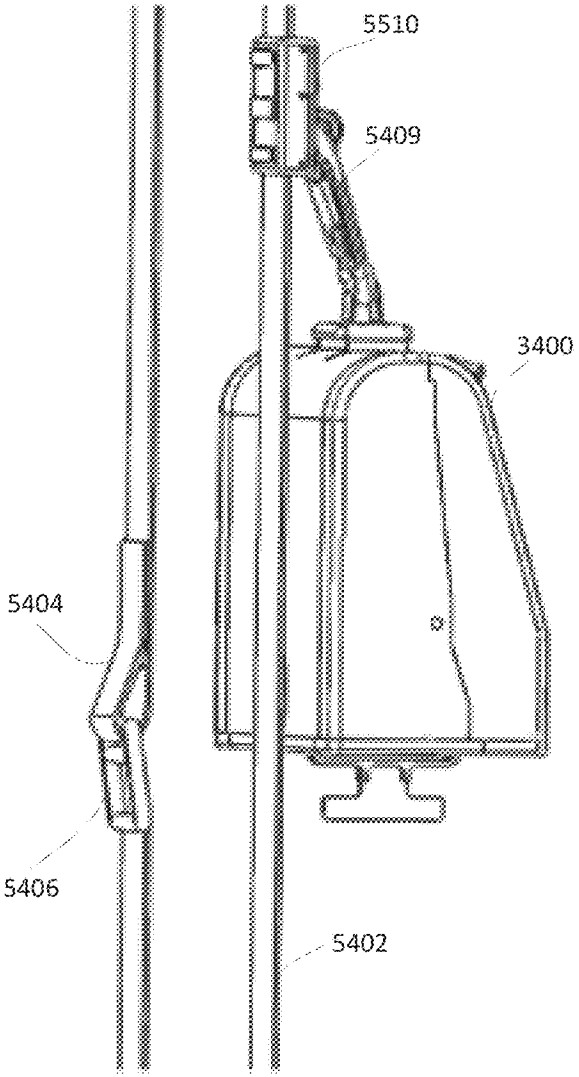
FIGS. 54A-54C illustrate an example cable retractor device mounted to a belt strap, according to some embodiments.
Figure 54B:
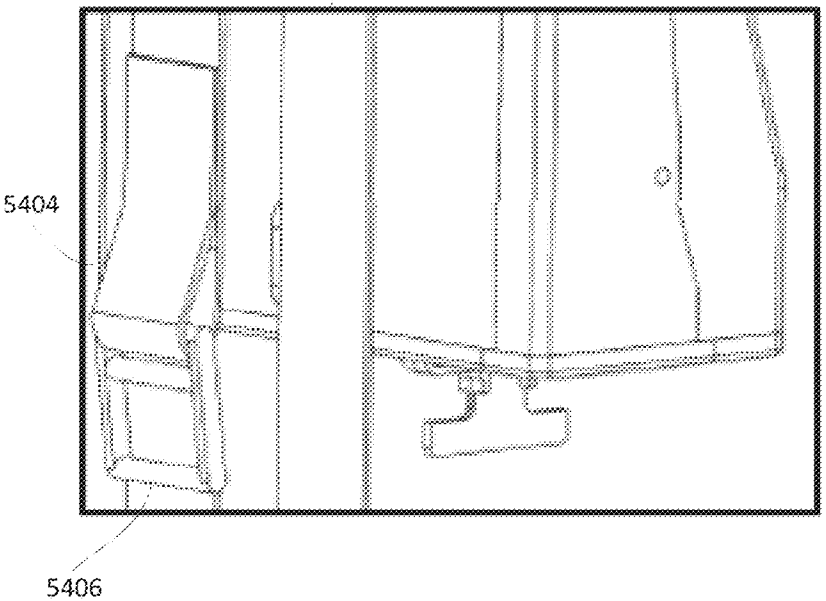
Figure 54A:
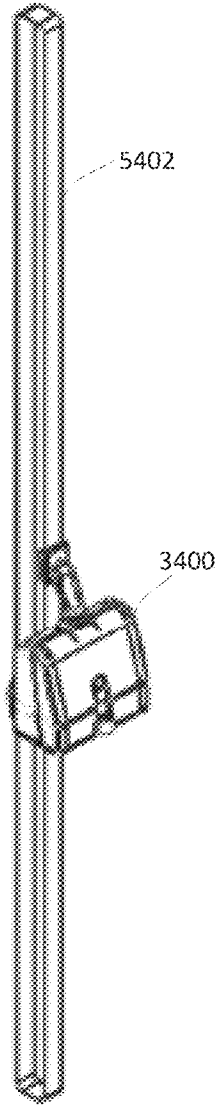

The cable retractor device 3400 may be secured to other mechanisms, such as a belt strap. FIGS. 54A-54C illustrate an example cable retractor device 3400 mounted to a belt strap 5402. The belt strap 5402 may be made of any material including, but not limited to, cloth, leather, polymer, or canvas. The belt strap 5402 may be wrapped around, e.g., a stationary object (e.g., a closed door). The belt strap 5402 may comprise a belt loop 5404 at one end and a belt connector 5406 and the other end. The belt strap 5402 can loop around the door, and the belt loop 5402 can connect with the belt connector 5406.

Figure 55A:
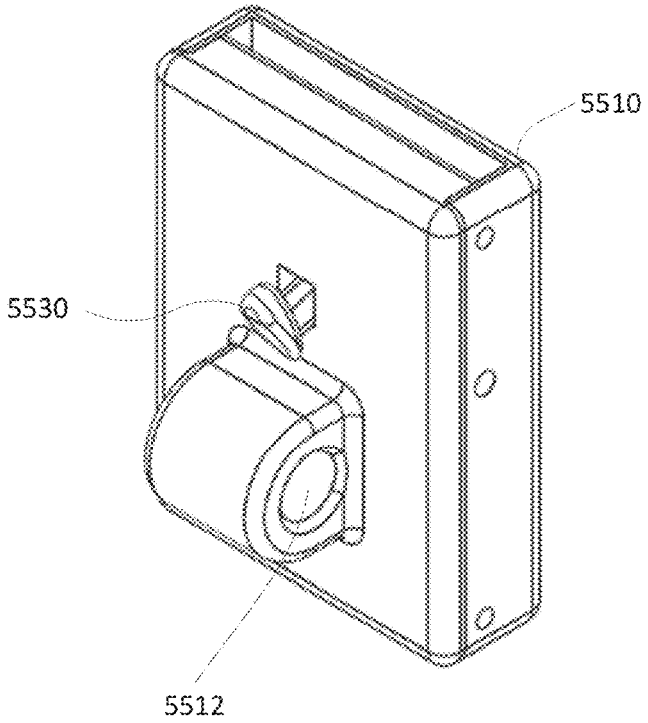
FIGS. 55A and 55B illustrate an example slider device for securing the cable retractor device to the belt strap, according to some embodiments.
Figure 55B:
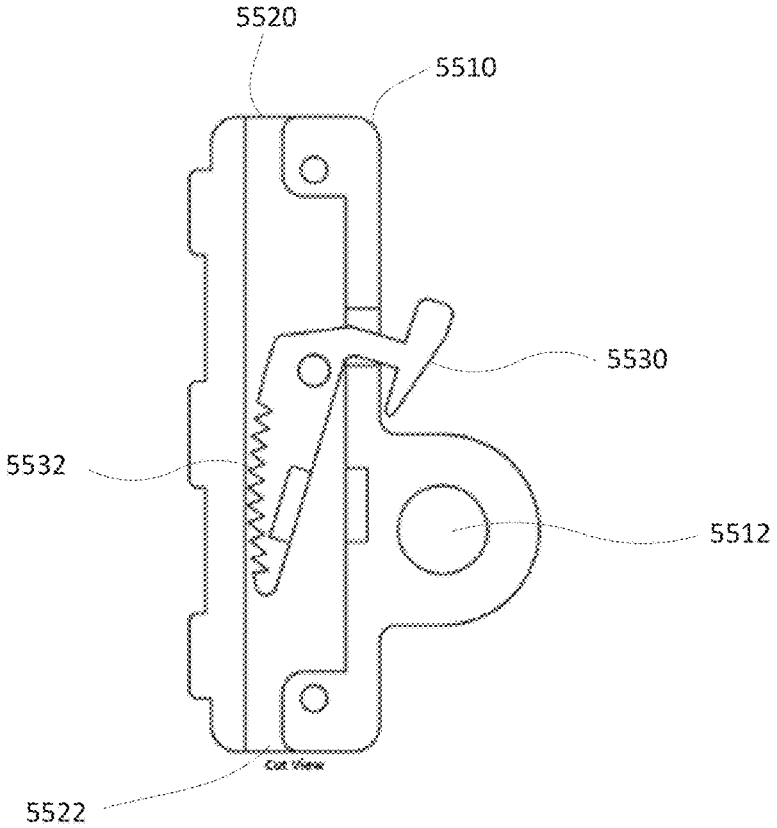

The cable retractor device 3400 may be secured to the belt strap 5402 using a slider device. FIGS. 55A and 55B illustrate an example slider device for securing the cable retractor device 3400 to the belt strap 5402. The cable retractor device 3400 can be attached to the slider device 5510 by using, e.g., a carabiner 5409 to attach loop 5512 of the slider device to loop 3544 of the cable retractor device 3400. The belt strap 5402 can pass through the slider device 5510 at top and bottom ends 5520 and 5522, respectively. When the button 5530 is at a first position (e.g., not pressed), a spring may force the teeth 5532 to make contact with the belt strap 5402, preventing the slider device 5510 from moving along the belt strap 5402 or restrict its movement. In some embodiments, the orientation of the teeth 5532 may allow the slider device 5510 to be moved in only one direction (e.g., up) when engaged. When the button 5530 is at a second position (e.g., pressed down), the spring load may be released, and the teeth 5532 may not prevent the slider device 5510 from moving along the belt strap 5402, and the user may position the cable retractor device 3400 by sliding it up or down along the belt strap 5402.

Figure 56C:
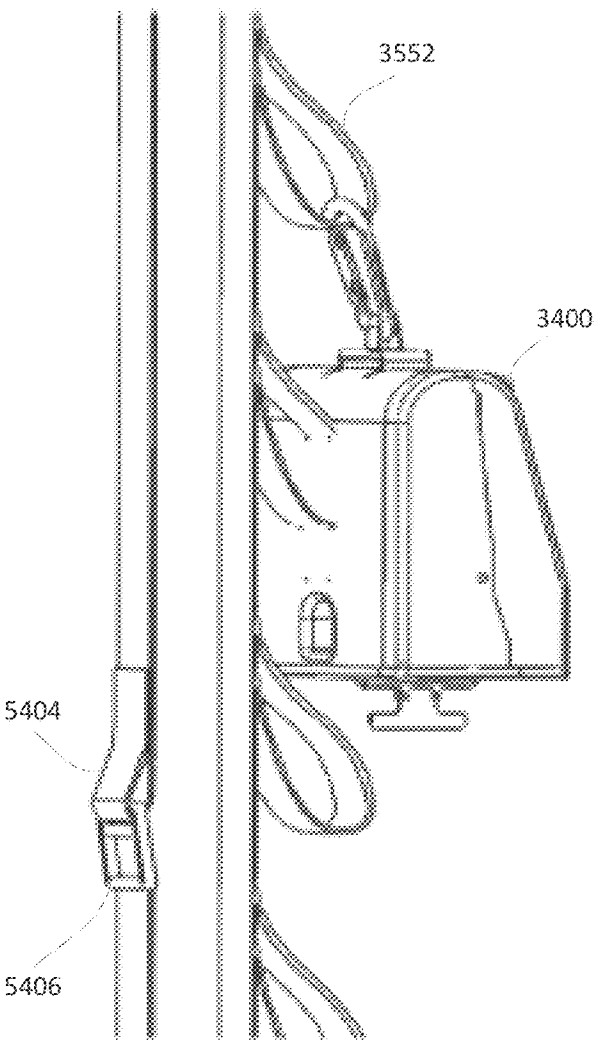
FIGS. 56A-56C illustrate an example cable retractor device mounted to a portable belt, according to some embodiments.
Figure 56B:
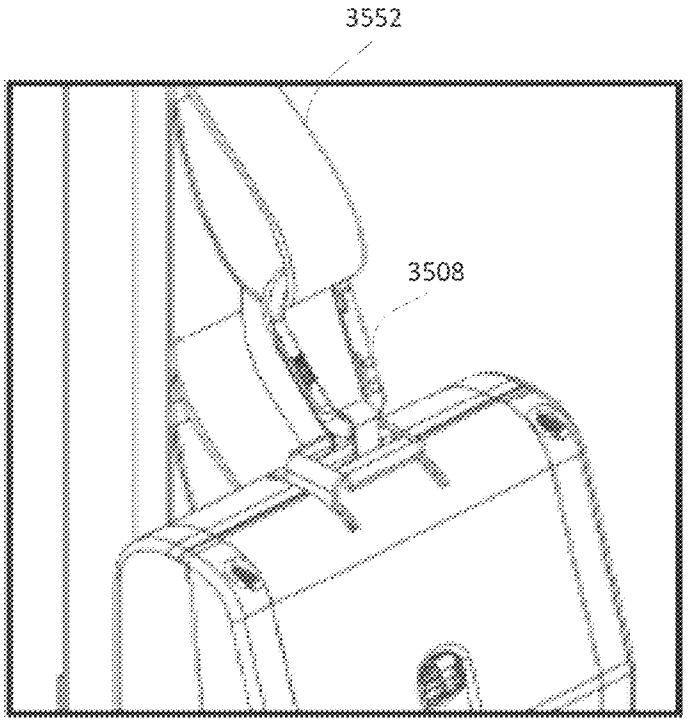
Figure 56A:
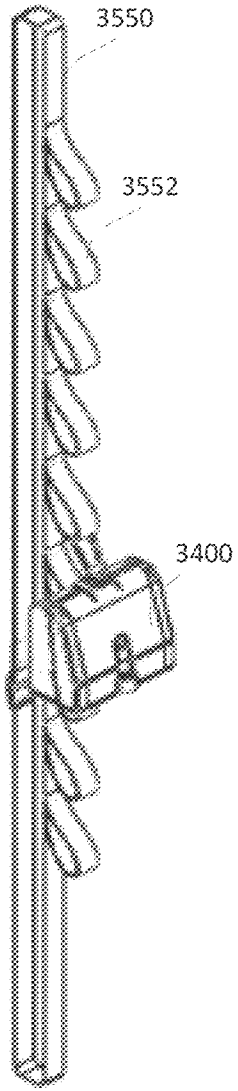
Figure 56D:
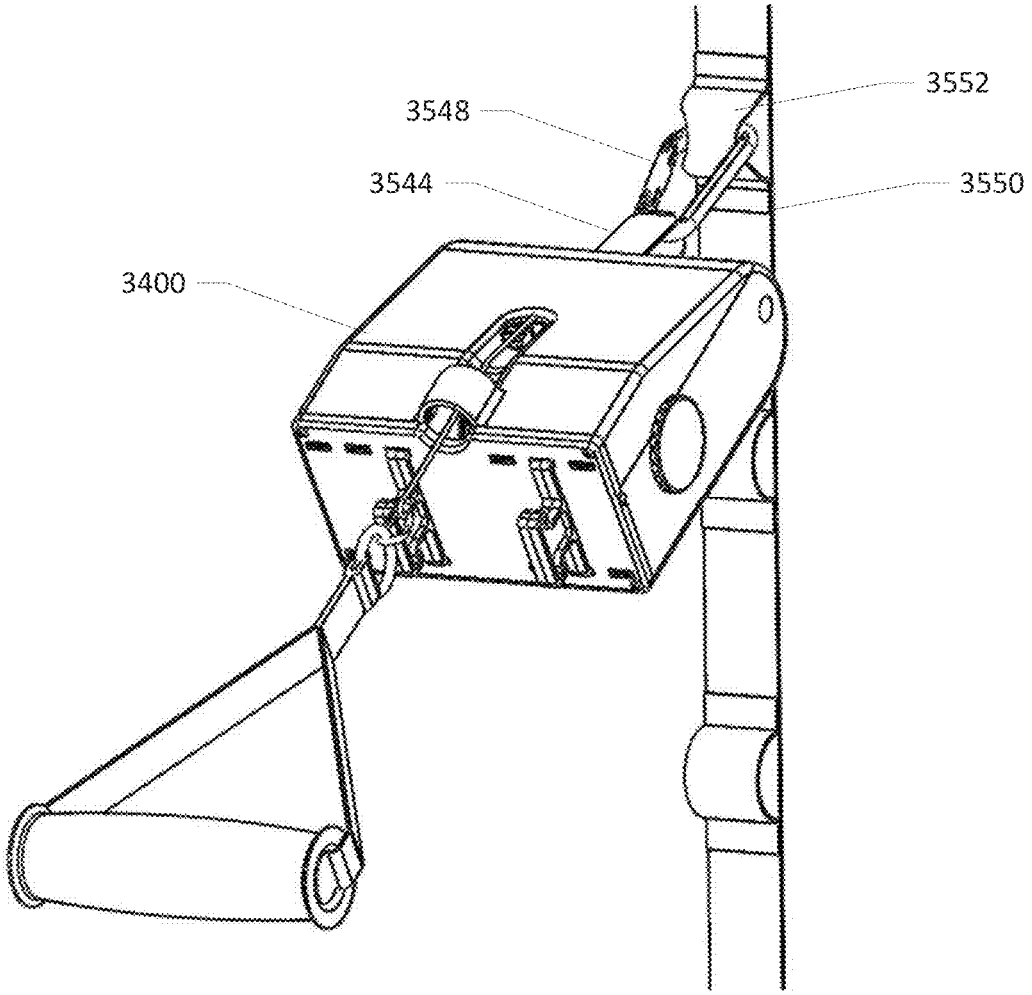
FIG. 56D illustrates another perspective view of an example cable retractor device in use, according to some embodiments.

In some embodiments, the cable retractor device 3400 may be mounted to a portable belt. FIGS. 56A-56C illustrate an example cable retractor device 3400 mounted to a portable belt 3550. Portable belt 3550 can be used when no poles are available to a user (e.g., during travel). Portable belt 3550 can comprise one or more belt loops 3552, and portable belt 3550 can wrap around a stationary object (e.g., a closed door). A user can then mount cable retractor device 3400 to portable belt 3550 using a belt loop 3552 at an appropriate height. Cable retractor device 3400 can be mounted to portable belt 3550 by feeding a loop 3544 through a hole 3542 on cable retractor device 3400. A carabiner 3548 can then attach loop 3544 to belt loop 3552. However, other means of attaching cable retractor device 3400 to belt loop 3552 are also contemplated (e.g., tying cable retractor device to belt loop 3552 directly with loop 3544). Referring back to FIG. 43A, cable retractor device 3400 can be prepared for use with a portable belt 3550 by detaching handle 3506 from carabiner 3508. Carabiner 3508 and cable 3510 can then be fed under arch 3410, and handle 3506 can be reattached to carabiner 3508. FIG. 56D illustrates an example cable retractor device 3400 in use, where the cable retractor device 3400 is mounted to a portable belt 3550.

In some embodiments, the cable retractor device may have a mounting loop (e.g., mounting loop 4720 of FIGS. 44A, 44C, 44E, and 44F) where the portable belt 3550 can be attached to the mounting loop and loop 3544 may be threaded through. In certain embodiments, rod 142A may pass through mounting loop 4720 to provide greater rigidity and stability to the cable retractor device and to mounting loop 4720. In some embodiments, mounting loop 4720 is metal, such as sheet metal (e.g., steel or aluminum).

In some embodiments, an apparatus for providing a constant level of resistance comprises: a resistance module configured to provide a constant-force resistance. The resistance module comprises a constant-force spring having a spring force, and the spring force is less than or equal to the constant-force resistance. The apparatus further comprises a first gear configured to mate with the resistance module and cause the constant-force spring to exert the spring force; and a second gear configured to mate with the first gear. A gearing ratio between the first gear and the second gear is a ratio between the constant-force resistance and the spring resistance.

In some embodiments, the constant-force resistance is 0.5 to 100 pounds.

In some embodiments, the constant-force resistance is 1, 2, 2.5, 3, 5, 10, 15, 20, 25, 30, 40, 50, 75, or 100 pounds.

In some embodiments, the spring force is 0.25 to 50 pounds.

In some embodiments, the gearing ratio is between 5:1 and 1.2:1, between 4:1 and 1.4:1, between 3:1 and 1.6:1, or 2:1.

In some embodiments, the apparatus further comprises: a second resistance module configured to provide a second constant-force resistance; a third gear configured to mate with the second resistance module and cause a second constant-force spring of the second resistance module to exert a second spring force; and a fourth gear configured to mate with the third gear. The first and second resistance modules are configured to provide a third constant-force resistance based on the first and second constant-force resistances.

In some embodiments, the second constant-force resistance is 0.5 to 100 pounds.

In some embodiments, the second constant-force resistance is 1, 2, 2.5, 3, 5, 10, 15, 20, 25, 30, 40, 50, 75, or 100 pounds.

In some embodiments, the second spring force is 0.25 to 50 pounds.

In some embodiments, the first gear is configured to mate with the third gear, and wherein the second gear is configured to mate with the fourth gear.

In some embodiments, the second gear and the fourth gear form a cable spool when mated.

In some embodiments, the cable spool further comprises a plurality of removable spool portions.

In some embodiments, the resistance module comprises a first coupling component and a first drum, and a first end of the constant-force spring is connected to the first drum.

In some embodiments, the resistance module further comprises: a second drum, wherein a second end of the constant-force spring is connected to the second drum.

In some embodiments, the apparatus further comprises a detachable key pin for adjusting the constant level of resistance.

In some embodiments, the apparatus further comprises a mounting hole, wherein the mounting hole is enclosed by mounting hole walls.

In some embodiments, the apparatus further comprises a mounting loop.

In some embodiments, an apparatus for providing a resistance comprises: a resistance module configured to provide a resistance; a first gear configured to mate with the resistance module; a second gear configured to mate with the first gear; a wedge. The wedge is configured to prevent the first gear or the second gear from rotating when the resistance module is not mated with the first gear, and the wedge is configured to allow the first gear and the second gear to rotate when the resistance module is mated with the first gear.

In some embodiments, the wedge is further configured to attach to a spring, and wherein the spring is configured to attach to an anchoring point.

In some embodiments, the wedge is at a first end of an arm, wherein the arm is rotatably attached to an inner gear housing.

In some embodiments, the resistance module mating with the first gear is configured to activate a rack and pinion system configured to: press against a second end of the arm and cause the arm to rotate and disengage the wedge from the first gear or the second gear.

In some embodiments, the resistance module mating with the first gear is configured to activate a lever system configured to: press against a second end of the arm and cause the arm to rotate and disengage the wedge from the first gear or the second gear.

In some embodiments, an apparatus for providing a continuously-variable resistance comprises: a continuously-variable gear. The continuously-variable gear comprises: a conical portion, the conical portion comprising a continuously-variable diameter, and a cylindrical portion, the cylindrical portion comprising a grooved portion. The apparatus further comprises a belt mated with the continuously-variable gear via the conical portion. The belt is configured to cause the continuously-variable gear to rotate. The apparatus further comprises a resistance module configured to provide a constant-force resistance. The resistance module is configured to mate with the continuously-variable gear. A rotation of the continuously-variable gear causes the continuously-variable resistance to be provided based on the constant-force resistance.

In some embodiments, rotating the continuously-variable gear in a first angular direction about a rotational axis causes the continuously-variable resistance to decrease, and rotating the continuously-variable gear in a second angular direction about the rotational axis causes the continuously-variable resistance to increase.

In some embodiments, the apparatus further comprises a grooved sleeve, wherein the grooved sleeve is configured to mate with the continuously-variable gear and with the resistance module.

In some embodiments, the apparatus further comprises an axle. The axle comprises a threaded portion, and the axle extends through the continuously-variable gear via the grooved portion of the continuously-variable gear.

In some embodiments, wherein the continuously-variable gear is configured to move along the axle while the continuously-variable gear rotates.

In some embodiments, the resistance module is configured to move in a same direction as the continuously-variable gear.

In some embodiments, the apparatus further comprises a second continuously-variable gear and a second resistance module configured to mate with the second continuously-variable gear. The belt is mated with the second continuously-variable gear via a conical portion of the second continuously-variable gear, and the belt is configured to cause the second continuously-variable gear to rotate.

In some embodiments, rotating the first continuously-variable gear in a first angular direction about an axis of rotation causes the continuously-variable gear to move away from the second continuously-variable gear along the axis of rotation, and rotating the first continuously-variable gear in a second angular direction about the axis of rotation causes the continuously-variable gear to move toward the second continuously-variable gear along the axis of rotation.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims.

What is claimed is:

1. An apparatus for providing a resistance, the apparatus comprising:
- a resistance module configured to provide a resistance;
- a first gear configured to mate with the resistance module;
- a second gear configured to mate with the first gear;
- a wedge, wherein the wedge is configured to prevent the first gear or the second gear from rotating when the resistance module is not mated with the first gear, and wherein the wedge is configured to allow the first gear and the second gear to rotate when the resistance module is mated with the first gear;
- wherein the resistance module mating with the first gear is configured to activate a lever system, the lever system configured to:
  - press against an end of an arm and cause the arm to rotate and disengage the wedge from the first gear or the second gear, or
  - activate a rack and pinion system configured to:
    - press against an end of the arm and cause the arm to rotate and disengage the wedge from the first gear or the second gear.

2. The apparatus of claim 1, wherein:
- the resistance module is configured to provide a constant-force resistance, wherein:
  - the resistance module comprises a constant-force spring having a spring force, and
  - the spring force is less than or equal to the constant-force resistance;
- the first gear is configured to cause the constant-force spring to exert the spring force,
- wherein a gearing ratio between the first gear and the second gear is a ratio between the constant-force resistance and the spring force.

3. The apparatus of claim 2, wherein the constant-force resistance is between 0.5 to 100 pounds.

4. The apparatus of claim 2, wherein the spring force is between 0.25 to 50 pounds.

5. The apparatus of claim 2, wherein the gearing ratio is between 5:1 and 1.2:1, between 4:1 and 1.4:1, between 3:1 and 1.6:1, or 2:1.

6. The apparatus of claim 2, further comprising:
- a second resistance module configured to provide a second constant-force resistance;
- a third gear configured to mate with the second resistance module and cause a second constant-force spring of the second resistance module to exert a second spring force; and
- a fourth gear configured to mate with the third gear, wherein the first and second resistance modules are configured to provide a third constant-force resistance based on the first and second constant-force resistances.

7. The apparatus of claim 2, wherein:
- the resistance module comprises a first coupling component and a first drum, and
- a first end of the constant-force spring is connected to the first drum.

8. The apparatus of claim 2, further comprising a detachable key pin for adjusting the constant level of resistance.

9. The apparatus of claim 2, further comprising a mounting hole, wherein the mounting hole is enclosed by mounting hole walls.

10. The apparatus of claim 2, further comprising a mounting loop.

11. The apparatus of claim 1, wherein the wedge is further configured to attach to a spring, and wherein the spring is configured to attach to an anchoring point.

12. The apparatus of claim 1, wherein the wedge is at a second end of the arm, wherein the arm is rotatably attached to an inner gear housing.

13. An apparatus for providing a continuously-variable resistance, the apparatus comprising:

a continuously-variable gear, wherein the continuously-variable gear comprises:

a conical portion, the conical portion comprising a continuously-variable diameter, and a cylindrical portion, the cylindrical portion comprising a grooved portion;

a belt mated with the continuously-variable gear via the conical portion, wherein the belt is configured to cause the continuously-variable gear to rotate;

a resistance module configured to provide a constant-force resistance, wherein the resistance module is configured to mate with the continuously-variable gear, wherein:

a rotation of the continuously-variable gear causes the continuously-variable resistance to be provided based on the constant-force resistance; and a second continuously-variable gear and a second resistance module configured to mate with the second continuously-variable gear, wherein:

the belt is mated with the second continuously-variable gear via a conical portion of the second continuously-variable gear, and the belt is configured to cause the second continuously-variable gear to rotate.

14. The apparatus of claim 13, wherein:

rotating the continuously-variable gear in a first angular direction about a rotational axis causes the continuously-variable resistance to decrease, and rotating the continuously-variable gear in a second angular direction about the rotational axis causes the continuously-variable resistance to increase.

15. The apparatus of claim 13, further comprising a grooved sleeve, wherein the grooved sleeve is configured to mate with the continuously-variable gear and with the resistance module.

16. The apparatus of claim 13, further comprising an axle, wherein:

the axle comprises a threaded portion, and the axle extends through the continuously-variable gear via the grooved portion of the continuously-variable gear.

17. The apparatus of claim 13, further comprising a tensioner configured to adjust a tension of the belt.

18. An apparatus for providing a continuously-variable resistance, the apparatus comprising:

a continuously-variable gear, wherein the continuously-variable gear comprises:

a conical portion, the conical portion comprising a continuously-variable diameter, and a cylindrical portion, the cylindrical portion comprising a grooved portion;

a belt mated with the continuously-variable gear via the conical portion, wherein the belt is configured to cause the continuously-variable gear to rotate; and a resistance module configured to provide a constant-force resistance, wherein:

the resistance module is configured to mate with the continuously-variable gear, a rotation of the continuously-variable gear causes the continuously-variable resistance to be provided based on the constant-force resistance, the resistance module comprises a first coupling component, a first drum, and a constant-force spring having the resistance level, and a first end of the constant-force spring is connected to the first drum.

* * * * *